US008993205B2

(12) United States Patent
Nakamura et al.

(10) Patent No.: US 8,993,205 B2
(45) Date of Patent: Mar. 31, 2015

(54) ELECTROPHOTOGRAPHIC PHOTOSENSITIVE MEMBER, PROCESS CARTRIDGE, AND ELECTROPHOTOGRAPHIC APPARATUS

(71) Applicant: Canon Kabushiki Kaisha, Tokyo (JP)

(72) Inventors: Nobuhiro Nakamura, Mishima (JP); Atsushi Okuda, Yokohama (JP); Kunihiko Sekido, Suntou-gun (JP); Michiyo Sekiya, Atami (JP); Yota Ito, Mishima (JP); Kenichi Kaku, Newcastle Upon Tyne (GB); Hiroyuki Tomono, Numazu (JP); Yuka Ishiduka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/931,327

(22) Filed: Jun. 28, 2013

(65) Prior Publication Data

US 2014/0011127 A1 Jan. 9, 2014

(30) Foreign Application Priority Data

Jun. 29, 2012 (JP) ..... 2012-147161
Apr. 25, 2013 (JP) ..... 2013-093091
Jun. 4, 2013 (JP) ..... 2013-118067

(51) Int. Cl.
*G03G 5/14* (2006.01)
*G03G 5/05* (2006.01)
*G03G 5/06* (2006.01)

(52) U.S. Cl.
CPC ..... *G03G 5/142* (2013.01); *G03G 5/0575* (2013.01); *G03G 5/0589* (2013.01); *G03G 5/0592* (2013.01); *G03G 5/0596* (2013.01); *G03G 5/0609* (2013.01); *G03G 5/0612* (2013.01);
(Continued)

(58) Field of Classification Search
CPC . G03G 9/0575; G03G 9/0592; G03G 9/0609; G03G 9/065; G03G 9/0657; G03G 9/0589; G03G 9/0596; G03G 9/0612; G03G 9/0651; G03G 9/1425
USPC ..... 430/60, 62
See application file for complete search history.

(56) References Cited

U.S. PATENT DOCUMENTS 4,442,193 A 4/1984 Chen
4,562,132 A 12/1985 Ong et al.
4,992,349 A 2/1991 Chen
(Continued)

FOREIGN PATENT DOCUMENTS

EP 1542082 A1 6/2005
EP 2033961 A1 3/2009
(Continued)

OTHER PUBLICATIONS

Translation of JP 09-127716 published May 1997.*
(Continued)

*Primary Examiner* — Peter Vajda
(74) *Attorney, Agent, or Firm* — Canon USA, Inc. IP Division

(57) ABSTRACT

An electrophotographic photosensitive member comprises a support, an undercoat layer formed on the support, and a photosensitive layer formed on the undercoat layer, wherein the undercoat layer has a structure represented by the formula (C1) or the formula (C2).

8 Claims, 4 Drawing Sheets

(52) U.S. Cl.
CPC ..... *G03G 5/065* (2013.01); *G03G 5/0651* (2013.01); *G03G 5/0657* (2013.01)
USPC ..... 430/62; 430/60

(56) References Cited

U.S. PATENT DOCUMENTS

| | | | |
|---|---|---|---|
| 5,468,583 | A | 11/1995 | Gruenbaum |
| 5,747,206 | A | 5/1998 | Agata et al. |
| 5,795,690 | A | 8/1998 | Takegawa |
| 7,670,740 | B2 | 3/2010 | Wu et al. |
| 7,781,132 | B2 | 8/2010 | Yanus et al. |
| 2004/0166427 | A1 | 8/2004 | Tong |
| 2006/0281020 | A1 | 12/2006 | Kim |
| 2007/0026332 | A1 | 2/2007 | Ferrar |
| 2007/0059619 | A1 | 3/2007 | Shimoyama |
| 2011/0318675 | A1 | 12/2011 | Yu |
| 2012/0064442 | A1 | 3/2012 | Kawabata |
| 2014/0011127 | A1 | 1/2014 | Nakamura et al. |

FOREIGN PATENT DOCUMENTS

| | | | | |
|---|---|---|---|---|
| EP | 2107424 | A1 | | 10/2009 |
| EP | 2180376 | A2 | | 4/2010 |
| JP | 1-206349 | A | | 8/1989 |
| JP | 5-279582 | A | | 10/1993 |
| JP | 7-70038 | A | | 3/1995 |
| JP | 09-127716 | | * | 5/1997 |
| JP | 9-151157 | A | | 6/1997 |
| JP | 2001-83726 | A | | 3/2001 |
| JP | 2003-330209 | A | | 11/2003 |
| JP | 2003-345044 | A | | 12/2003 |
| JP | 2004093801 | A | | 3/2004 |
| JP | 2006-178504 | A | | 7/2006 |
| JP | 2007-148293 | A | | 6/2007 |
| JP | 2008-65173 | A | | 3/2008 |
| JP | 2008-250082 | A | | 10/2008 |
| JP | 2008-299344 | A | | 12/2008 |
| JP | 2009-505156 | A | | 2/2009 |

OTHER PUBLICATIONS

U.S. Appl. No. 13/930,334, filed Jun. 28, 2013, Hiroyuki Tomono.
U.S. Appl. No. 13/931,215, filed Jun. 28, 2013, Atsushi Okuda.
U.S. Appl. No. 13/930,869, filed Jun. 28, 2013, Kunihiko Sekido.
Brooks A. Jones et al., "Cyanonaphthalene Diimide Semiconductors for Air-Stable, Flexible, and Optically Transparent n-Channel Field-Effect Transistors", Chemistry of Materials,vol. 19, No. 11, 2703-2705(2007).
Hiroyuki Miyamura et al, "Polymer Incarcerated Gold Catalyzed Aerobic Oxidation of Hydroquinones and their Derivatives", Chemistry Letters, 37(3),360-361(2008).
Hideki Okada, et al., Synthesis and Properties of a Novel Electron Transporting Compound, 3,3'-dialkyl-4,4'-bisnaphthylquinone (DBNQ), PPCI Japan Hard Copy'98 p. 207, 1998.
Ronald Callahan, et al, "Syntheses of Phencyclone Analogues . . . ", Chem. Educator No. 6, 227-234(2001).
Masaki Yamada, et al., "Synthesis and Properties of Diamino-Substituted Dipyrido [3,2-a: 2',3'-c]phenazine", Bull. Chem.Soc. Jpn.,vol. 65,1006-1011(1992).
Tetrahedron Letters,43(16),2991-2994(2002).
Tetrahedron Letters,44(10),2087-2091(2003).
Brooks A. Jones, et al., "Tuning Orbital Energetics in Arylene Diinlide Semiconductors, Materials Design for Ambient Stability of n—Type Charge Transport", Journal of the American chemical society,vol. 129, No. 49, 15259-78 (2007).

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member and to a process cartridge and an electrophotographic apparatus each including the electrophotographic photosensitive member.

2. Description of the Related Art

Nowadays, electrophotographic photosensitive members containing organic photoconductive substances predominate are the mainstream of electrophotographic photosensitive members for use in process cartridges and electrophotographic apparatuses. In general, an electrophotographic photosensitive member includes a support and a photosensitive layer formed on the support. To inhibit the charge injection from the support side to the photosensitive layer side and inhibit the occurrence of image defects, such as fog, an undercoat layer is provided between the support and the photosensitive layer.

In recent years, charge-generating substances having higher sensitivities have been used. However, there is a problem in which a higher sensitivity of a charge-generating substance result in a larger amount of charges generated; hence, the charges are liable to stay in the photosensitive layer, thereby easily causing a ghost. Specifically, a phenomenon, i.e., a positive ghost phenomenon, in which the density is increased at only a portion of an output image corresponding to a portion that has been irradiated with light at the time of previous rotation, is liable to occur.

As a technique for inhibiting (reducing) such a ghost phenomenon, a technique for incorporating an electron-transporting substance into an undercoat layer is known. In the case where the electron-transporting substance is incorporated into the undercoat layer in order not to elute the electron-transporting substance at the time of the formation of the photosensitive layer on the undercoat layer, a technique for using an undercoat layer composed of a curable material that is not easily dissolved in a solvent of a photosensitive layer coating liquid is known.

PCT Japanese Translation Patent Publication No. 2009-505156 discloses an undercoat layer which contains a condensation polymer (electron-transporting substance) having an aromatic tetracarbonylbisimide skeleton and a cross-linking site and which contains a polymer with a cross-linking agent. Japanese Patent Laid-Open Nos. 2003-330209 and 2008-299344 disclose an undercoat layer containing a polymer of a non-hydrolyzable polymerizable functional group electron-transporting substance.

In recent years, electrophotographic images have been required to have better image quality, so the tolerance for the foregoing positive ghost has been extremely tightened.

The inventors have conducted studies and found that with respect to the inhibition (reduction) of the positive ghost, in particular, a change in the level of the positive ghost before and after continuous image output, the techniques disclosed in PCT Japanese Translation Patent Publication No. 2009-505156 and Japanese Patent Laid-Open Nos. 2003-330209 and 2008-299344 still have room for improvement. In the techniques disclosed in PCT Japanese Translation Patent Publication No. 2009-505156 and Japanese Patent Laid-Open Nos. 2003-330209 and 2008-299344, the positive ghost is not sufficiently reduced during the initial stage and repeated use, in some cases.

SUMMARY OF THE INVENTION

Aspects of the present invention provide an electrophotographic photosensitive member that reduces a positive ghost, and a process cartridge and an electrophotographic apparatus each including the electrophotographic photosensitive member.

One disclosed aspect of the present invention provides an electrophotographic photosensitive member comprising a support, an undercoat layer formed on the support, and a photosensitive layer formed on the undercoat layer, in which the undercoat layer comprises a structure represented by the following formula (C1), or a structure represented by the following formula (C2), (C1)

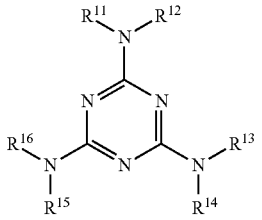

(C2)

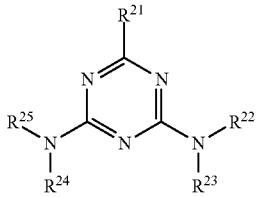

wherein, in the formulae (C1) and (C2), $R^{11}$ to $R^{16}$, and $R^{22}$ to $R^{25}$ each independently represent a hydrogen atom, a methylene group, a monovalent group represented by $—CH_2OR^2$, a group represented by the following formula (i), or a group represented by the following formula (ii), at least one of $R^{11}$ to $R^{16}$, and at least one of $R^{22}$ to $R^{25}$ are each the group represented by the formula (i), at least one of $R^{11}$ to $R^{16}$, and at least one of $R^{22}$ to $R^{25}$ are each the group represented by the formula (ii), $R^2$ represents a hydrogen atom or an alkyl group having 1 to 10 carbon atoms, and $R^{21}$ represents an alkyl group, a phenyl group, or a phenyl group substituted with an alkyl group, (i)

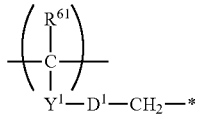

wherein, in the formula (i), $R^{61}$ represents a hydrogen atom or an alkyl group, $Y^1$ represents a single bond, an alkylene group, or a phenylene group, $D^1$ represents a divalent group represented by any one of the following formulae (D1) to (D4), and "*" in the formula (i) indicates the side to which a nitrogen atom in the formula (C1) or a nitrogen atom in the formula (C2) is bound, (D1)

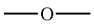

(D2)

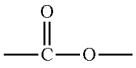

(D3)

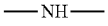

(D4)

(ii)

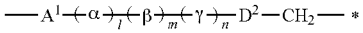

wherein, in the formula (ii), $D^2$ represents a divalent group represented by any one of the above formulae (D1) to (D4), α represents an alkylene group having 1 to 6 main-chain atoms, an alkylene group having 1 to 6 main-chain atoms and being substituted with an alkyl group having 1 to 6 carbon atoms, an alkylene group having 1 to 6 main-chain atoms and being substituted with a benzyl group, an alkylene group having 1 to 6 main-chain atoms and being substituted with an alkoxycarbonyl group, or an alkylene group having 1 to 6 main-chain atoms and being substituted with a phenyl group, one of the carbon atoms in the main chain of the alkylene group may be replaced with O, S, NH, or $NR^1$, $R^1$ representing an alkyl group having 1 to 6 carbon atoms, β represents a phenylene group, a phenylene group substituted with an alkyl group having 1 to 6 carbon atoms, a phenylene group substituted with a nitro group, or a phenylene group substituted with a halogen atom, γ represents an alkylene group having 1 to 6 main-chain atoms, or an alkyl group having 1 to 6 main-chain atoms and being substituted with an alkyl group having 1 to 6 carbon atoms, l, m, and n each independently represent 0 or 1, $A^1$ represents a divalent group represented by any one of the following formulae (A1) to (A9), and "*" in the formula (ii) indicates the side to which a nitrogen atom in the formula (C1) or a nitrogen atom in the formula (C2) is bound, (A1)

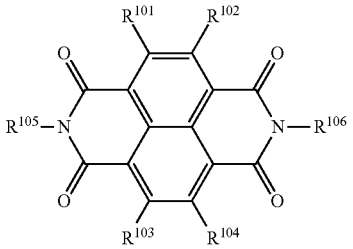

(A2)

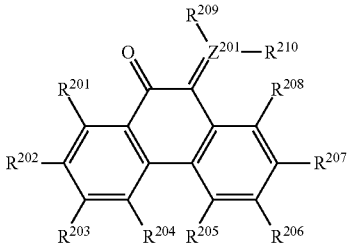

-continued (A3)

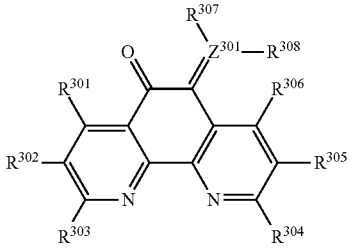

(A4)

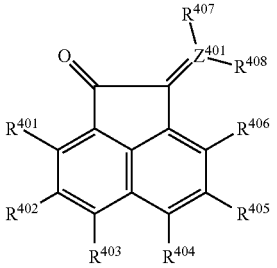

(A5)

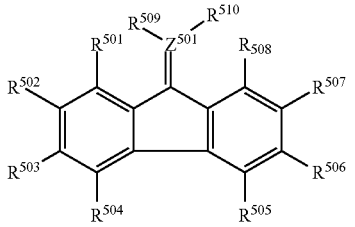

(A6)

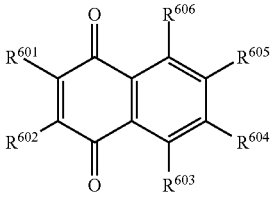

(A7)

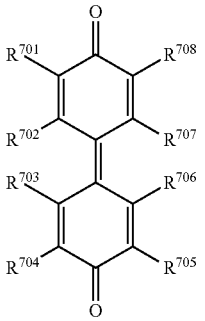

(A8)

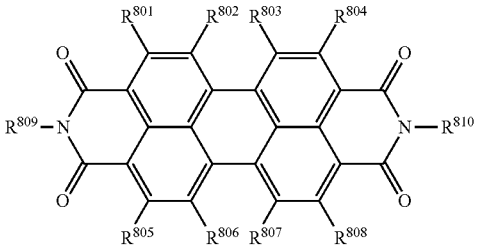

-continued (A9)

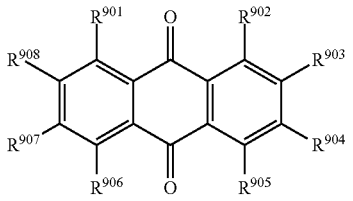

wherein, in the formulae (A1) to (A9), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$, and $R^{901}$ to $R^{908}$ each independently represent a single bond, a hydrogen atom, a halogen atom, a cyano group, a nitro group, an alkoxycarbonyl group, a carboxyl group, a dialkylamino group, a hydroxy group, an unsubstituted or substituted alkyl group, an unsubstituted or substituted aryl group, or an unsubstituted or substituted hetero ring, at least two of $R^{101}$ to $R^{106}$, at least two of $R^{201}$ to $R^{210}$, at least two of $R^{301}$ to $R^{308}$, at least two of $R^{401}$ to $R^{408}$, at least two of $R^{501}$ to $R^{510}$, at least two of $R^{601}$ to $R^{606}$, at least two of $R^{701}$ to $R^{708}$, at least two of $R^{801}$ to $R^{810}$, and at least two of $R^{901}$ to $R^{908}$ are the single bonds, a substituent of the substituted alkyl group is an alkyl group, an aryl group, a halogen atom, or a carbonyl group, a substituent of the substituted aryl group or hetero ring is a halogen atom, a nitro group, a cyano group, an alkyl group, a halogen-substituted alkyl group, an alkoxy group, or a carbonyl group, $Z^{201}$, $Z^{301}$, $Z^{401}$, and $Z^{501}$ each independently represent a carbon atom, a nitrogen atom, or an oxygen atom, $R^{209}$ and $R^{210}$ are absent when $Z^{201}$ is the oxygen atom, $R^{210}$ is absent when $Z^{201}$ is the nitrogen atom, $R^{307}$ and $R^{308}$ are absent when $Z^{301}$ is the oxygen atom, $R^{308}$ is absent when $Z^{301}$ is the nitrogen atom, $R^{407}$ and $R^{408}$ are absent when $Z^{401}$ is the oxygen atom, $R^{408}$ is absent when $Z^{401}$ is the nitrogen atom, $R^{509}$ and $R^{510}$ are absent when $Z^{501}$ is the oxygen atom, and $R^{510}$ is absent when $Z^{501}$ is the nitrogen atom.

Another disclosed aspect of the present invention provides a process cartridge detachably attachable to a main body of an electrophotographic apparatus, in which the process cartridge integrally supports the electrophotographic photosensitive member described above, and at least one device selected from the group consisting of a charging device, a developing device, a transferring device, and a cleaning device.

Another disclosed aspect of the present invention provides an electrophotographic apparatus including the electrophotographic photosensitive member described above, a charging device, an exposure device, a developing device; and a transferring device.

Aspects of the present invention provide an electrophotographic photosensitive member that reduces a positive ghost, and a process cartridge and an electrophotographic apparatus each including the electrophotographic photosensitive member.

Further features of the present invention will become apparent from the following description of exemplary embodiments with reference to the attached drawings.

DESCRIPTION OF THE EMBODIMENTS

An undercoat layer according to an embodiment of the present invention is a layer (cured layer) having a structure represented by the following formula (C1) or a structure represented by the following formula (C2).

The inventors speculate that the reason an electrophotographic photosensitive member including the undercoat layer according to an embodiment of the present invention has the effect of achieving the reduction of the occurrence of a positive ghost at a high level is as follows.

In the electrophotographic photosensitive member according to an embodiment of the present invention, the undercoat layer has a structure in which a melamine compound or a guanamine compound is bound to both of an electron-transporting substance and a resin, the structure being represented by the formula (C1) or (C2).

In the structure represented by the formula (C1) or (C2), it is speculated that a triazine ring having the electron-withdrawing ability and an electron-transporting moiety represented by $A^1$ are bound together and interact with each other to form a conduction level considered as a factor for the electron-transporting ability. The uniformization of the conduction level will be less likely to cause electrons to be trapped, thereby reducing residual charge.

In an undercoat layer containing such a plurality of components, however, the component having the same structure aggregates easily, in some cases. In the undercoat layer according to an embodiment of the present invention, the triazine ring bound to the electron-transporting moiety is bound to a molecular chain of the resin (a group represented by the formula (i)); hence, the uneven distribution of the same component due to its aggregation in the undercoat layer is inhibited, thereby forming a uniform conduction level. As a result, it is speculated that electrons are less likely to be trapped, thereby reducing residual charge and suppressing the occurrence of the positive ghost during long-term, repeated use. It is also speculated that a cured product having a structure represented by the formula (C1) or (C2) is formed, thus inhibiting the elution of the electron-transporting substance to provide the effect of reducing a ghost at a higher level.

The electrophotographic photosensitive member according to an embodiment of the present invention includes a support, the undercoat layer formed on the support, and a photosensitive layer formed on the undercoat layer. The photosensitive layer may be a photosensitive layer having a laminated structure (functionally separated structure) including a charge-generating layer that contains a charge-generating substance and a charge-transporting layer that contains a charge-transporting substance. The photosensitive layer having a laminated structure may be a normal-order-type photosensitive layer including the charge-generating layer and the charge-transporting layer stacked, in that order, from the support side in view of electrophotographic properties.

Figure 4A:
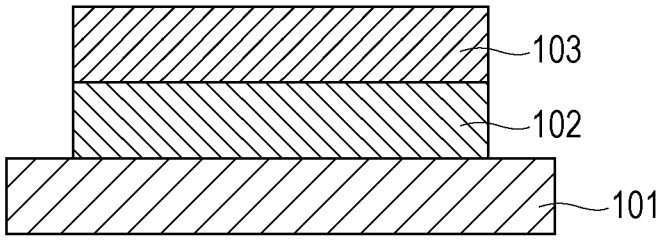
FIGS. 4A and 4B illustrate the layer structure of an electrophotographic photosensitive member according to aspects of the present invention.
Figure 4B:
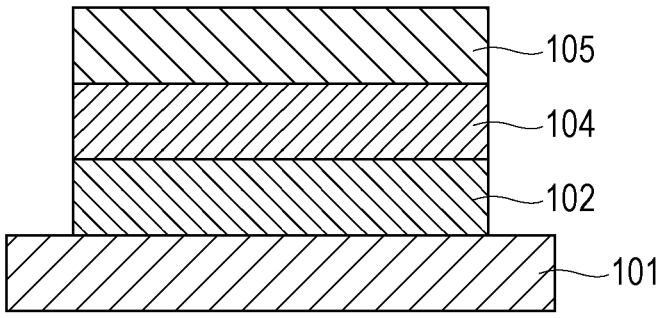

FIGS. 4A and 4B illustrate examples of the layer structure of the electrophotographic photosensitive member according to an embodiment of the present invention. In FIGS. 4A and 4B, reference numeral 101 denotes a support, reference numeral 102 denotes an undercoat layer, reference numeral 103 denotes a photosensitive layer, reference numeral 104 denotes a charge-generating layer, and reference numeral 105 denotes a charge-transporting layer.

As common electrophotographic photosensitive members, cylindrical electrophotographic photosensitive members including photosensitive layers (charge-generating layers and charge-transporting layers) formed on cylindrical supports are widely used. Electrophotographic photosensitive members may have belt- and sheet-like shapes.

Undercoat Layer

The undercoat layer is provided between the photosensitive layer and the support or a conductive layer described below. The undercoat layer has a structure represented by the following formula (C1) or a structure represented by the following formula (C2). In other words, the undercoat layer contains a cured product (polymer) having a structure represented by the following formula (C1) or a structure represented by the following formula (C2):

(C1)

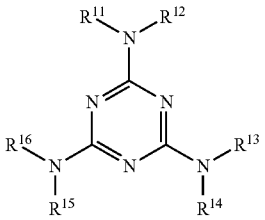

(C2)

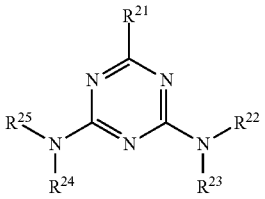

wherein, in the formula (C1), $R^{11}$ to $R^{16}$, and $R^{22}$ to $R^{25}$ each independently represent a hydrogen atom, a methylene group, a monovalent group represented by $—CH_2OR^2$, a group represented by the following formula (i), or a group represented by the following formula (ii); at least one of $R^{11}$ to $R^{16}$, and at least one of $R^{22}$ to $R^{25}$ are each the group represented by the formula (i); and at least one of $R^{11}$ to $R^{16}$, and at least one of $R^{22}$ to $R^{25}$ are each the group represented by the formula (ii); $R^2$ represents a hydrogen atom or an alkyl group having 1 to 10 carbon atoms; and $R^{21}$ represents an alkyl group, a phenyl group, or a phenyl group substituted with an alkyl group, (i)

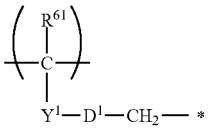

wherein, in the formula (i), $R^{61}$ represents a hydrogen atom or an alkyl group, $Y^1$ represents a single bond, an alkylene group, or a phenylene group, $D^1$ represents a divalent group represented by any one of the following formulae (D1) to (D4), the alkyl group may be a methyl group or an ethyl group, the alkylene group may be a methylene group, and "*" in the formula (i) indicates the side to which a nitrogen atom in the formula (C1) or a nitrogen atom in the formula (C2) is bound, (D1)

(D2)

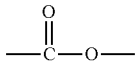

(D3)

(D4)

(ii)

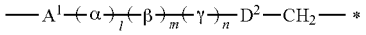

wherein, in the formula (ii), $D^2$ represents a divalent group represented by any one of the foregoing formulae (D1) to (D4), α represents an alkylene group having 1 to 6 main-chain atoms, an alkylene group having 1 to 6 main-chain atoms and being substituted with an alkyl group having 1 to 6 carbon atoms, an alkylene group having 1 to 6 main-chain atoms and being substituted with a benzyl group, an alkylene group having 1 to 6 main-chain atoms and being substituted with an alkoxycarbonyl group, or an alkylene group having 1 to 6 main-chain atoms and being substituted with a phenyl group, one of the carbon atoms in the main chain of the alkylene group may be replaced with O, S, NH, or $NR^1$, $R^1$ representing an alkyl group having 1 to 6 carbon atoms, β represents a phenylene group, a phenylene group substituted with an alkyl having 1 to 6 carbon atoms, a phenylene group substituted with a nitro group, or a phenylene group substituted with a halogen atom, γ represents an alkylene group having 1 to 6 main-chain atoms or an alkylene group having 1 to 6 main-chain atoms and substituted with an alkyl group having 1 to 6 carbon atoms, l, m, and n each independently represent 0 or 1, $A^1$ represents a divalent group represented by any one of the following formulae (A1) to (A9), "*" in the formula (ii) indicates the side to which a nitrogen atom in the formula (C1) or a nitrogen atom in the formula (C2) is bound, (A1)

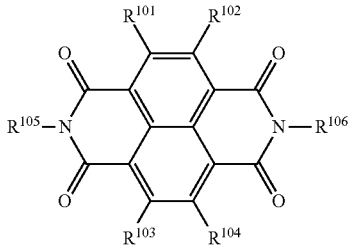

(A2)

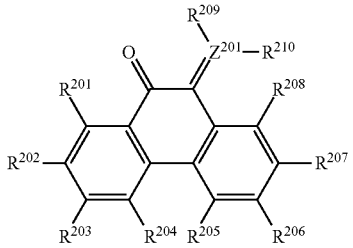

-continued (A3)

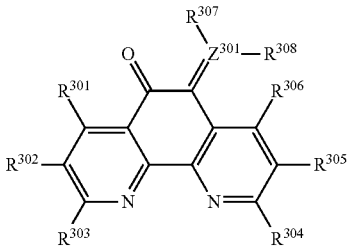

(A4)

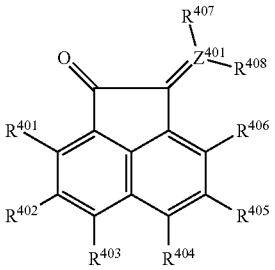

(A5)

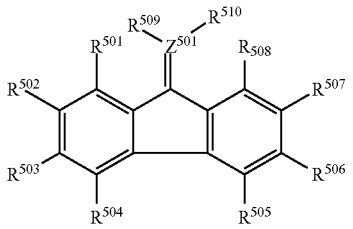

(A6)

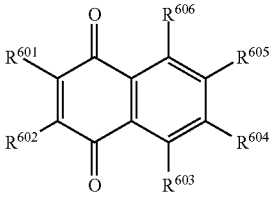

(A7)

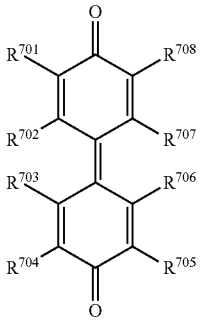

(A8)

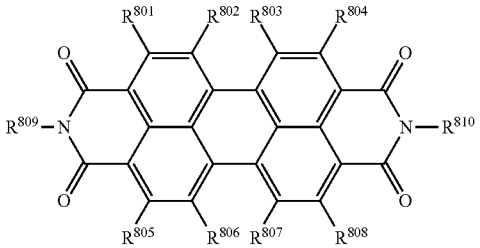

-continued (A9)

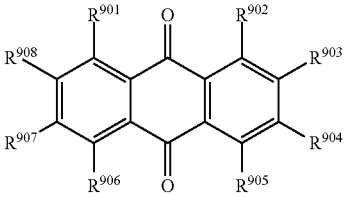

wherein, in the formulae (A1) to (A9), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$, and $R^{901}$ to $R^{908}$ each independently represent a single bond, a hydrogen atom, a halogen atom, a cyano group, a nitro group, an alkoxycarbonyl group, a carboxyl group, a dialkylamino group, a hydroxy group, an unsubstituted or substituted alkyl group, an unsubstituted or substituted aryl group, or an unsubstituted or substituted hetero ring; at least two of $R^{101}$ to $R^{106}$, at least two of $R^{201}$ to $R^{210}$, at least two of $R^{301}$ to $R^{308}$, at least two of $R^{401}$ to $R^{408}$, at least two of $R^{501}$ to $R^{510}$, at least two of $R^{601}$ to $R^{606}$, at least two of $R^{701}$ to $R^{708}$, at least two of $R^{801}$ to $R^{810}$, and at least two of $R^{901}$ to $R^{908}$ are the single bonds; a substituent of the substituted alkyl group is an alkyl group, an aryl group, a halogen atom, or a carbonyl group; a substituent of the substituted aryl group or hetero ring is a halogen atom, a nitro group, a cyano group, an alkyl group, a halogen-substituted alkyl group, an alkoxy group, or a carbonyl group; $Z^{201}$, $Z^{301}$, $Z^{401}$, and $Z^{501}$ each independently represent a carbon atom, a nitrogen atom, or an oxygen atom; $R^{209}$ and $R^{210}$ are absent when $Z^{201}$ is the oxygen atom; $R^{210}$ is absent when $Z^{201}$ is the nitrogen atom; $R^{307}$ and $R^{308}$ are absent when $Z^{301}$ is the oxygen atom; $R^{308}$ is absent when $Z^{301}$ is the nitrogen atom; $R^{407}$ and $R^{408}$ are absent when $Z^{401}$ is the oxygen atom; $R^{408}$ is absent when $Z^{401}$ is the nitrogen atom; $R^{509}$ and $R^{510}$ are absent when $Z^{501}$ is the oxygen atom; and $R^{510}$ is absent when $Z^{501}$ is the nitrogen atom.

The structure represented by the formula (C1) includes a moiety derived from a melamine compound. The structure represented by the formula (C2) includes a moiety derived from a guanamine compound. The moiety derived from the melamine compound or the moiety derived from the guanamine compound is bound to the group represented by the formula (i) and the group represented by the formula (ii). The group represented by the formula (i) is a moiety derived from a resin. The group represented by the formula (ii) is an electron-transporting moiety represented by any one of the formulae (A1) to (A9) in the formula (ii).

Each of the structure represented by the formula (C1) and the structure represented by the formula (C2) is bound to at least one group represented by the formula (i) and at least one group represented by the formula (ii). The remaining group that is not bound to the group represented by the formula (i) or the group represented by the formula (ii) represents a hydrogen atom, a methylene group, or a monovalent group represented by $—CH_2OR^2$ (wherein $R^2$ represents a hydrogen atom or an alkyl group having 1 to 10 carbon atoms). When the remaining group represents a methylene group, the structure may be bound to the melamine structure or the guanamine structure via the methylene group.

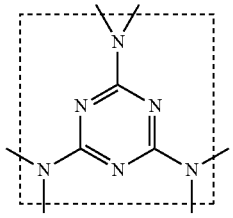

MELAMINE STRUCTURE

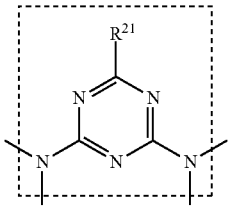

GUANAMINE STRUCTURE

The number of main-chain atoms in the formula (ii) except $A^1$ is preferably 12 or less and more preferably 2 or more and 9 or less because the distance between the triazine ring and the electron-transporting moiety is appropriate and thus the electron-transporting ability is smoothly provided by interaction, thereby further reducing the positive ghost.

In the formula (ii), β may represent a phenylene group. α may represent an alkylene group which has 1 to 5 main-chain atoms and which is substituted with an alkyl group having 1 to 4 carbon atoms or may represent an alkylene group having 1 to 5 main-chain atoms.

The content of the structure represented by the formula (C1) or the structure represented by the formula (C2) in the undercoat layer may be 30% by mass or more and 100% by mass or less with respect to the total mass of the undercoat layer.

The content of the structure represented by the formula (C1) or (C2) in the undercoat layer may be analyzed by a common analytical method. An example of the analytical method is described below. The content of the structure represented by the formula (C1) or (C2) is determined by Fourier transform infrared spectroscopy (FT-IR) using a KBr tablet method. A calibration curve is formed on the basis of absorption resulting from the triazine ring using samples having different melamine contents with respect to a KBr powder, so that the content of the structure represented by the formula (C1) or (C2) in the undercoat layer can be calculated.

Furthermore, the structure represented by the formula (C1) or (C2) can be identified by analyzing the undercoat layer by measurement methods, such as solid-state $^{13}$C-NMR measurement, mass spectrometry measurement, MS-spectrum measurement by pyrolysis GC-MS analysis, and characteristic absorption measurement by infrared spectrophotometry. For example, solid-state $^{13}$C-NMR measurement was performed with CMX-300 Infiniy manufactured by Chemagnetics under conditions: observed nucleus: $^{13}$C, reference substance: polydimethylsiloxane, number of acquisitions: 8192, pulse sequence: CP/MAS, DD/MAS, pulse width: 2.1 μsec (DD/MAS), 4.2 μsec (CP/MAS), contact time 2.0 msec, and spinning rate of sample: 10 kHz.

With respect to mass spectrometry, the molecular weight was measured with a mass spectrometer (MALDI-TOF MS, Model: ultraflex, manufactured by Bruker Daltonics) under conditions: accelerating voltage: 20 kV, mode: Reflector, and molecular weight standard: fullerene $C_{60}$. The molecular weight was determined on the basis of the value at the peak maximum observed.

The molecular weight of the resin was measured with a gel permeation chromatograph "HLC-8120" manufactured by TOSOH CORPORATION and calculated in terms of polystyrene.

To enhance the film formability and the electrophotographic properties, the undercoat layer may contain, for example, organic particles, inorganic particles, metal oxide particles, a leveling agent, and a catalyst to promote curing in addition to the structure represented by the formula (C1) or (C2). However, the content thereof is preferably less than 50% by mass and more preferably less than 20% by mass with respect to the total mass of the undercoat layer. The undercoat layer may have a thickness of 0.1 μm or more and 5.0 μm or less.

While specific examples of the structure represented by the formula (C1) or (C2) are illustrated below, the present invention is not limited thereto. In each of the specific examples, the number of main-chain atoms other than $A^1$, which serves as an electron-transporting moiety, is described. In Tables 1 to 27, binding sites are indicated by dotted lines. The term "single" indicates a single bond. The lateral direction of the group represented by the formula (i) and the group represented by the formula (ii) is the same as the lateral direction of each of the structures illustrated in Tables 1 to 27.

TABLE 1

| Specific example | Number of main-chain atoms | Formula (ii) | | | | | | |
|---|---|---|---|---|---|---|---|---|
| | | α | l | β | m | γ | n | $D^2$ |
| 101 | 4 | 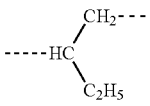 | 1 | single | 0 | single | 0 | ----O---- |
| 102 | 4 | 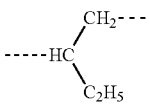 | 1 | single | 0 | single | 0 | ----O---- |
| 103 | 4 | 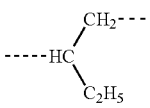 | 1 | single | 0 | single | 0 | ----O---- |

TABLE 1-continued
| | | | | | | | | |
|---|---|---|---|---|---|---|---|---|
| 104 | 4 | 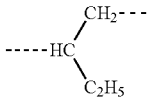 | 1 | single | 0 | single | 0 | ----O---- |
| 105 | 5 | 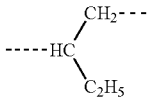 | 1 | single | 0 | single | 0 | ----O---- |
| 106 | 4 | 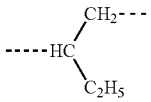 | 1 | single | 0 | single | 0 | ----O---- |
| 107 | 4 | 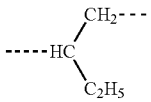 | 1 | single | 0 | single | 0 | ----O---- |
| 108 | 4 | 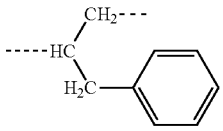 | 1 | single | 0 | single | 0 | ----O---- |
| 109 | 5 | single | 0 | 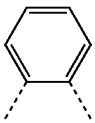 | 1 | 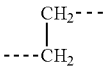 | 1 | ----O---- |
| 110 | 6 | single | 0 | 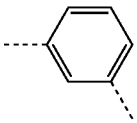 | 1 | single | 0 | 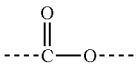 |
| 111 | 5 | single | 0 | 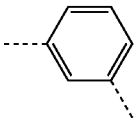 | 1 | single | 0 | ----N----<br>H |
| 112 | 6 | single | 0 | 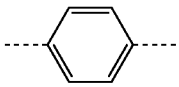 | 1 | single | 0 | ----S---- |
| 113 | 5 | single | 0 | 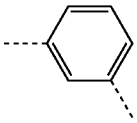 | 1 | single | 0 | ----N----<br>H |
| 114 | 4 | 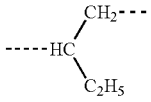 | 1 | single | 0 | single | 0 | ----O---- |
| 115 | 6 | single | 0 | 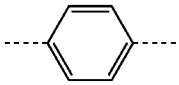 | 1 | single | 0 | ----S---- |

TABLE 1-continued
| | | | | | | | | |
|---|---|---|---|---|---|---|---|---|
| 116 | 4 | 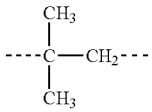 | 1 | single | 0 | single | 0 | ----O---- |
| 117 | 4 | 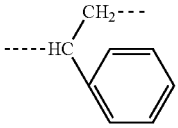 | 1 | single | 0 | single | 0 | ----O---- |
| 118 | 4 | 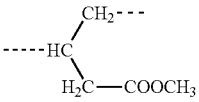 | 1 | single | 0 | single | 0 | ----O---- |
| 119 | 5 | 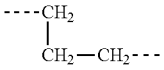 | 1 | single | 0 | single | 0 | ----O---- |
| 120 | 4 | 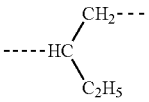 | 1 | single | 0 | single | 0 | ----O---- |
| 121 | 4 | 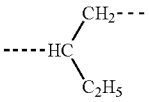 | 1 | single | 0 | single | 0 | ----O---- |
| 122 | 4 | 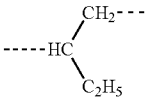 | 1 | single | 0 | single | 0 | ----O---- |
| 123 | 10 | 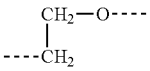 | 1 | 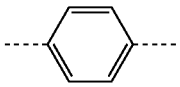 | 0 | single | 0 | 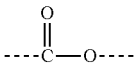 |
| 124 | 4 | 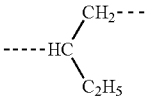 | 1 | single | 0 | single | 0 | ----O---- |
| Specific example | Formula (i) | | |
|---|---|---|---|
| | $R^{61}$ | Y | D1 |
| 101 | H | single | ----O---- |
| 102 | $CH_3$ | ----$CH_2$--- | ----O---- |
| 103 | $C_2H_5$ | ----$CH_2$--- | ----O---- |
| 104 | H | 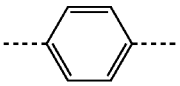 | ----O---- |
| 105 | H | single | 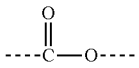 |
| 106 | H | single | ----O---- |

TABLE 1-continued

| | | | |
|---|---|---|---|
| 107 | H | single | ----O---- |
| 108 | H | single | ----O---- |
| 109 | H | single | ----O---- |
| 110 | H | single | ----C(=O)—O---- |
| 111 | H | single | ----S---- |
| 112 | H | single | ----N(H)---- |
| 113 | H | single | ----N(H)---- |
| 114 | H | single | ----O---- |
| 115 | H | single | ----S---- |
| 116 | H | single | ----O---- |
| 117 | H | single | ----O---- |
| 118 | H | single | ----O---- |
| 119 | H | single | ----O---- |
| 120 | H | single | ----O---- |
| 121 | H | single | ----O---- |
| 122 | H | single | ----O---- |
| 123 | H | single | ----C(=O)—O---- |
| 124 | H | single | ----O---- |

| Specific | Formula (C1) | | | | | |
|---|---|---|---|---|---|---|
| example | $R^{11}$ | $R^{12}$ | $R^{13}$ | $R^{14}$ | $R^{15}$ | $R^{16}$ |
| 101 | Formula (ii) | ----$CH_2$--- | Formula (i) | ----$CH_2$--- | ----$CH_2$--- | ----$CH_2$--- |
| 102 | Formula (ii) | ----$CH_2$--- | Formula (i) | ----$CH_2$--- | ----$CH_2$--- | ----$CH_2$--- |
| 103 | Formula (ii) | ----$CH_2$--- | Formula (i) | ----$CH_2$--- | ----$CH_2$--- | ----$CH_2$--- |
| 104 | Formula (ii) | ----$CH_2$--- | Formula (i) | ----$CH_2$--- | ----$CH_2$--- | ----$CH_2$--- |
| 105 | Formula (ii) | ----$CH_2$--- | Formula (i) | ----$CH_2$--- | ----$CH_2$--- | ----$CH_2$--- |
| 106 | Formula (ii) | Formula (i) | Formula (i) | ----$CH_2$--- | ----$CH_2$--- | ----$CH_2$--- |
| 107 | Formula (ii) | H | Formula (i) | ----$CH_2$--- | ----$CH_2$--- | H |

TABLE 1-continued

| | | | | | | |
|---|---|---|---|---|---|---|
| 108 | Formula (ii) | ----$CH_2$--- | Formula (i) | ----$CH_2$--- | ----$CH_2$--- | ----$CH_2$--- |
| 109 | Formula (ii) | ----$CH_2$--- | Formula (i) | ----$CH_2$--- | ----$CH_2$--- | ----$CH_2$--- |
| 110 | Formula (ii) | ----$CH_2$--- | Formula (i) | ----$CH_2$--- | ----$CH_2$--- | ----$CH_2$--- |
| 111 | Formula (ii) | ----$CH_2$--- | Formula (i) | ----$CH_2$--- | ----$CH_2$--- | ----$CH_2$--- |
| 112 | Formula (ii) | ----$CH_2$--- | Formula (i) | ----$CH_2$--- | ----$CH_2$--- | ----$CH_2$--- |
| 113 | Formula (ii) | H | Formula (i) | ----$CH_2$--- | ----$CH_2$--- | H |
| 114 | Formula (ii) | ----$CH_2$--- | Formula (i) | ----$CH_2$--- | ----$CH_2$--- | ----$CH_2$--- |
| 115 | Formula (ii) | ----$CH_2$--- | Formula (i) | ----$CH_2$--- | ----$CH_2$--- | ----$CH_2$--- |
| 116 | Formula (ii) | ----$CH_2$--- | Formula (i) | ----$CH_2$--- | ----$CH_2$--- | ----$CH_2$--- |
| 117 | Formula (ii) | ----$CH_2$--- | Formula (i) | ----$CH_2$--- | ----$CH_2$--- | ----$CH_2$--- |
| 118 | Formula (ii) | ----$CH_2$--- | Formula (i) | ----$CH_2$--- | ----$CH_2$--- | ----$CH_2$--- |
| 119 | Formula (ii) | ----$CH_2$--- | Formula (i) | ----$CH_2$--- | ----$CH_2$--- | ----$CH_2$--- |
| 120 | Formula (ii) | H | Formula (i) | ----$CH_2$--- | ----$CH_2$--- | H |
| 121 | Formula (ii) | ----$CH_2$--- | Formula (i) | ----$CH_2$--- | ----$CH_2$--- | ----$CH_2$--- |
| 122 | Formula (ii) | ----$CH_2$--- | Formula (i) | ----$CH_2$--- | ----$CH_2$--- | ----$CH_2$--- |
| 123 | Formula (ii) | ----$CH_2$--- | Formula (i) | ----$CH_2$--- | ----$CH_2$--- | ----$CH_2$--- |
| 124 | Formula (ii) | ----$CH_2$--- | Formula (i) | ----$CH_2$--- | ----$CH_2$--- | ----$CH_2$--- |

TABLE 2

| Specific exam- | Number of main-chain | Formula (ii) | | | | | | |
|---|---|---|---|---|---|---|---|---|
| ple | atoms | α | l | β | m | γ | n | $B^2$ |
| 125 | 4 | 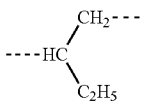 | 1 | single | 0 | single | 0 | ----O---- |
| 126 | 4 | 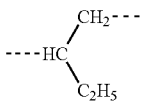 | 1 | single | 0 | single | 0 | ----O---- |
| 127 | 4 | 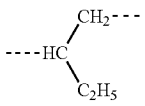 | 1 | single | 0 | single | 0 | ----O---- |

TABLE 2-continued
| | | | | | | | | |
|---|---|---|---|---|---|---|---|---|
| 128 | 4 | 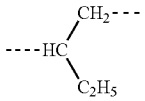 | 1 | single | 0 | single | 0 | ----O---- |
| 129 | 4 | 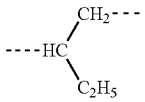 | 1 | single | 0 | single | 0 | ----O---- |
| 130 | 4 | 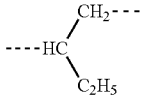 | 1 | single | 0 | single | 0 | ----O---- |
| 131 | 4 | single | 0 | 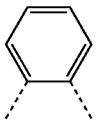 | 1 | ----$CH_2$--- | 1 | ----O---- |
| 132 | 4 | 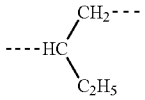 | 1 | single | 0 | single | 0 | ----O---- |
| 133 | 6 | single | 0 | 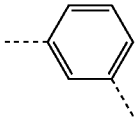 | 1 | single | 0 | 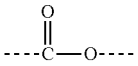 |
| 134 | 5 | single | 0 | 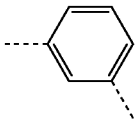 | 1 | single | 0 | ----N---- H |
| 135 | 6 | single | 0 | 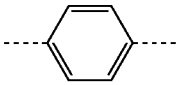 | 1 | single | 0 | ----S---- |
| 136 | 4 | 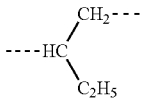 | 1 | single | 0 | single | 0 | ----O---- |
| 137 | 4 | 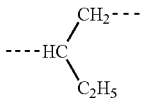 | 1 | single | 0 | single | 0 | ----O---- |
| 138 | 10 | -----$(CH_2)_8$---- | 1 | single | 0 | single | 0 | ----O---- |
| 139 | 10 | 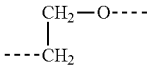 | 1 | 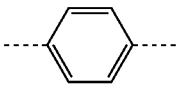 | 1 | single | 0 | 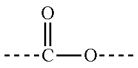 |

TABLE 2-continued

| Specific example | Formula (i) | | |
|---|---|---|---|
| | $R^{61}$ | $Y^1$ | $B^1$ |
| 125 | H | single | ----O---- |
| 126 | H | single | ----O---- |
| 127 | H | single | ----O---- |
| 128 | H | single | ----O---- |
| 129 | H | single | ----O---- |
| 130 | $C_2H_5$ | ----$CH_2$--- | ----O---- |
| 131 | H | single | ----O---- |
| 132 | H | single | ----O---- |
| 133 | H | single | ----C(=O)—O---- |
| 134 | H | single | ----N(H)---- |
| 135 | H | single | ----S---- |
| 136 | H | single | ----O---- |
| 137 | H | single | ----O---- |
| 138 | H | single | ----O---- |
| 139 | H | single | ----C(=O)—O---- |

| Specific example | Formula (C2) | | | | |
|---|---|---|---|---|---|
| | $R^{21}$ | $R^{22}$ | $R^{23}$ | $R^{24}$ | $R^{25}$ |
| 125 | 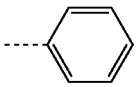 | Formula (ii) | ----$CH_2$--- | Formula (i) | ----$CH_2$--- |
| 126 | 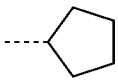 | Formula (ii) | ----$CH_2$--- | Formula (i) | ----$CH_2$--- |
| 127 | 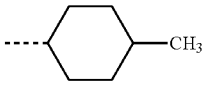 | Formula (ii) | Formula (i) | ----$CH_2$--- | ----$CH_2$--- |
| 128 | 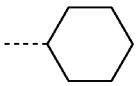 | Formula (ii) | ----$CH_2$--- | Formula (i) | ----$CH_2$--- |
| 129 | 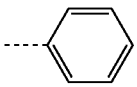 | H | Formula (ii) | Formula (i) | ----$CH_2$--- |

TABLE 2-continued

| | | | | | |
|---|---|---|---|---|---|
| 130 | 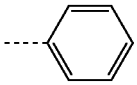 | Formula (ii) | ----$CH_2$--- | Formula (i) | ----$CH_2$--- |
| 131 | 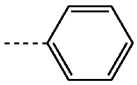 | Formula (ii) | ----$CH_2$--- | Formula (i) | ----$CH_2$--- |
| 132 | 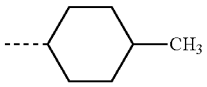 | Formula (ii) | ----$CH_2$--- | Formula (i) | ----$CH_2$--- |
| 133 | 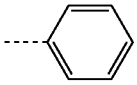 | Formula (ii) | ----$CH_2$--- | Formula (i) | ----$CH_2$--- |
| 134 | 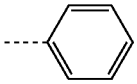 | Formula (ii) | ----$CH_2$--- | Formula (i) | ----$CH_2$--- |
| 135 | 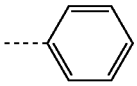 | Formula (ii) | ----$CH_2$--- | Formula (i) | ----$CH_2$--- |
| 136 | 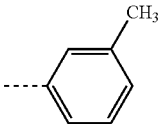 | Formula (ii) | ----$CH_2$--- | Formula (i) | ----$CH_2$--- |
| 137 | 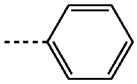 | Formula (ii) | ----$CH_2$--- | Formula (i) | ----$CH_2$--- |
| 138 | 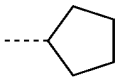 | Formula (ii) | ----$CH_2$--- | Formula (i) | ----$CH_2$--- |
| 139 | 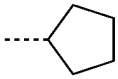 | Formula (ii) | ----$CH_2$--- | Formula (i) | ----$CH_2$--- |

TABLE 3

| Specific example | Number of main-chain atoms | Formula (ii) | | | | | | | Formula (i) | | |
|---|---|---|---|---|---|---|---|---|---|---|---|
| | | α | l | β | m | γ | n | $D^2$ | $R^{61}$ | Y | $D^1$ |
| 201 | 5 | single | 0 | 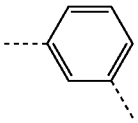 | 1 | single | 0 | ----N----<br>H | H | single | ----N----<br>H |

TABLE 3-continued

| | | | | | | | | | | | |
|---|---|---|---|---|---|---|---|---|---|---|---|
| 202 | 6 | single | 0 | 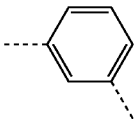 | 1 | ----$CH_2$--- | 1 | ----O---- | H | single | ----O---- |
| 203 | 6 | single | 0 | 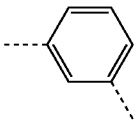 | 1 | ----$CH_2$--- | 1 | ----O---- | H | single | ----O---- |
| 204 | 6 | single | 0 | 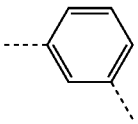 | 1 | ----$CH_2$--- | 1 | ----O---- | H | 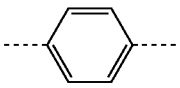 | ----O---- |

| Specific example | Formula (C1) | | | | | |
|---|---|---|---|---|---|---|
| | $R^{11}$ | $R^{12}$ | $R^{13}$ | $R^{14}$ | $R^{15}$ | $R^{16}$ |
| 201 | Formula (ii) | ----$CH_2$--- | Formula (i) | ----$CH_2$--- | ----$CH_2$--- | ----$CH_2$--- |
| 202 | Formula (ii) | H | Formula (i) | ----$CH_2$--- | ----$CH_2$--- | H |
| 203 | Formula (ii) | ----$CH_2$--- | Formula (i) | ----$CH_2$--- | ----$CH_2$--- | ----$CH_2$--- |
| 204 | Formula (ii) | H | Formula (i) | ----$CH_2$--- | ----$CH_2$--- | H |

TABLE 4

| Specific example | Number of main-chain atoms | Formula (ii) | | | | | | Formula (i) | | | |
|---|---|---|---|---|---|---|---|---|---|---|---|
| | | α | l | β | m | γ | n | $D^2$ | $R^{61}$ | $Y^1$ | $D^1$ |
| 205 | 6 | single | 0 | 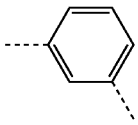 | 1 | single | 0 | ----C(=O)—O---- | H | single | ----C(=O)—O---- |
| 206 | 5 | single | 0 | 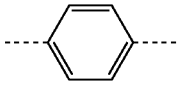 | 1 | single | 0 | ----S---- | H | single | ----S---- |
| 207 | 7 | single | 0 | 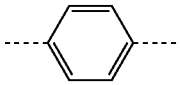 | 1 | ----$CH_2$--- | 1 | ----O---- | H | single | ----O---- |
| 208 | 6 | single | 0 | 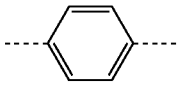 | 1 | single | 0 | ----S---- | H | single | ----S---- |

| Specific example | Formula (C2) | | | | |
|---|---|---|---|---|---|
| | $R^{21}$ | $R^{22}$ | $R^{23}$ | $R^{24}$ | $R^{25}$ |
| 205 | 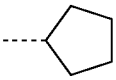 | Formula (ii) | ----$CH_2$--- | Formula (i) | ----$CH_2$--- |

TABLE 4-continued

| | | | | | |
|---|---|---|---|---|---|
| 206 | 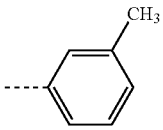 | Formula (ii) | ----$CH_2$--- | Formula (i) | ----$CH_2$--- |
| 207 | 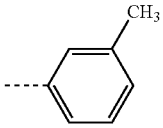 | Formula (ii) | ----$CH_2$--- | Formula (i) | ----$CH_2$--- |
| 208 | 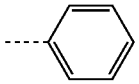 | Formula (ii) | ----$CH_2$--- | Formula (i) | ----$CH_2$--- |

TABLE 5

| Specific example | Number of main-chain atoms | Formula (ii) | | | | | | Formula (i) | | |
|---|---|---|---|---|---|---|---|---|---|---|
| | | α | l | β | m | γ | n | $D^2$ | $R^{61}$ | $Y^1$ |
| 301 | 7 | single | 0 | 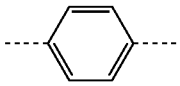 | 1 | ----$CH_2$--- | 1 | ----O---- | H | single |
| 302 | 6 | single | 0 | 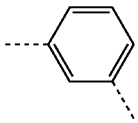 | 1 | single | 0 | ----C(=O)—O---- | H | single |
| 303 | 5 | single | 0 | 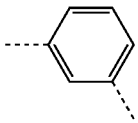 | 1 | single | 0 | ----N(H)---- | H | single |
| 304 | 4 | 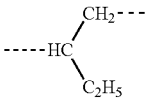 | 1 | single | 0 | single | 0 | ----O---- | H | single |

| Specific example | Formula (C1) | | | | | | |
|---|---|---|---|---|---|---|---|
| | $D^1$ | $R^{11}$ | $R^{12}$ | $R^{13}$ | $R^{14}$ | $R^{15}$ | $R^{16}$ |
| 301 | ----O---- | Formula (ii) | ----$CH_2$--- | Formula (i) | ----$CH_2$--- | ----$CH_2$--- | ----$CH_2$--- |
| 302 | ----C(=O)—O---- | Formula (ii) | ----$CH_2$--- | Formula (i) | ----$CH_2$--- | ----$CH_2$--- | ----$CH_2$--- |
| 303 | ----N(H)---- | Formula (ii) | ----$CH_2$--- | Formula (i) | ----$CH_2$--- | ----$CH_2$--- | ----$CH_2$--- |
| 304 | ----O---- | Formula (ii) | ----$CH_2$--- | Formula (i) | ----$CH_2$--- | ----$CH_2$--- | ----$CH_2$--- |

TABLE 6

| Specific example | Number of main-chain atoms | Formula (ii) α | l | β | m | γ | n | Formula (i) $D^2$ | $R^{61}$ | $Y^1$ | $D^1$ |
|---|---|---|---|---|---|---|---|---|---|---|---|
| 305 | 4 | 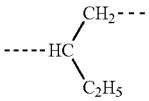 | 1 | single | 0 | single | 0 | ----O---- | H | single | ----O---- |
| 306 | 7 | single | 0 | 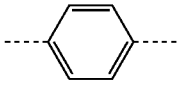 | 1 | ----$CH_2$--- | 1 | ----O---- | H | single | ----O---- |

| Specific example | Formula (C2) R21 | R22 | R23 | R24 | R25 |
|---|---|---|---|---|---|
| 305 | 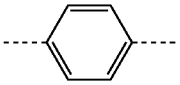 | Formula (ii) | ----$CH_2$--- | Formula (i) | ----$CH_2$--- |
| 306 | 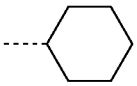 | Formula (ii) | ----$CH_2$--- | Formula (i) | ----$CH_2$--- |

TABLE 7

| Specific example | Number of main-chain atoms | Formula (ii) α | l | β | m | γ | n | Formula (i) $D^2$ | $R^{61}$ | $Y^1$ |
|---|---|---|---|---|---|---|---|---|---|---|
| 401 | 6 | single | 0 | 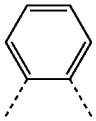 | 1 | $CH_2$---<br>\|<br>----$CH_2$ | 1 | ----O---- | H | single |
| 402 | 6 | single | 0 | 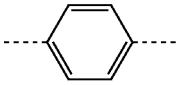 | 1 | single | 0 | ----S---- | H | single |
| 403 | 8 | single | 0 | 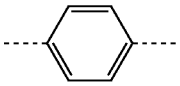 | 1 | $CH_2$---<br>\|<br>----$CH_2$ | 1 | ----O---- | H | sngle |
| 404 | 8 | single | 0 | 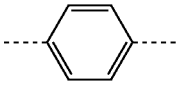 | 1 | $CH_2$---<br>\|<br>----$CH_2$ | 1 | ----O---- | H | single |
| 405 | 8 | single | 0 | 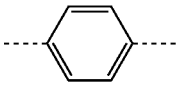 | 1 | $CH_2$---<br>\|<br>----$CH_2$ | 1 | ----O---- | H | 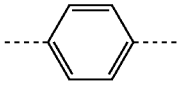 |

TABLE 7-continued

| Specific example | Formula (C1) | | | | | | |
|---|---|---|---|---|---|---|---|
| | $D^1$ | $R^{11}$ | $R^{12}$ | $R^{13}$ | $R^{14}$ | $R^{15}$ | $R^{16}$ |
| 401 | ----O---- | Formula (ii) | ----$CH_2$--- | Formula (i) | ----$CH_2$--- | ----$CH_2$--- | ----$CH_2$--- |
| 402 | ----S---- | Formula (ii) | ----$CH_2$--- | Formula (i) | ----$CH_2$--- | ----$CH_2$--- | ----$CH_2$--- |
| 403 | ----O---- | Formula (ii) | ----$CH_2$--- | Formula (i) | ----$CH_2$--- | ----$CH_2$--- | ----$CH_2$--- |
| 404 | ----O---- | Formula (ii) | H | Formula (i) | ----$CH_2$--- | ----$CH_2$--- | H |
| 405 | ----O---- | Formula (ii) | H | Formula (i) | ----$CH_2$--- | ----$CH_2$--- | H |

TABLE 8

| Specific example | Number of main-chain atoms | Formula (ii) | | | | | | Formula (i) | | | |
|---|---|---|---|---|---|---|---|---|---|---|---|
| | | α | l | β | m | γ | n | $D^2$ | $R^{61}$ | $Y^1$ | $D^1$ |
| 406 | 7 | single | 0 | 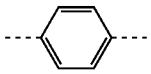 | 1 | ---$CH_2$-- | 1 | ----O---- | H | single | ----O---- |
| 407 | 6 | single | 0 | 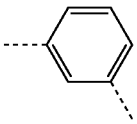 | 1 | single | 0 | ----C(=O)—O--- | H | single | ----C(=O)—O--- |
| 408 | 6 | single | 0 | 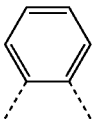 | 1 | ----$CH_2$---<br>\|<br>----$CH_2$ | 1 | ----O---- | H | single | ----O---- |
| 409 | 10 | -----$(CH_2)_8$---- | 1 | single | 0 | single | 0 | ----O---- | H | single | ----O---- |

| Specific example | Formula (C2) | | | | |
|---|---|---|---|---|---|
| | $R^{21}$ | $R^{22}$ | $R^{23}$ | $R^{24}$ | $R^{25}$ |
| 406 | 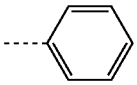 | Formula (ii) | ---$CH_2$-- | Formula (i) | ---$CH_2$-- |
| 407 | 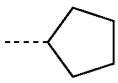 | Formula (ii) | ---$CH_2$-- | Formula (i) | ---$CH_2$-- |
| 408 | 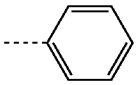 | Formula (ii) | ---$CH_2$-- | Formula (i) | ---$CH_2$-- |
| 409 | 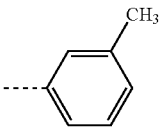 | Formula (ii) | ---$CH_2$-- | Formula (i) | ---$CH_2$-- |

TABLE 9

| Specific example | Number of main-chain atoms | Formula (ii) | | | | | | Formula (i) | | |
|---|---|---|---|---|---|---|---|---|---|---|
| | | α | l | β | m | γ | n | $D^2$ | $R^{61}$ | $Y^1$ |
| 501 | 6 | single | 0 | 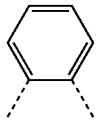 | 1 | $CH_2$---<br>\|<br>----$CH_2$ | 1 | ----O---- | $C_2H_5$ | ----$CH_2$--- |
| 502 | 6 | single | 0 | 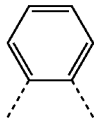 | 1 | $CH_2$---<br>\|<br>----$CH_2$ | 1 | ----O---- | H | single |
| 503 | 6 | single | 0 | 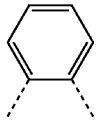 | 1 | $CH_2$---<br>\|<br>----$CH_2$ | 1 | ----O---- | H | single |
| 504 | 7 | single | 0 | 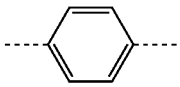 | 1 | ----$CH_2$--- | 1 | ----O---- | H | single |
| 505 | 3 | single | 0 | single | 0 | single | 0 | O<br>‖<br>----C—O---- | H | single |
| 506 | 3 | single | 0 | single | 0 | single | 0 | O<br>‖<br>----C—O---- | H | single |
| 507 | 2 | single | 0 | single | 0 | single | 0 | ----N----<br>H | H | single |
| 508 | 10 | -----$(CH_2)_8$---- | 1 | single | 0 | single | 0 | ----O---- | H | single |

| Specific example | Formula (C1) | | | | | | |
|---|---|---|---|---|---|---|---|
| | $D^1$ | $R^{11}$ | $R^{12}$ | $R^{13}$ | $R^{14}$ | $R^{15}$ | $R^{16}$ |
| 501 | ----O---- | Formula (ii) | ----$CH_2$--- | Formula (i) | ----$CH_2$--- | ----$CH_2$--- | ----$CH_2$--- |
| 502 | ----O---- | Formula (ii) | ----$CH_2$--- | Formula (i) | ----$CH_2$--- | ----$CH_2$--- | ----$CH_2$--- |
| 503 | ----O---- | Formula (ii) | Formula (i) | ----$CH_2$--- | ----$CH_2$--- | ----$CH_2$--- | ----$CH_2$--- |
| 504 | ----O---- | Formula (ii) | H | Formula (i) | ----$CH_2$--- | ----$CH_2$--- | H |
| 505 | O<br>‖<br>----C—O---- | Formula (ii) | ----$CH_2$--- | Formula (i) | ----$CH_2$--- | ----$CH_2$--- | ----$CH_2$--- |
| 506 | O<br>‖<br>----C—O---- | Formula (ii) | H | Formula (i) | ----$CH_2$--- | ----$CH_2$--- | H |
| 507 | ----N----<br>H | Formula (ii) | ----$CH_2$--- | Formula (i) | ----$CH_2$--- | ----$CH_2$--- | ----$CH_2$--- |
| 508 | ----O---- | Formula (ii) | ----$CH_2$--- | Formula (i) | ----$CH_2$--- | ----$CH_2$--- | ----$CH_2$--- |

TABLE 10

| Specific example | Number of main-chain atoms | Formula (ii) α | l | β | m | γ | n | Formula (i) $D^2$ | $R^{61}$ | $Y^1$ | $D^1$ |
|---|---|---|---|---|---|---|---|---|---|---|---|
| 509 | 6 | single | 0 | 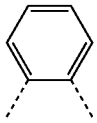 | 1 | $CH_2$--<br>\|<br>---$CH_2$ | 1 | ----O---- | H | single | ----O---- |
| 510 | 6 | single | 0 | 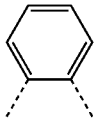 | 1 | $CH_2$--<br>\|<br>---$CH_2$ | 1 | ----O---- | H | single | ----O---- |
| 511 | 7 | single | 0 | 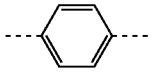 | 1 | ---$CH_2$-- | 1 | ----O---- | H | single | ----O---- |
| 512 | 7 | single | 0 | 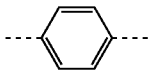 | 1 | ---$CH_2$-- | 1 | ----O---- | H | single | ----O---- |
| 513 | 7 | single | 0 | 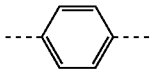 | 1 | ---$CH_2$-- | 1 | ----O---- | $C_2H_5$ | ---$CH_2$-- | ----O---- |
| 514 | 3 | single | 0 | single | 0 | single | 0 | ---C(=O)—O--- | H | single | ---C(=O)—O--- |
| 515 | 7 | single | 0 | 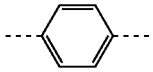 | 1 | ---$CH_2$-- | 1 | ----O---- | H | single | ----O---- |
| 516 | 7 | single | 0 | 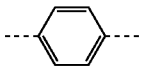 | 1 | ---$CH_2$-- | 1 | ----O---- | H | single | ----O---- |
| 517 | 2 | single | 0 | single | 0 | single | 0 | ----N(H)---- | H | single | ----N(H)---- |

| Specific example | Formula (C2) $R^{21}$ | $R^{22}$ | $R^{23}$ | $R^{24}$ | $R^{25}$ |
|---|---|---|---|---|---|
| 509 | 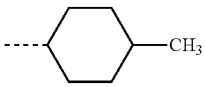 | Formula (ii) | ---$CH_2$-- | Formula (i) | ---$CH_2$-- |
| 510 | 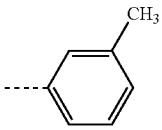 | Formula (ii) | ---$CH_2$-- | Formula (i) | ---$CH_2$-- |
| 511 | 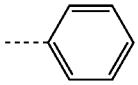 | Formula (ii) | ---$CH_2$-- | Formula (i) | ---$CH_2$-- |
| 512 | 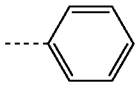 | H | Formula (ii) | Formula (i) | ---$CH_2$-- |

TABLE 10-continued

| | | | | | |
|---|---|---|---|---|---|
| 513 | 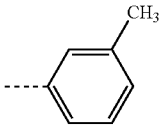 | Formula (ii) | ---$CH_2$-- | Formula (i) | ---$CH_2$-- |
| 514 | 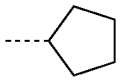 | Formula (ii) | ---$CH_2$-- | Formula (i) | ---$CH_2$-- |
| 515 | 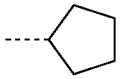 | Formula (ii) | ---$CH_2$-- | Formula (i) | ---$CH_2$-- |
| 516 | 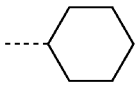 | Formula (ii) | ---$CH_2$-- | Formula (i) | ---$CH_2$-- |
| 517 | 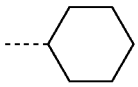 | Formula (ii) | ---$CH_2$-- | Formula (i) | ---$CH_2$-- |

TABLE 11

| Specific example | Number of main-chain atoms | Formula (ii) | | | | | | Formula (i) | | |
|---|---|---|---|---|---|---|---|---|---|---|
| | | α | l | β | m | γ | n | $D^2$ | $R^{61}$ | $Y^1$ |
| 601 | 7 | single | 0 | 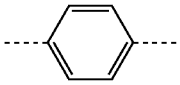 | 1 | ----$CH_2$--- | 1 | ----O---- | H | single |
| 602 | 6 | single | 0 | 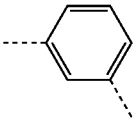 | 1 | single | 0 | ----C(=O)—O---- | H | single |
| 603 | 6 | single | 0 | 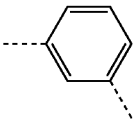 | 1 | ----$CH_2$--- | 1 | ----O---- | H | single |
| 604 | 7 | single | 0 | 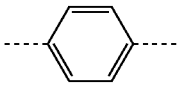 | 1 | ----$CH_2$--- | 1 | ----O---- | $C_2H_5$ | ----$CH_2$--- |
| 605 | 5 | single | 0 | 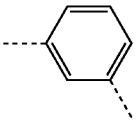 | 1 | single | 0 | ----N(H)---- | H | single |
| 606 | 6 | single | 0 | 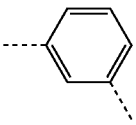 | 1 | ----$CH_2$--- | 1 | ----O---- | $CH_3$ | ----$CH_2$--- |

TABLE 11-continued

| Specific example | Formula (C1) | | | | | | |
|---|---|---|---|---|---|---|---|
| | $D^1$ | $R^{11}$ | $R^{12}$ | $R^{13}$ | $R^{14}$ | $R^{15}$ | $R^{16}$ |
| 601 | ----O---- | Formula (ii) | H | Formula (i) | ----$CH_2$--- | ----$CH_2$--- | H |
| 602 | ----C(=O)—O---- | Formula (ii) | H | Formula (i) | ----$CH_2$--- | ----$CH_2$--- | H |
| 603 | ----O---- | Formula (ii) | ----$CH_2$--- | Formula (i) | ----$CH_2$--- | ----$CH_2$--- | ----$CH_2$--- |
| 604 | ----O---- | Formula (ii) | H | Formula (i) | ----$CH_2$--- | ----$CH_2$--- | H |
| 605 | ----$N^+H$---- | Formula (ii) | H | Formula (i) | ----$CH_2$--- | ----$CH_2$--- | H |
| 606 | ----O---- | Formula (ii) | ----$CH_2$--- | Formula (i) | ----$CH_2$--- | ----$CH_2$--- | ----$CH_2$--- |

TABLE 12

| Specific example | Number of main-chain atoms | Formula (ii) | | | | | | Formula (i) | | | |
|---|---|---|---|---|---|---|---|---|---|---|---|
| | | α | l | β | m | γ | n | $D^2$ | $R^{61}$ | $Y^1$ | $D^1$ |
| 607 | 6 | single | 0 | 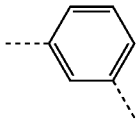 | 1 | single | 0 | ----C(=O)—O---- | H | single | ----C(=O)—O---- |
| 608 | 6 | single | 0 | 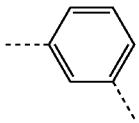 | 1 | ----$CH_2$--- | 1 | ----O---- | $CH_3$ | ----$CH_2$--- | ----O---- |
| 609 | 6 | single | 0 | 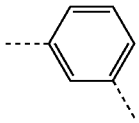 | 1 | ----$CH_2$--- | 1 | ----O---- | H | single | ----O---- |

| Specific example | Formula (C2) | | | | |
|---|---|---|---|---|---|
| | $R^{21}$ | $R^{22}$ | $R^{23}$ | $R^{24}$ | $R^{25}$ |
| 607 | 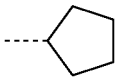 | Formula (ii) | ----$CH_2$--- | Formula (i) | ----$CH_2$--- |
| 608 | 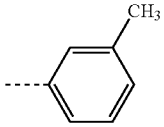 | Formula (ii) | ----$CH_2$--- | Formula (i) | ----$CH_2$--- |
| 609 | 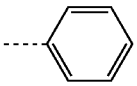 | Formula (ii) | ----$CH_2$--- | Formula (i) | ----$CH_2$--- |

TABLE 13

| Specific example | Number of main-chain atoms | Formula (ii) | | | | | | Formula (i) | | |
|---|---|---|---|---|---|---|---|---|---|---|
| | | α | l | β | m | γ | n | $D^2$ | $R^{61}$ | $Y^1$ |
| 701 | 7 | single | 0 | 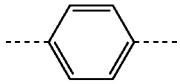 | 1 | ----$CH_2$--- | 1 | ----O---- | H | single |
| 702 | 7 | single | 0 | 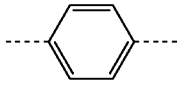 | 1 | ----$CH_2$--- | 1 | ----O---- | H | single |
| 703 | 6 | single | 0 | 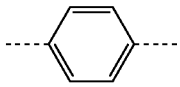 | 1 | single | 0 | ----S---- | H | single |
| 704 | 5 | single | 0 | 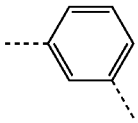 | 1 | single | 0 | ----N(H)---- | H | single |
| 705 | 7 | single | 0 | 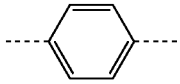 | 1 | ----$CH_2$--- | 1 | ----O---- | H | single |

| Specific example | Formula (C1) | | | | | | |
|---|---|---|---|---|---|---|---|
| | $D^1$ | $R^{11}$ | $R^{12}$ | $R^{13}$ | $R^{14}$ | $R^{15}$ | $R^{16}$ |
| 701 | ----O---- | Formula (ii) | ----$CH_2$--- | Formula (i) | ----$CH_2$--- | ----$CH_2$--- | ----$CH_2$--- |
| 702 | ----O---- | Formula (ii) | ----$CH_2$--- | Formula (i) | ----$CH_2$--- | ----$CH_2$--- | ----$CH_2$--- |
| 703 | ----S---- | Formula (ii) | ----$CH_2$--- | Formula (i) | ----$CH_2$--- | ----$CH_2$--- | ----$CH_2$--- |
| 704 | ----N(H)---- | Formula (ii) | ----$CH_2$--- | Formula (i) | ----$CH_2$--- | ----$CH_2$--- | ----$CH_2$--- |
| 705 | ----O---- | Formula (ii) | H | Formula (i) | ----$CH_2$--- | ----$CH_2$--- | H |

TABLE 14

| Specific example | Number of main-chain atoms | Formula (ii) | | | | | |
|---|---|---|---|---|---|---|---|
| | | α | l | β | m | γ | n |
| 706 | 6 | single | 0 | 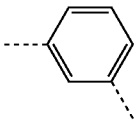 | 1 | single | 0 |
| 707 | 7 | single | 0 | 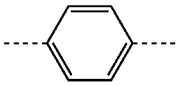 | 1 | ----$CH_2$--- | 1 |
| 708 | 7 | single | 0 | 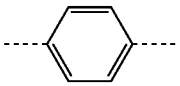 | 1 | ----$CH_2$--- | 1 |
| 709 | 7 | single | 0 | 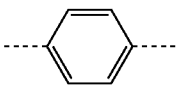 | 1 | ----$CH_2$--- | 1 |

TABLE 14-continued

| Specific example | Formula (i) $D^2$ | $R^{61}$ | $Y^1$ | $D^1$ |
|---|---|---|---|---|
| 706 | O ‖ ----C---O---- | H | single | O ‖ ----C---O---- |
| 707 | ----O---- | H | single | ----O---- |
| 708 | ----O---- | H | single | ----O---- |
| 709 | ----O---- | H | 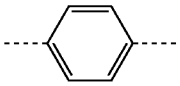 | ----O---- |

| Specific example | Formula (C2) $R^{21}$ | $R^{22}$ | $R^{23}$ | $R^{24}$ | $R^{25}$ |
|---|---|---|---|---|---|
| 706 | 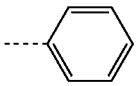 | Formula (ii) | ----$CH_2$--- | Formula (i) | ----$CH_2$--- |
| 707 | 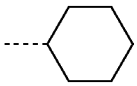 | Formula (ii) | ----$CH_2$--- | Formula (i) | ----$CH_2$--- |
| 708 | 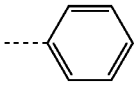 | Formula (ii) | ----$CH_2$--- | Formula (i) | ----$CH_2$--- |
| 709 | 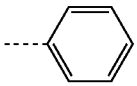 | Formula (ii) | ----$CH_2$--- | Formula (i) | ----$CH_2$--- |

TABLE 15

| Specific example | Number of main-chain atoms | Formula (ii) α | l | β | m | γ | n | Formula (i) $D^2$ | $R^{61}$ | $Y^1$ |
|---|---|---|---|---|---|---|---|---|---|---|
| 801 | 6 | single | 0 | 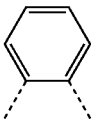 | 1 | $CH_2$--- \| ----$CH_2$ | 1 | ----O---- | H | single |
| 802 | 6 | single | 0 | 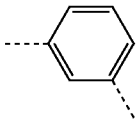 | 1 | ----$CH_2$--- | 1 | ----O---- | H | single |
| 803 | 6 | single | 0 | 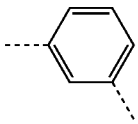 | 1 | single | 0 | O ‖ ----C---O---- | H | single |
| 804 | 5 | single | 0 | 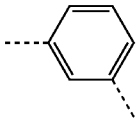 | 1 | single | 0 | ----N---- H | H | single |

TABLE 15-continued

| | | | | | | | | | | |
|---|---|---|---|---|---|---|---|---|---|---|
| 805 | 6 | single | 0 | 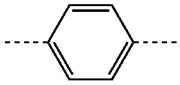 | 1 | single | 0 | ----S---- | H | single |
| 806 | 4 | 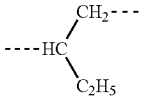 | 1 | single | 0 | single | 0 | ----O---- | $C_2H_5$ | ----$CH_2$--- |

| Specific example | Formula (C1) | | | | | | |
|---|---|---|---|---|---|---|---|
| | $D^1$ | $R^{11}$ | $R^{12}$ | $R^{13}$ | $R^{14}$ | $R^{15}$ | $R^{16}$ |
| 801 | ----O---- | Formula (ii) | ----$CH_2$--- | Formula (i) | ----$CH_2$--- | ----$CH_2$--- | ----$CH_2$--- |
| 802 | ----O---- | Formula (ii) | ----$CH_2$--- | Formula (i) | ----$CH_2$--- | ----$CH_2$--- | ----$CH_2$--- |
| 803 | 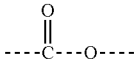 | Formula (ii) | ----$CH_2$--- | Formula (i) | ----$CH_2$--- | ----$CH_2$--- | ----$CH_2$--- |
| 804 |  | Formula (ii) | ----$CH_2$--- | Formula (i) | ----$CH_2$--- | ----$CH_2$--- | ----$CH_2$--- |
| 805 | ----S---- | Formula (ii) | ----$CH_2$--- | Formula (i) | ----$CH_2$--- | ----$CH_2$--- | ----$CH_2$--- |
| 806 | ----O---- | Formula (ii) | ----$CH_2$--- | Formula (i) | ----$CH_2$--- | ----$CH_2$--- | ----$CH_2$--- |

TABLE 16

| Specific example | Number of main-chain atoms | Formula (ii) | | | | | | Formula (i) | | | |
|---|---|---|---|---|---|---|---|---|---|---|---|
| | | α | l | β | m | γ | n | $D^2$ | $R^{61}$ | $Y^1$ | $D^1$ |
| 807 | 4 | 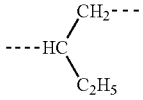 | 1 | single | 0 | single | 0 | ----O---- | H | single | ----O---- |
| 808 | 6 | single | 0 | 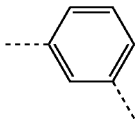 | 1 | single | 0 | 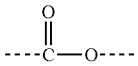 | H | single | 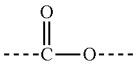 |

| Specific example | Formula (C2) | | | | |
|---|---|---|---|---|---|
| | $R^{21}$ | $R^{22}$ | $R^{23}$ | $R^{24}$ | $R^{25}$ |
| 807 | 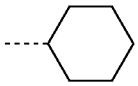 | Formula (ii) | ----$CH_2$--- | Formula (i) | ----$CH_2$--- |
| 808 | 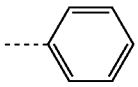 | Formula (ii) | ----$CH_2$--- | Formula (i) | ----$CH_2$--- |

TABLE 17

| Specific example | Number of main-chain atoms | Formula (ii) α | l | β | m | γ | Formula (i) n | $D^2$ | $R^{61}$ | $Y^1$ |
|---|---|---|---|---|---|---|---|---|---|---|
| 901 | 7 | single | 0 | 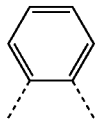 | 1 | $CH_2$---<br>\|<br>----$CH_2$ | 1 | O<br>‖<br>----C—O---- | H | single |
| 902 | 4 | $CH_2$---<br>\|<br>----$CH_2$ | 1 | single | 0 | single | 0 | ----O---- | H | single |
| 903 | 2 | single | 0 | single | 0 | single | 0 | ----O---- | H | single |
| 904 | 7 | single | 0 | 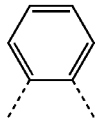 | 1 | $CH_2$---<br>\|<br>----$CH_2$ | 1 | O<br>‖<br>----C—O---- | H | single |
| 905 | 2 | single | 0 | single | 0 | single | 0 | ----O---- | H | single |

| Specific example | Formula (C1) $D^1$ | $R^{11}$ | $R^{12}$ | $R^{13}$ | $R^{14}$ | $R^{15}$ | $R^{16}$ |
|---|---|---|---|---|---|---|---|
| 901 | O<br>‖<br>----C—O---- | Formula(ii) | ----$CH_2$--- | Formula (i) | ----$CH_2$--- | ----$CH_2$--- | ----$CH_2$--- |
| 902 | ----O---- | Formula (ii) | H | Formula (i) | ----$CH_2$--- | ----$CH_2$--- | H |
| 903 | ----O---- | Formula (ii) | ----$CH_2$--- | Formula (i) | ----$CH_2$--- | ----$CH_2$--- | ----$CH_2$--- |
| 904 | O<br>‖<br>----C—O---- | Formula (ii) | H | Formula (i) | ----$CH_2$--- | ----$CH_2$--- | H |
| 905 | ----O---- | Formula (ii) | ----$CH_2$--- | Formula (i) | ----$CH_2$--- | ----$CH_2$--- | ----$CH_2$--- |

TABLE 18

| Specific example | Number of main-chain atoms | Formula (ii) α | l | β | m | γ | n | Formula (i) $D^2$ | $R^{61}$ | $Y^1$ | $D^1$ |
|---|---|---|---|---|---|---|---|---|---|---|---|
| 906 | 4 | $CH_2$---<br>\|<br>----$CH_2$ | 1 | single | 0 | single | 0 | ----O---- | H | single | ----O---- |
| 907 | 4 | $CH_2$---<br>\|<br>----$CH_2$ | 1 | single | 0 | single | 0 | ----O---- | H | single | ----N----<br>H |
| 908 | 4 | $CH_2$---<br>\|<br>----$CH_2$ | 1 | single | 0 | single | 0 | ----O---- | H | single | ----S---- |

TABLE 18-continued

| Specific example | Formula (C2) | | | | |
|---|---|---|---|---|---|
| | $R^{21}$ | $R^{22}$ | $R^{23}$ | $R^{24}$ | $R^{25}$ |
| 906 | 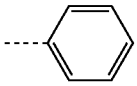 | Formula (ii) | ----$CH_2$--- | Formula (i) | ----$CH_2$--- |
| 907 | 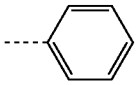 | Formula (ii) | ----$CH_2$--- | Formula (i) | ----$CH_2$--- |
| 908 | 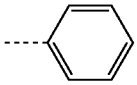 | Formula (ii) | ----$CH_2$--- | Formula (i) | ----$CH_2$--- |

TABLE 19

| Specific example | Number of main-chain atoms | Formula (ii) | | | | | | Formula (i) | | |
|---|---|---|---|---|---|---|---|---|---|---|
| | | α | l | β | m | γ | n | $D^2$ | $R^{61}$ | $Y^1$ |
| 140 | 4 | 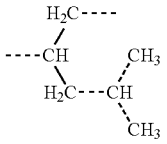 | 1 | single | 0 | single | 0 | ----O---- | H | single |
| 141 | 7 | 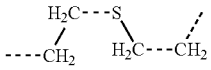 | 1 | single | 0 | single | 0 | ----O---- | H | single |
| 142 | 7 | 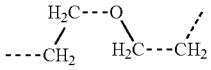 | 1 | single | 0 | single | 0 | ----O---- | H | single |

| Specific example | Formula (C1) | | | | | | |
|---|---|---|---|---|---|---|---|
| | $D^1$ | $R^{11}$ | $R^{12}$ | $R^{13}$ | $R^{14}$ | $R^{15}$ | $R^{16}$ |
| 140 | ----O---- | Formula (ii) | ----$CH_2$--- | Formula (i) | ----$CH_2$--- | ----$CH_2$--- | ----$CH_2$--- |
| 141 | ----O---- | Formula (ii) | ----$CH_2$--- | Formula (i) | ----$CH_2$--- | ----$CH_2$--- | ----$CH_2$--- |
| 142 | ----O---- | Formula (ii) | ----$CH_2$--- | Formula (i) | ----$CH_2$--- | ----$CH_2$--- | ----$CH_2$--- |

TABLE 20

| Specific example | Number of main-chain atoms | Formula (ii) | | | | | | Formula (i) | | |
|---|---|---|---|---|---|---|---|---|---|---|
| | | α | l | β | m | γ | n | $D^2$ | $R^{61}$ | $Y^1$ |
| 143 | 4 | 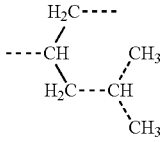 | 1 | single | 0 | single | 0 | ----O---- | H | single |
| 144 | 7 | 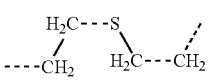 | 1 | single | 0 | single | 0 | ----O---- | H | single |
| 145 | 7 | 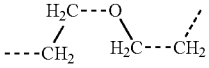 | 1 | single | 0 | single | 0 | ----O---- | H | single |

TABLE 20-continued
| Specific example | Formula (C2) | | | | |
|---|---|---|---|---|---|
| | $R^{21}$ | $R^{22}$ | $R^{23}$ | $R^{24}$ | $R^{25}$ |
| 143 | 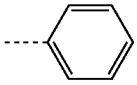 | Formula (ii) | ----$CH_2$--- | Formula (i) | ----$CH_2$--- |
| 144 | 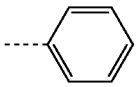 | Formula (ii) | ----$CH_2$--- | Formula (i) | ----$CH_2$--- |
| 145 | 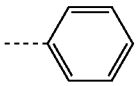 | Formula (ii) | ----$CH_2$--- | Formula (i) | ----$CH_2$--- |
TABLE 21
| Specific example | $A^1$ |
|---|---|
| 101 | 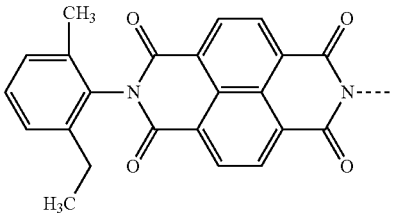 |
| 102 | 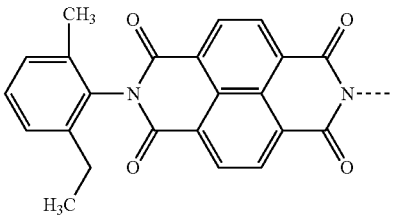 |
| 103 | 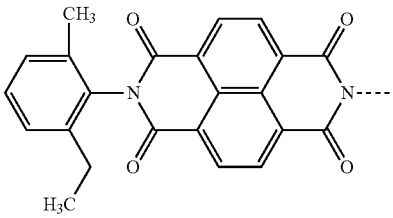 |
| 104 | 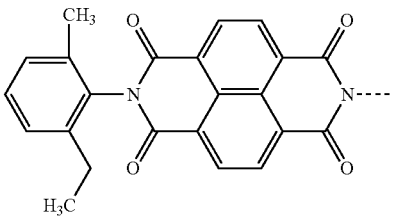 |

TABLE 21-continued
| Specific example | $A^1$ |
|---|---|
| 105 | 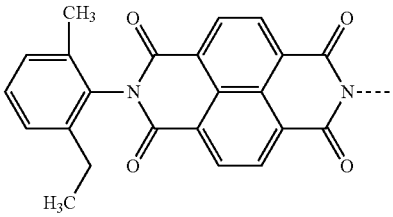 |
| 106 | 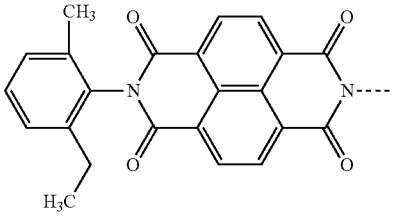 |
| 107 | 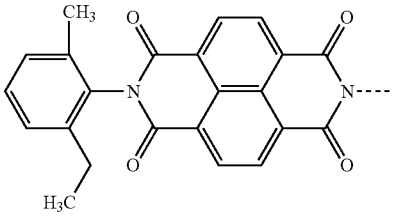 |
| 108 | 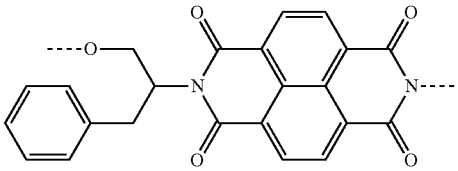 |
| 109 | 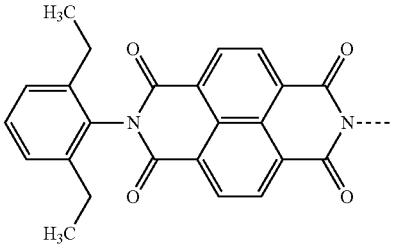 |
| 110 | 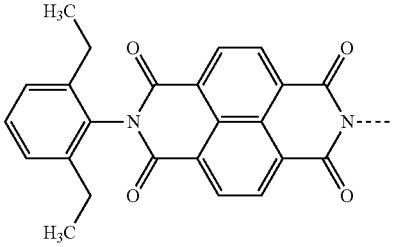 |

TABLE 21-continued
| Specific example | $A^1$ |
|---|---|
| 111 | 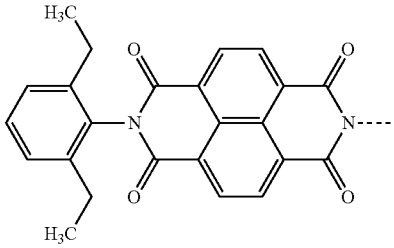 |
| 112 | 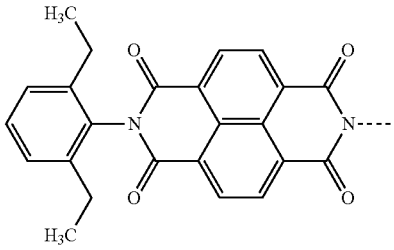 |
| 113 | 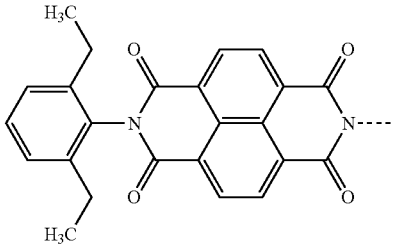 |
| 114 | 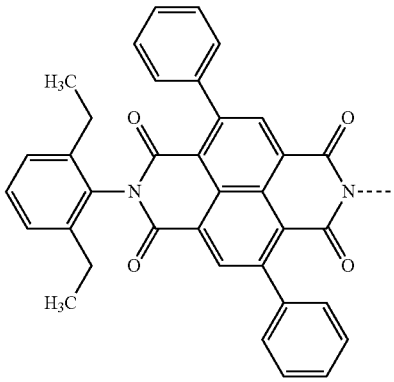 |
| 115 | 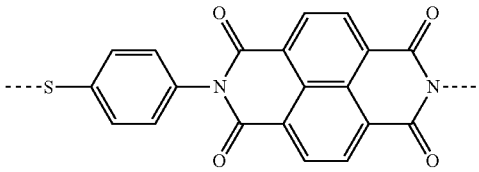 |
| 116 | 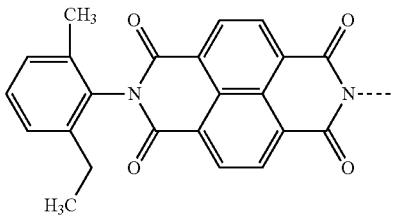 |

TABLE 21-continued
| Specific example | $A^1$ |
|---|---|
| 117 | 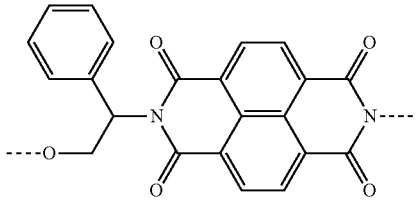 |
| 118 | 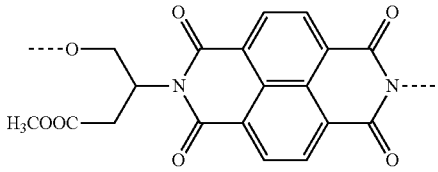 |
| 119 | 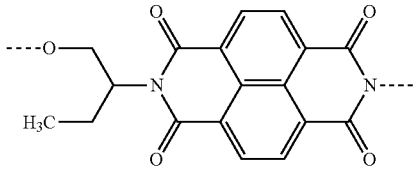 |
| 120 | 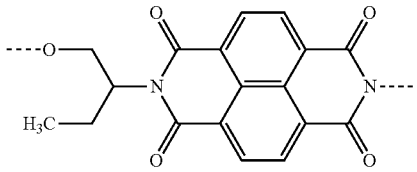 |
| 121 | 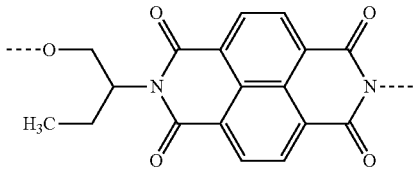 |
| 122 | 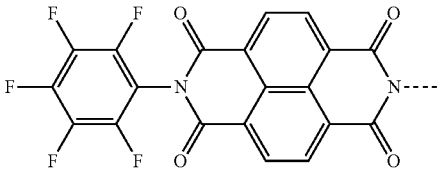 |
| 123 | 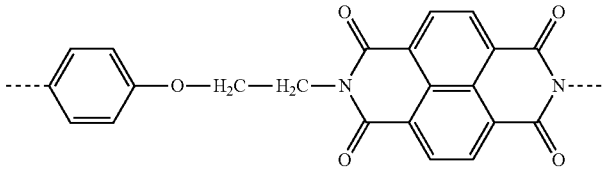 |
| 124 | 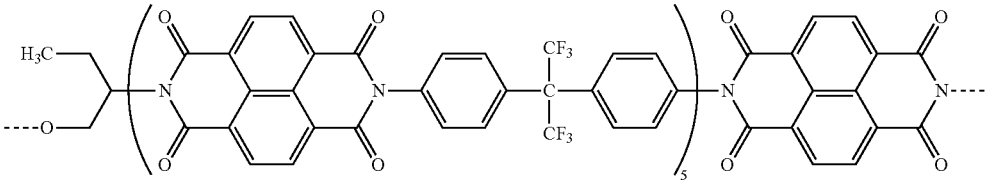 |

TABLE 22
| Specific example | $A^1$ |
|---|---|
| 125 | 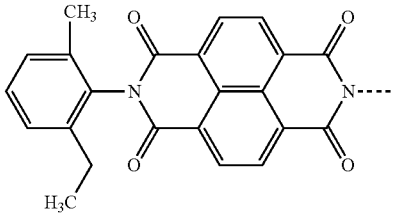 |
| 126 | 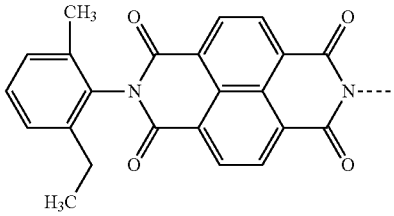 |
| 127 | 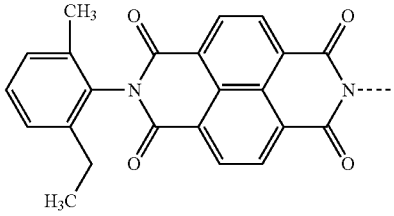 |
| 128 | 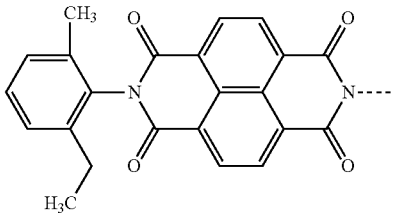 |
| 129 | 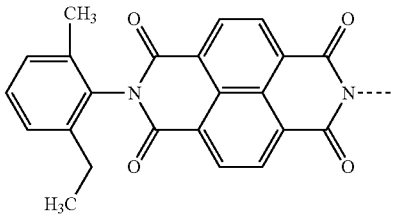 |
| 130 | 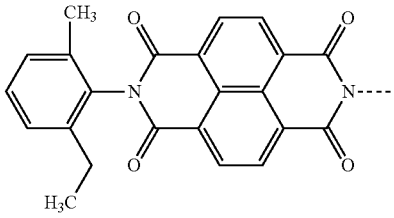 |
| 131 | 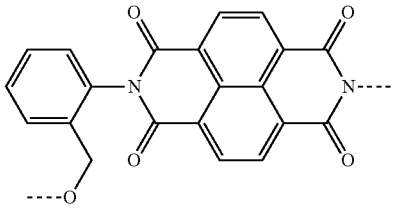 |

TABLE 22-continued
| Specific example | $A^1$ |
|---|---|
| 132 | 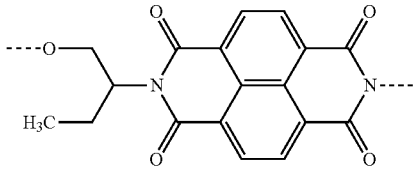 |
| 133 | 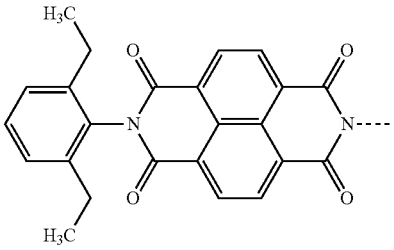 |
| 134 | 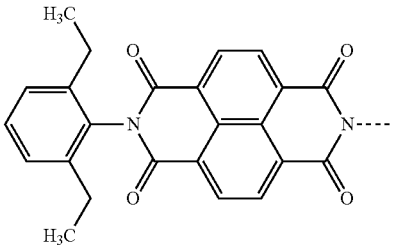 |
| 135 | 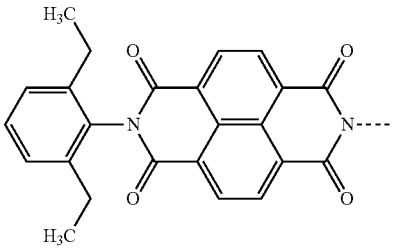 |
| 136 | 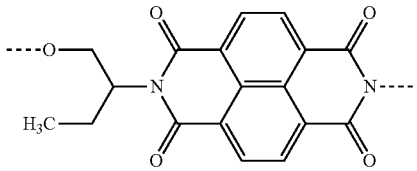 |
| 137 | 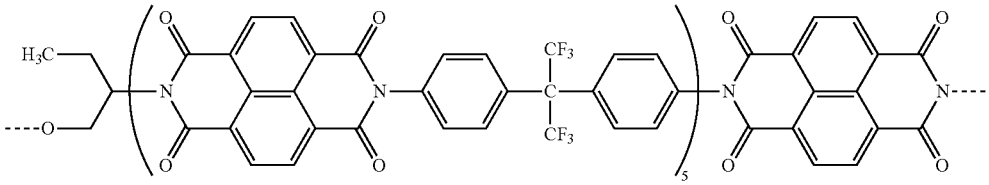 |
| 138 | 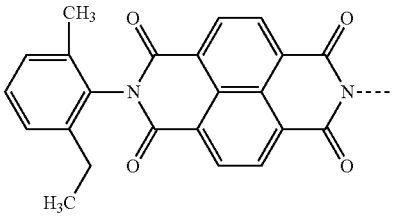 |

TABLE 22-continued
| Specific example | $A^1$ |
|---|---|
| 139 | 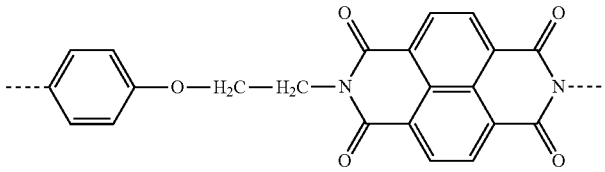 |
TABLE 23
| Specific example | $A^1$ |
|---|---|
| 201 | 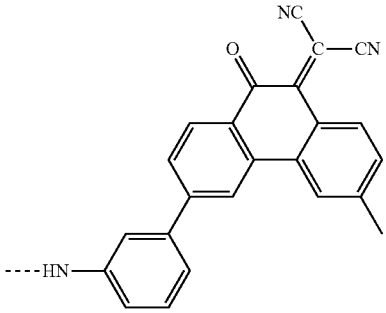 |
| 202 | 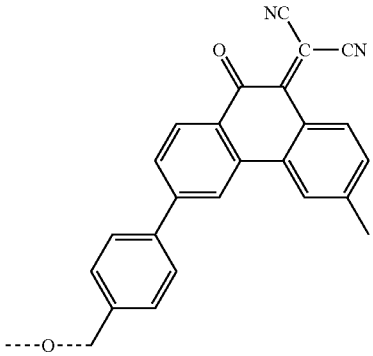 |
| 203 | 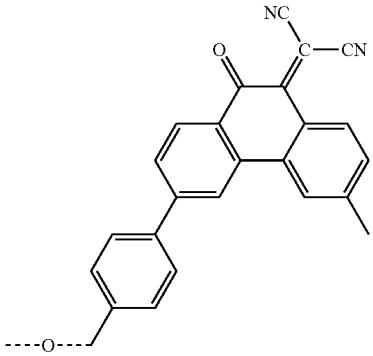 |
TABLE 23-continued
| Specific example | $A^1$ |
|---|---|
| 204 | 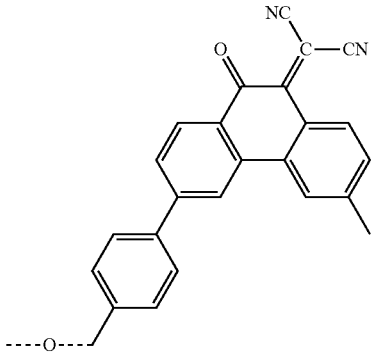 |
| 205 | 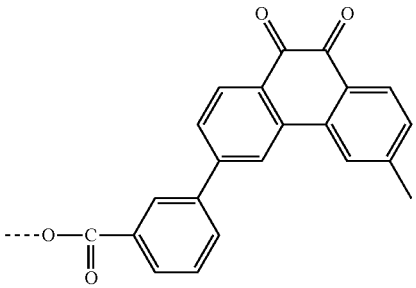 |
| 206 | 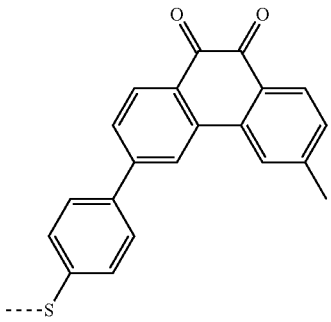 |

TABLE 23-continued
| Specific example | $A^1$ |
|---|---|
| 207 | 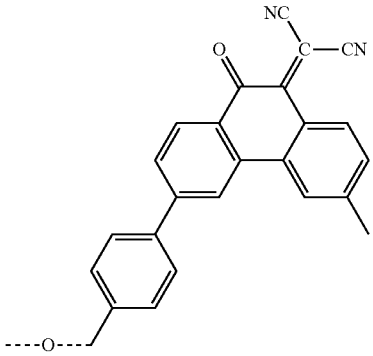 |
| 208 | 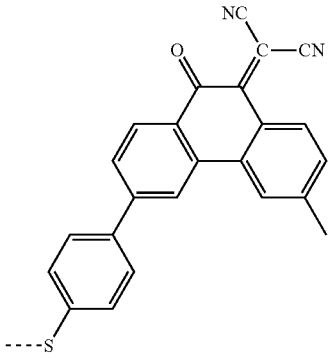 |
| 301 | 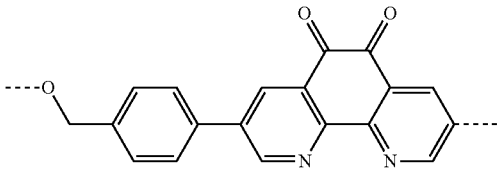 |
| 302 | 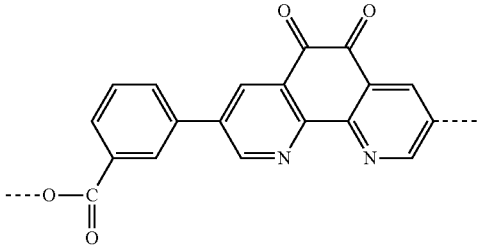 |
| 303 | 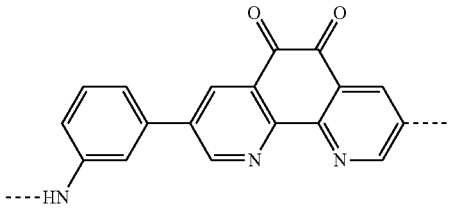 |
| 304 | 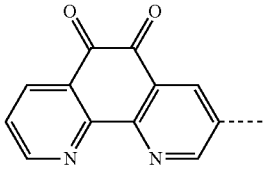 |
TABLE 23-continued
| Specific example | $A^1$ |
|---|---|
| 305 | 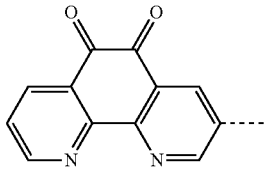 |
| 306 | 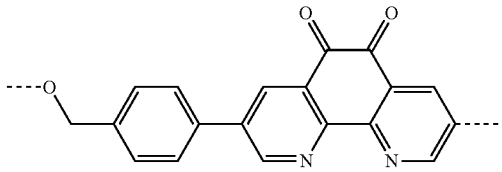 |
| 401 | 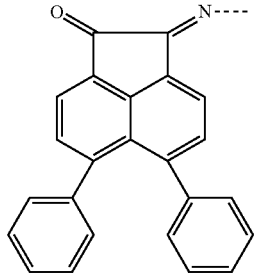 |
| 402 | 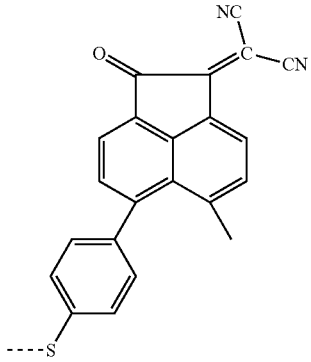 |
| 403 | 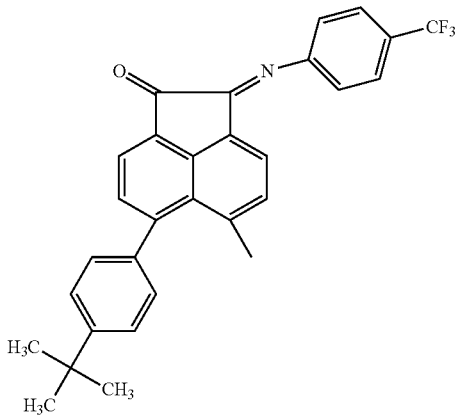 |

TABLE 24
| Specific example | $A^1$ |
|---|---|
| 404 | 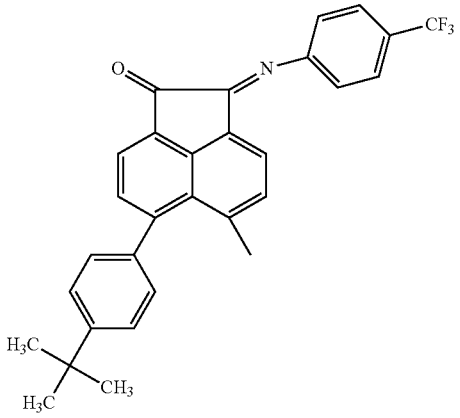 |
| 405 | 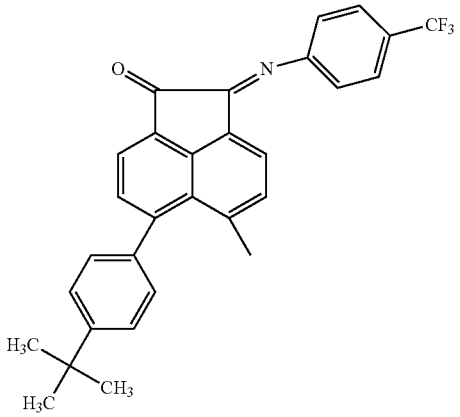 |
| 406 | 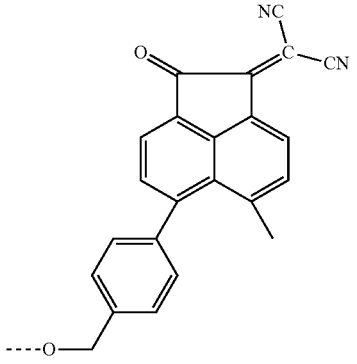 |
| 407 | 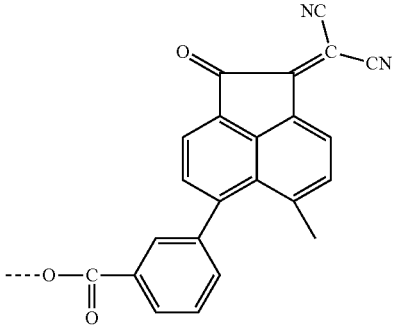 |
TABLE 24-continued
| Specific example | $A^1$ |
|---|---|
| 408 | 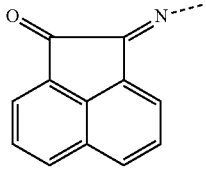 |
| 409 | 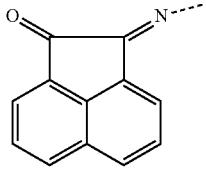 |
| 501 | 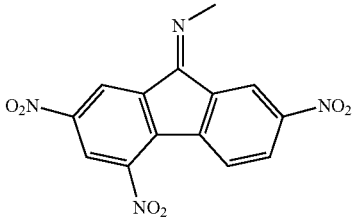 |
| 502 | 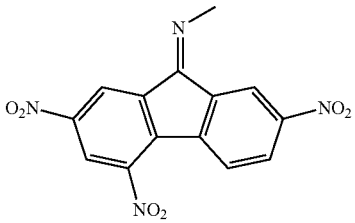 |
| 503 | 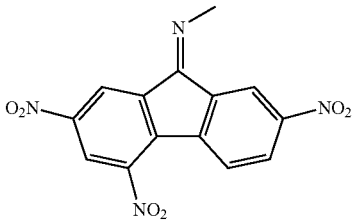 |
| 504 | 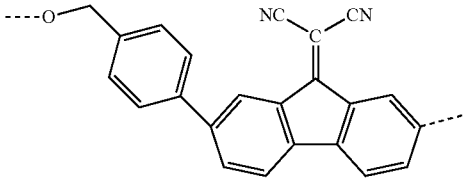 |
| 505 | 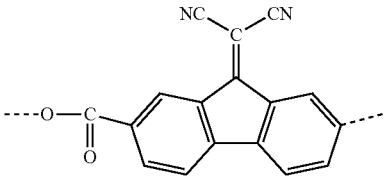 |

TABLE 24-continued
| Specific example | $A^1$ |
|---|---|
| 506 | 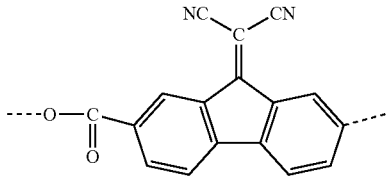 |
| 507 | 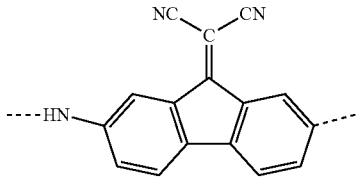 |
| 508 | 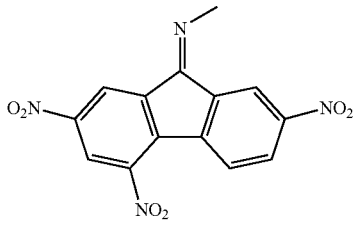 |
| 509 | 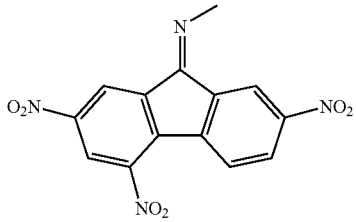 |
| 510 | 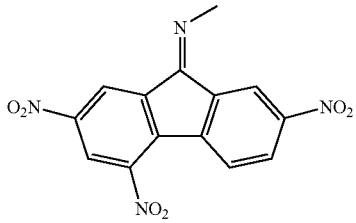 |
| 511 | 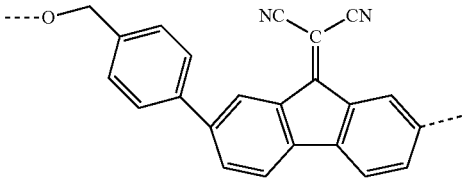 |
| 512 | 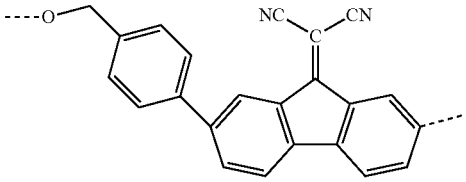 |
TABLE 25
| Specific example | $A^1$ |
|---|---|
| 513 | 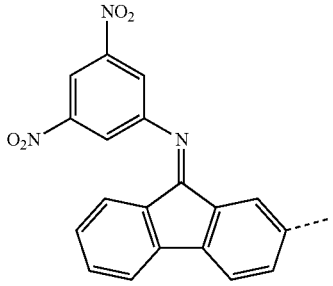 |
| 514 | 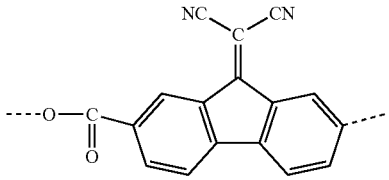 |
| 515 | 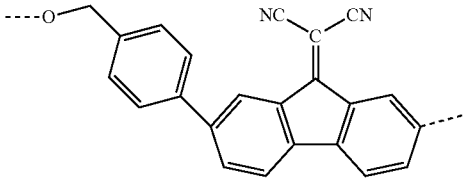 |
| 516 | 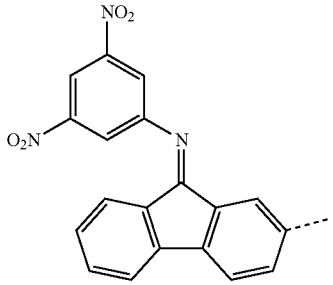 |
| 517 | 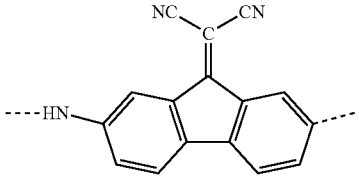 |
| 601 | 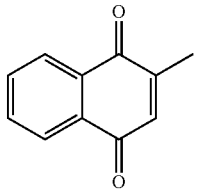 |
| 602 | 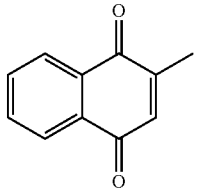 |

TABLE 25-continued
| Specific example | $A^1$ |
|---|---|
| 603 | 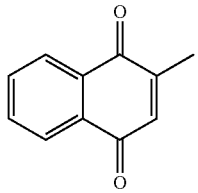 |
| 604 | 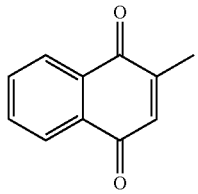 |
| 605 | 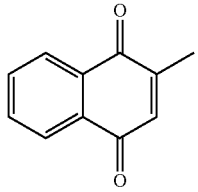 |
| 606 | 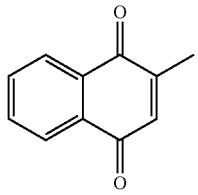 |
| 607 | 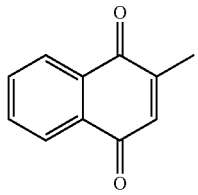 |
| 608 | 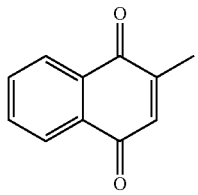 |
| 609 | 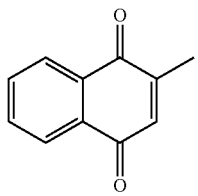 |
TABLE 25-continued
| Specific example | $A^1$ |
|---|---|
| 701 | 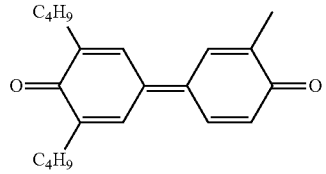 |
| 702 | 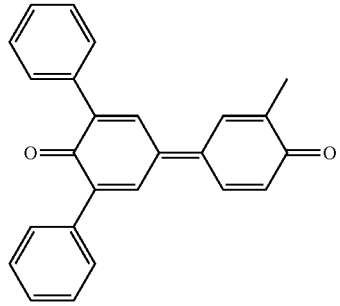 |
| 703 | 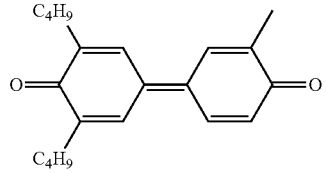 |
| 704 | 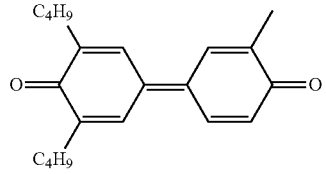 |
| 705 | 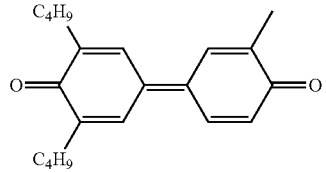 |
| 706 | 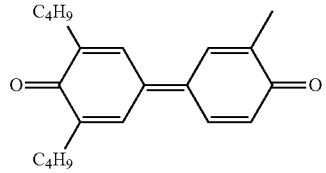 |
| 707 | 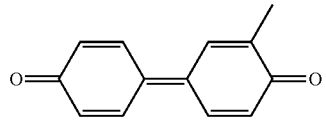 |
| 708 | 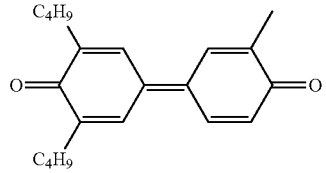 |

TABLE 25-continued
| Specific example | $A^1$ |
|---|---|
| 709 | 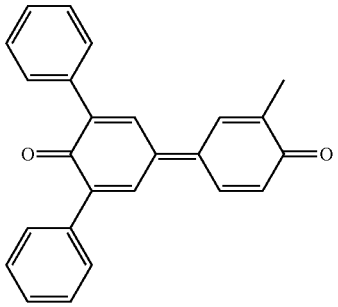 |
TABLE 26
| Specific example | $A^1$ |
|---|---|
| 801 | 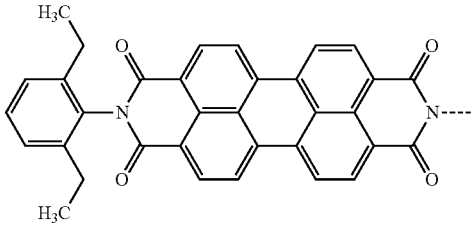 |
| 802 | 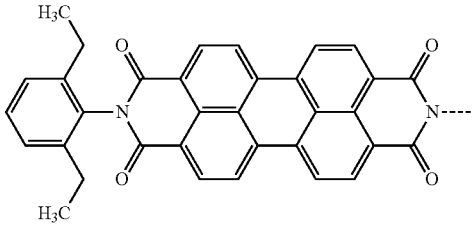 |
| 803 | 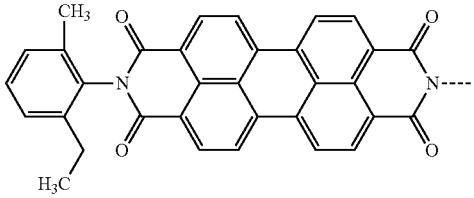 |
| 804 | 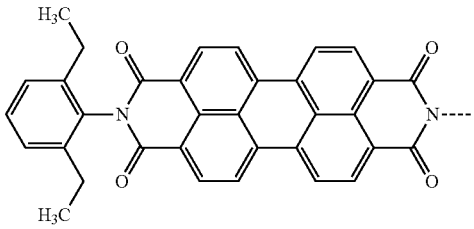 |
TABLE 26-continued
| Specific example | $A^1$ |
|---|---|
| 805 | 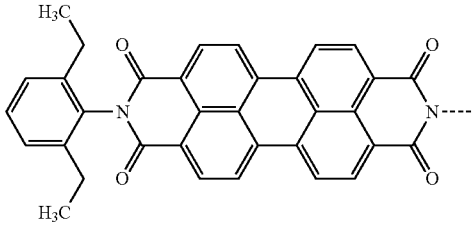 |
| 806 | 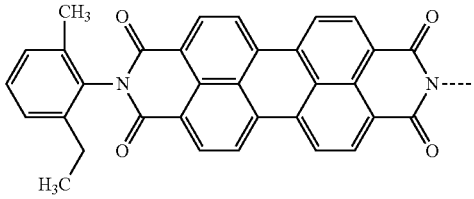 |
| 807 | 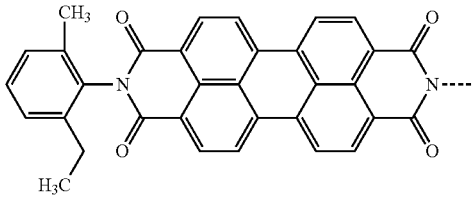 |
| 808 | 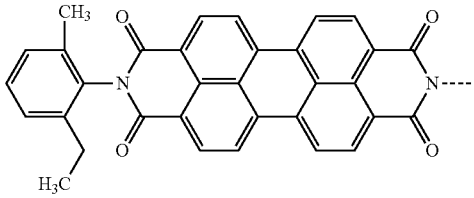 |
| 901 | 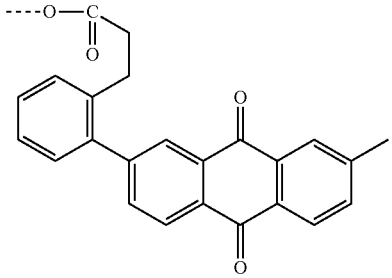 |
| 902 | 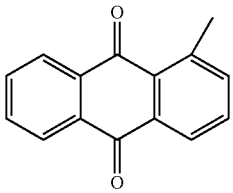 |
| 903 | 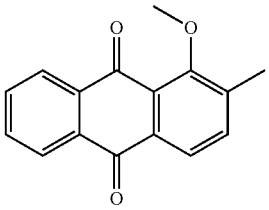 |

TABLE 26-continued

| Specific example | $A^1$ |
|---|---|
| 904 | 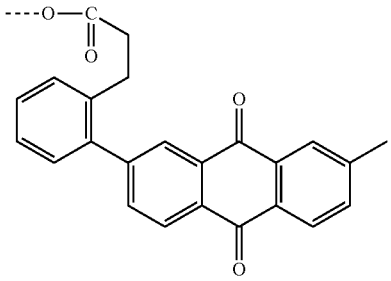 |
| 905 | 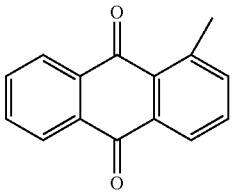 |
| 906 | 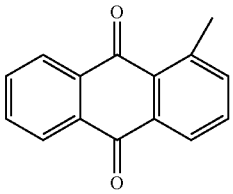 |
| 907 | 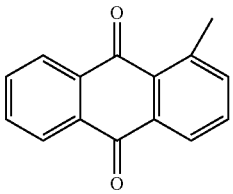 |
| 908 | 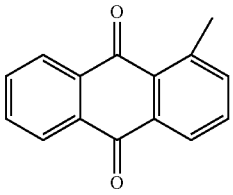 |

TABLE 27

| Specific example | $A^1$ |
|---|---|
| 140 | 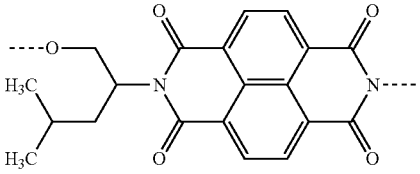 |

TABLE 27-continued

| Specific example | $A^1$ |
|---|---|
| 141 | 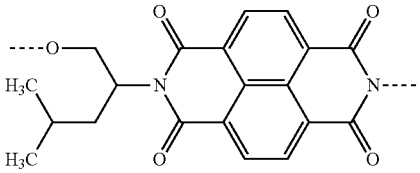 |
| 142 | 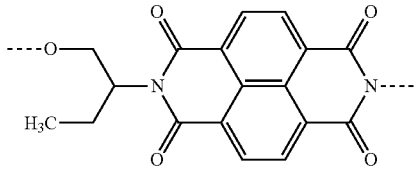 |
| 143 | 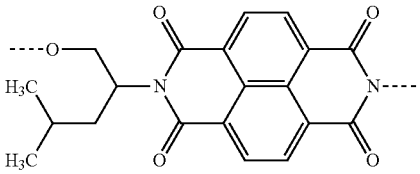 |
| 144 | 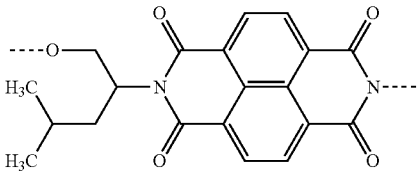 |
| 145 | 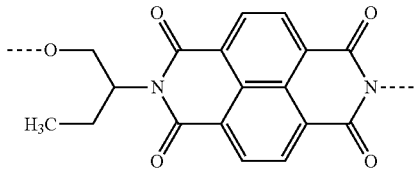 |

The undercoat layer having the structure represented by the formula (C1) or the structure represented by the formula (C2) is formed by applying an undercoat layer coating liquid which contains a melamine compound or a guanamine compound, a resin containing a polymerizable functional group capable of reacting with these compounds, and an electron-transporting substance containing a polymerizable functional group capable of reacting with these compounds to form a coating film, and then thermally curing the resulting coating film.

Melamine Compound and Guanamine Compound

The melamine compound and the guanamine compound are described below. The melamine compound or the guanamine compound is synthesized by a known method using, for example, formaldehyde and melamine or guanamine.

Specific examples of the melamine compound and the guanamine compound are described below. While the specific examples described below are monomers, oligomers (multimers) of the monomers may be contained. From the viewpoint of suppressing the positive ghost, the monomer may be contained in an amount of 10% by mass or more with respect to the total mass of the monomer and the multimer. The degree of polymerization of the multimer may be 2 or more and 100 or less. The multimers and the monomers may be used in combination of two or more. Examples of the melamine compound that are commonly available include SUPER MELAMI No. 90 (manufactured by NOF Corporation); SUPER BECKAMIN (R) TD-139-60, L-105-60, L127-60, L110-60, J-820-60, and G-821-60 (manufactured by DIC Inc.); UBAN 2020 (manufactured by Mitsui Chemicals, Inc.); SUMITEX RESIN M-3 (manufactured by Sumitomo Chemical Co., Ltd.); NIKALACK MW-30, MW-390, and MX-750LM (manufactured by Nippon Carbide Industries Co., Inc). Examples of the guanamine compound that are commonly commercially available include SUPER BECKAMIN (R) L-148-55, 13-535, L-145-60, and TD-126 (manufactured by DIC Inc.); and NIKALACK BL-60 and BX-4000 (manufactured by Nippon Carbide Industries Co., Inc).

Specific examples of the melamine compound are described below.

(C1-1)

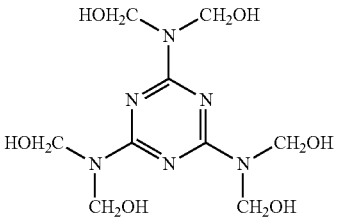

(C1-2)

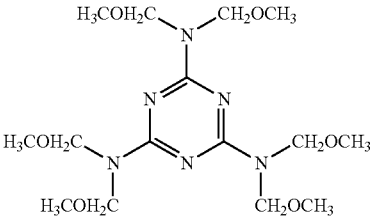

(C1-3)

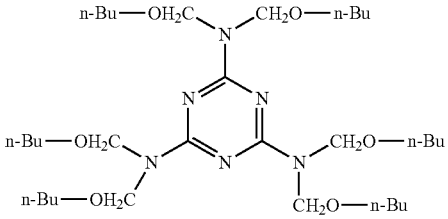

(C1-4)

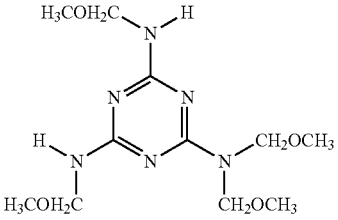

(C1-5)

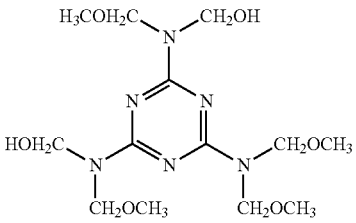

-continued (C1-6)

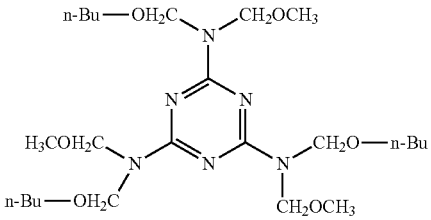

(C1-7)

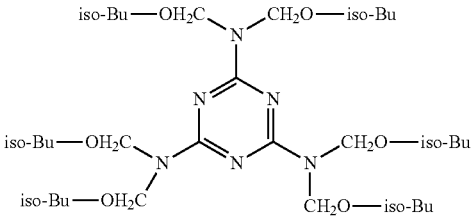

(C1-8)

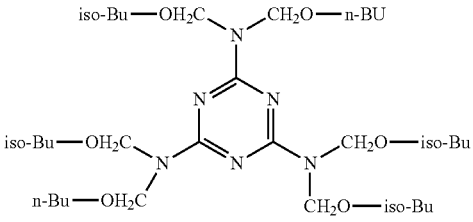

(C1-9)

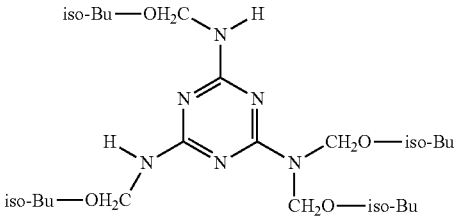

(C1-10)

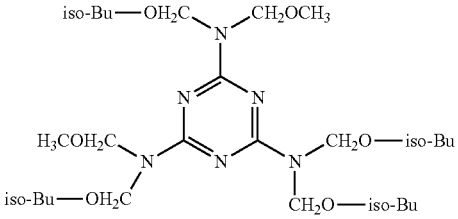

(C1-11)

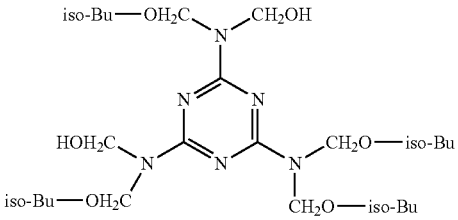

(C1-12)

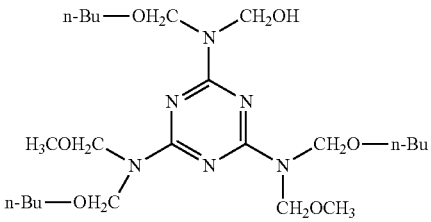

Specific examples of the guanamine compound are described below.
(C2-1)
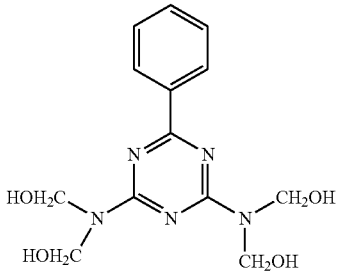
(C2-2)
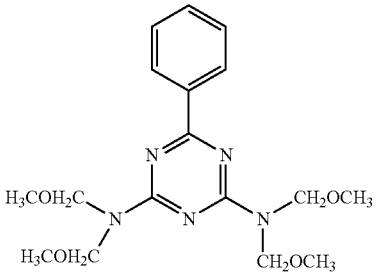
(C2-3)
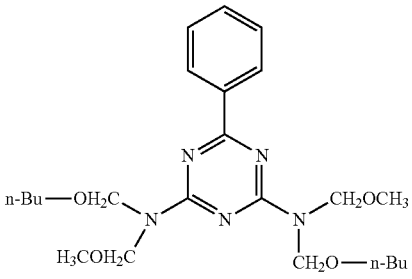
(C2-4)
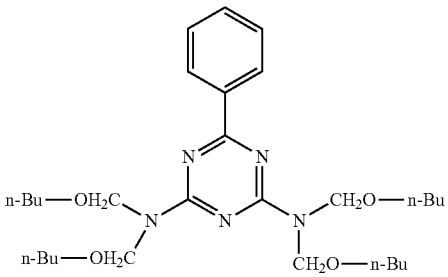
(C2-5)
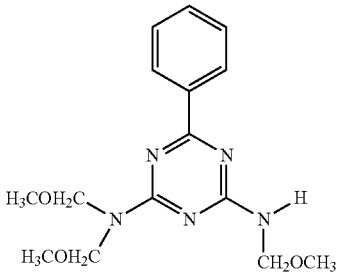
-continued
(C2-7)
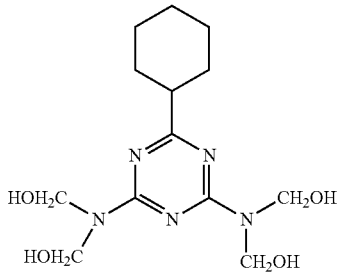
(C2-8)
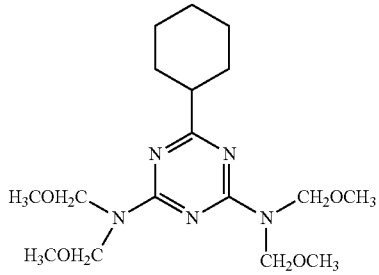
(C2-9)
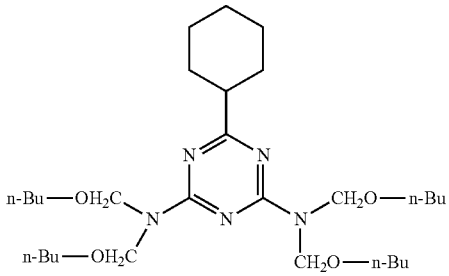
(C2-10)
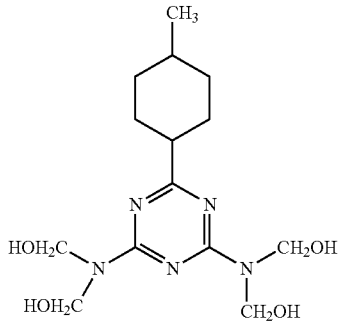
(C2-11)
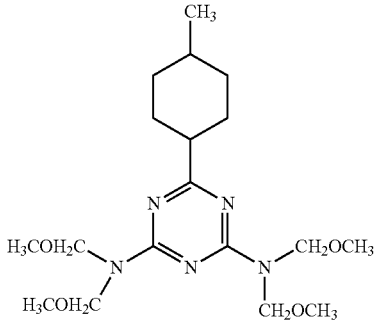

-continued (C2-12)

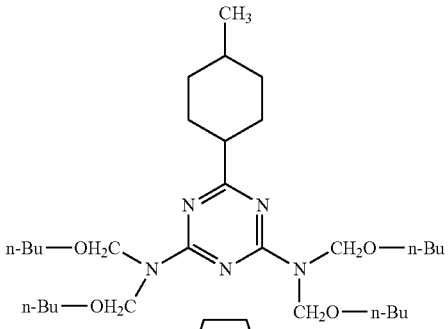

(C2-13)

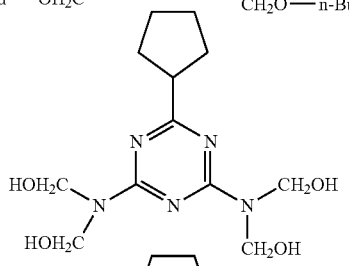

(C2-14)

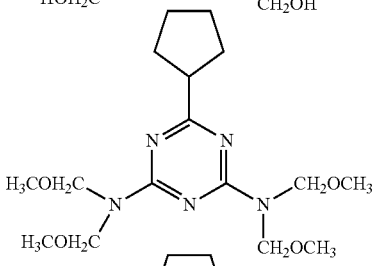

(C2-15)

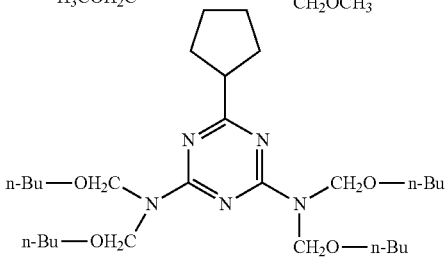

(C2-16)

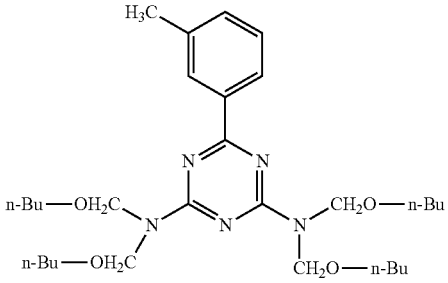

-continued (C2-17)

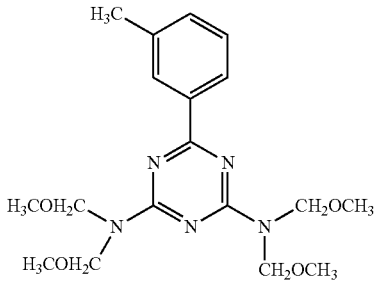

(C2-18)

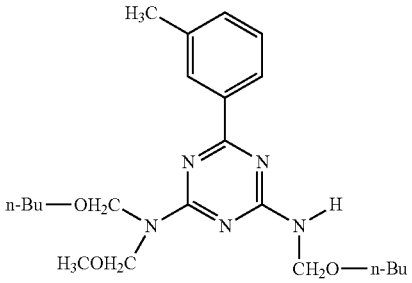

The electron-transporting substance containing a polymerizable functional group capable of reacting with the melamine compound or the guanamine compound is described below. The electron-transporting substance is derived from a structure represented by $A^1$ in the formula (ii). The electron-transporting substance may be a monomer containing an electron-transporting moiety represented by any one of the formula (A1) to (A9) or may be an oligomer containing a plurality of electron-transporting moieties. In the case of the oligomer, from the viewpoint of inhibiting electron trapping, the oligomer may have a weight-average molecular weight (Mw) of 5000 or less.

Examples of the electron-transporting substance are described below. Specific examples of a compound having a structure represented by the formula (A1) are described below.

(A1-1)

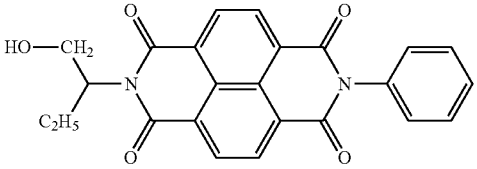

(A1-2)

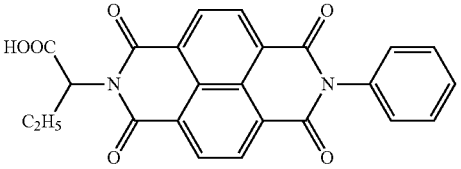

-continued
(A1-3)
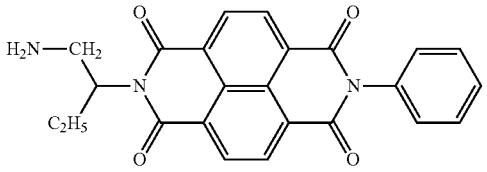
(A1-4)
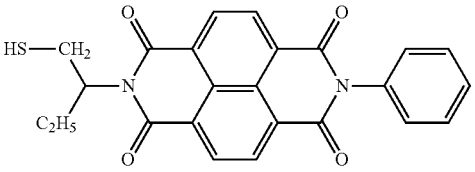
(A1-5)
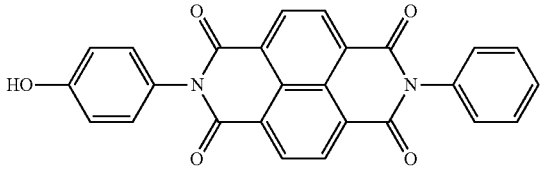
(A1-6)
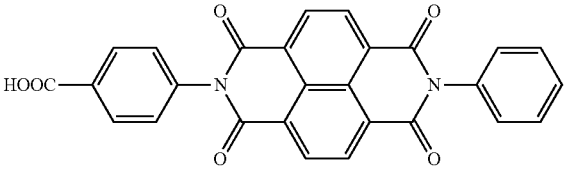
(A1-7)
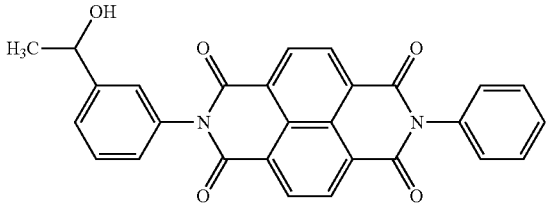
(A1-8)
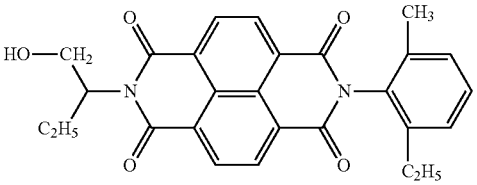
(A1-9)
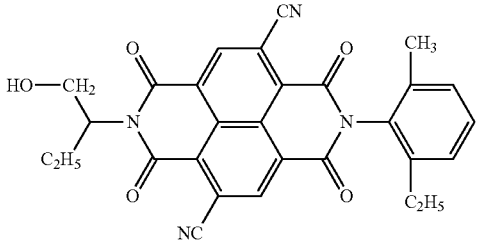
(A1-10)
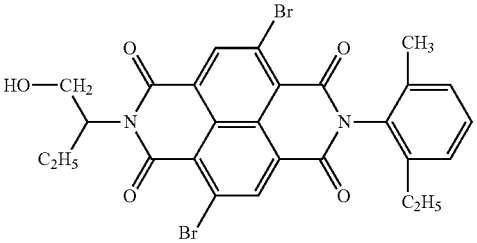
(A1-11)
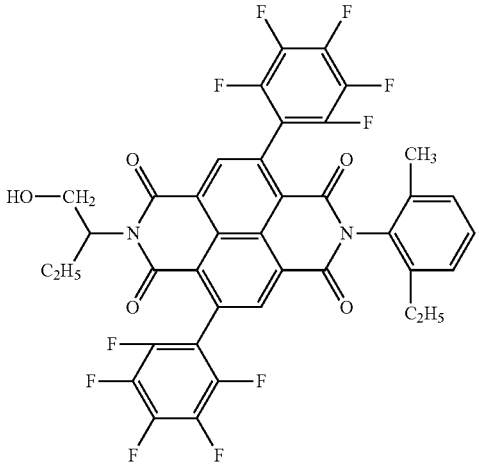
(A1-12)
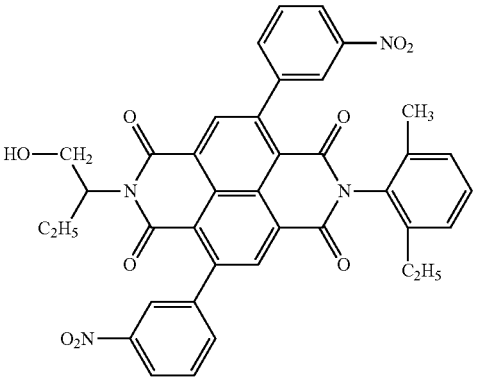
(A1-13)
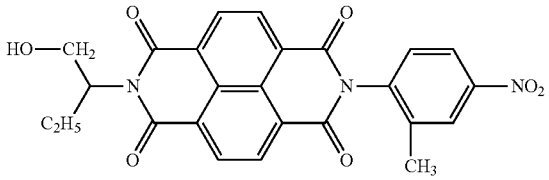
(A1-14)
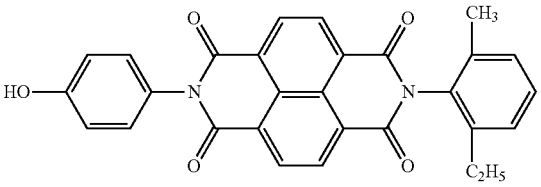

-continued
(A1-15)
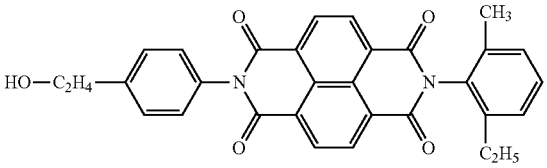
(A1-16)
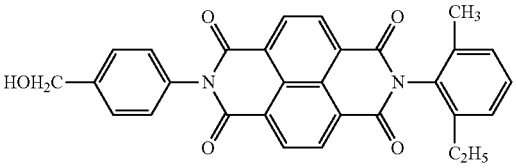
(A1-17)
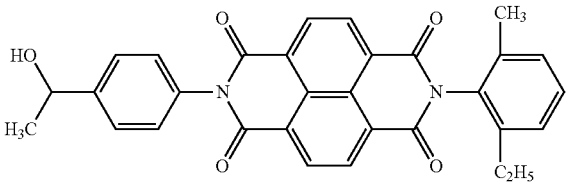
(A1-18)
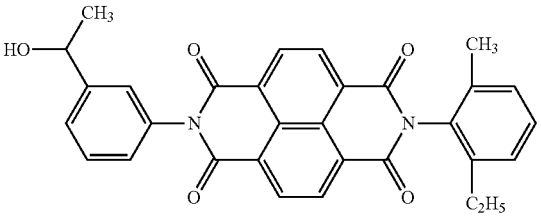
(A1-19)
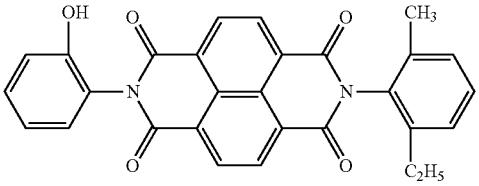
(A1-20)
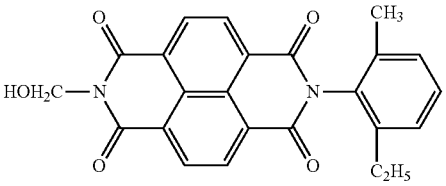
(A1-21)
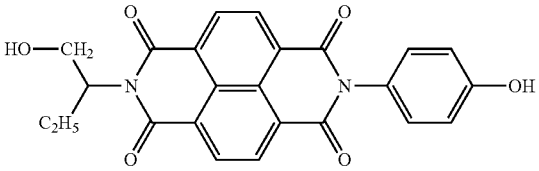
(A1-22)
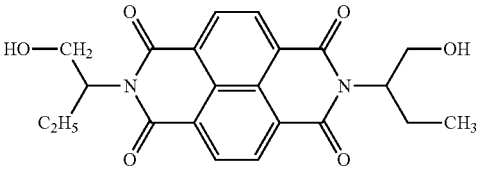
(A1-23)
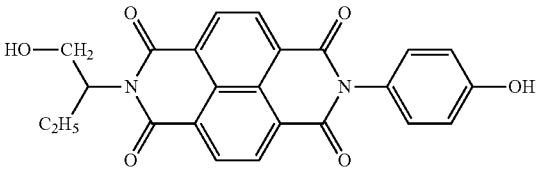
(A1-24)
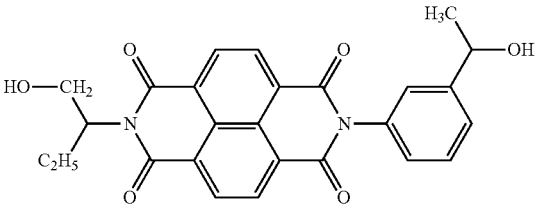
(A1-25)
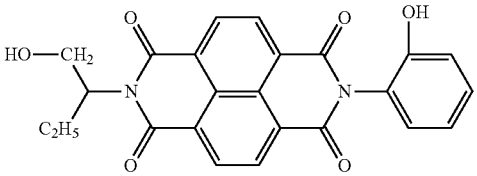
(A1-26)
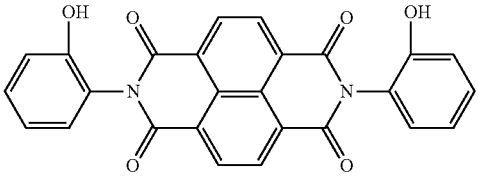
(A1-27)
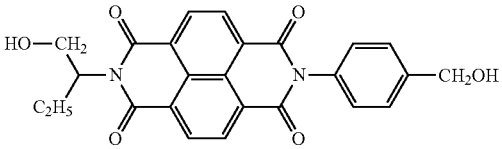
(A1-28)
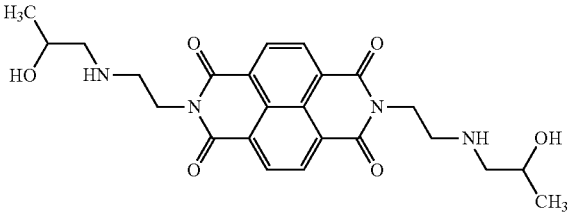

-continued
(A1-29)
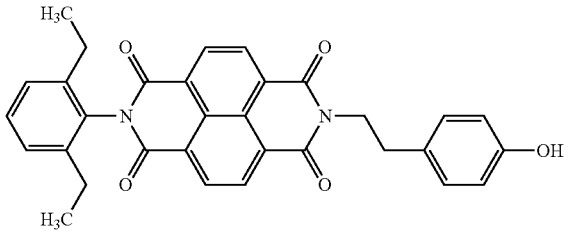
(A1-30)
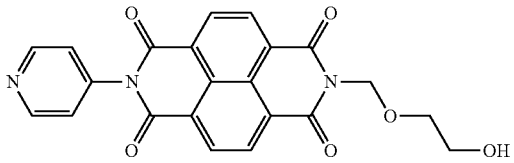
(A1-31)
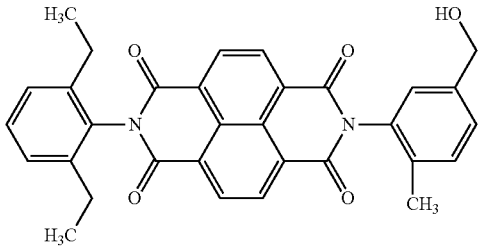
(A1-32)
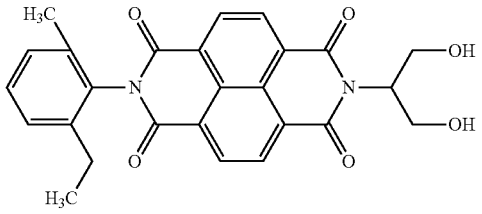
(A1-33)
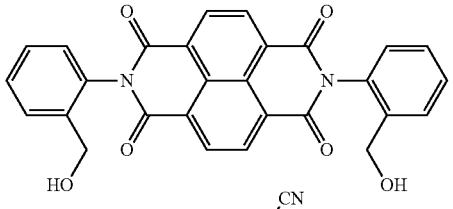
(A1-34)
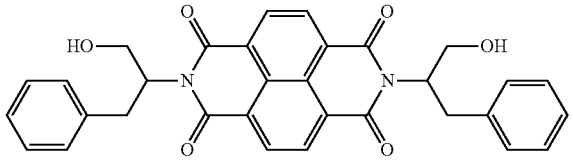
(A1-35)
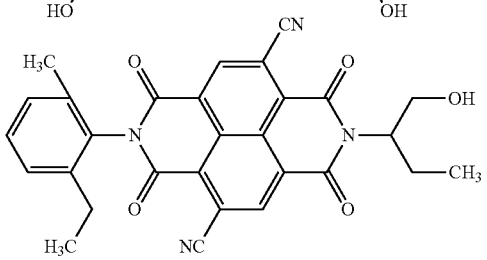
(A1-36)
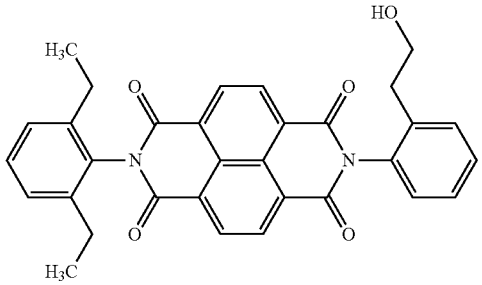
(A1-37)
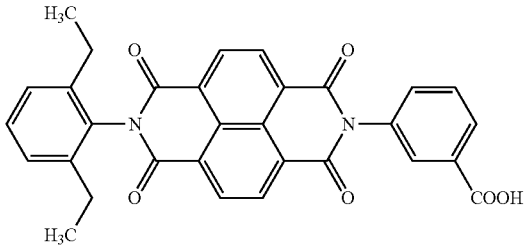
(A1-38)
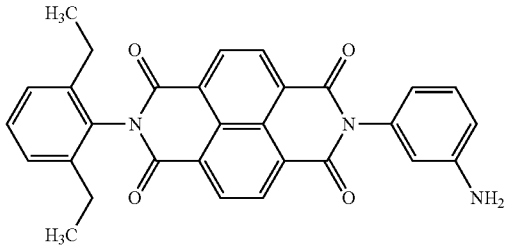
(A1-39)
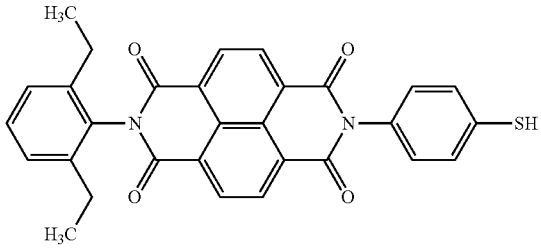
(A1-40)
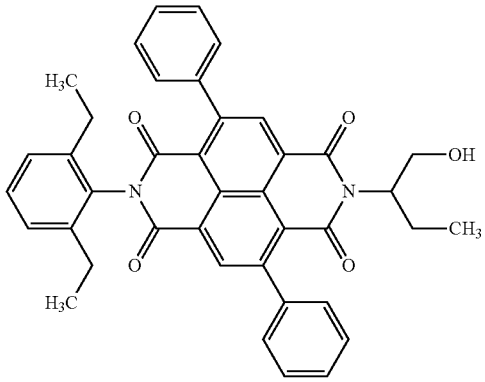

-continued
(A1-41)
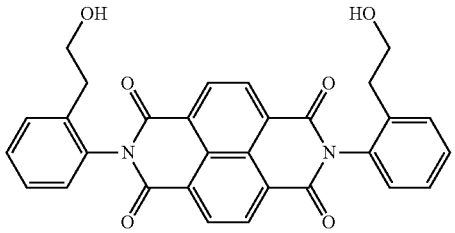
(A1-42)
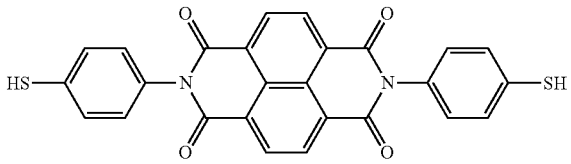
(A1-43)
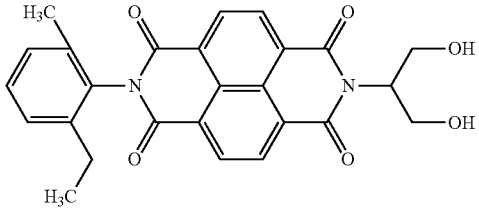
(A1-44)
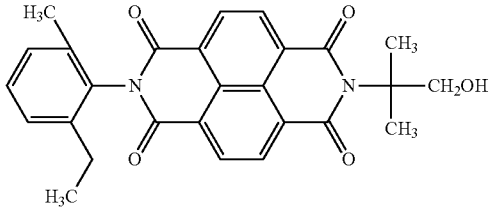
(A1-45)
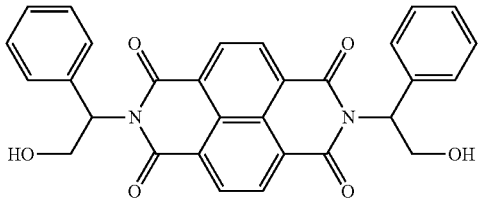
(A1-46)
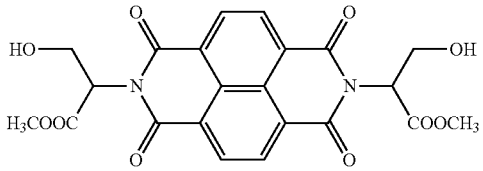
(A1-47)
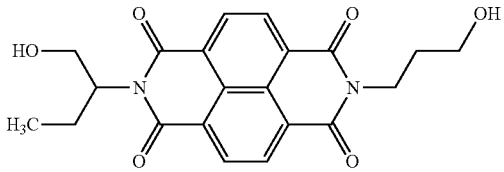
(A1-48)
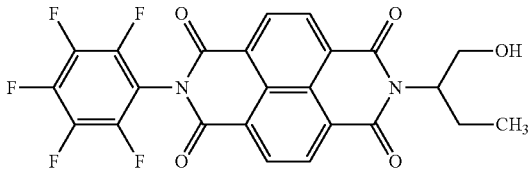
(A1-49)
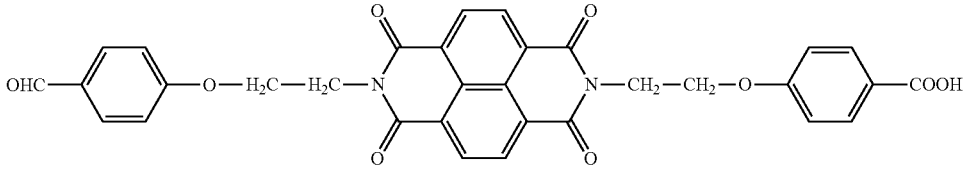
(A1-50)
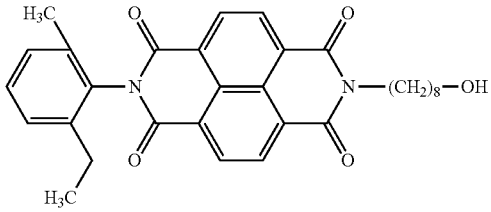
(A1-51)
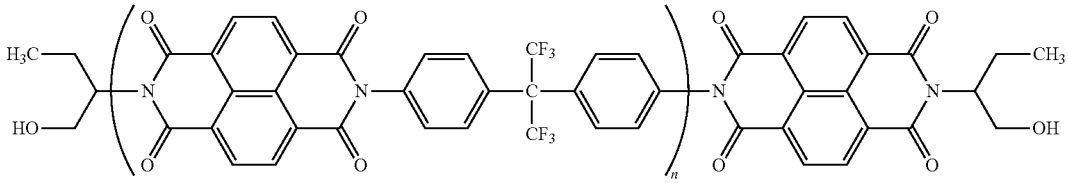

-continued
(A1-52)
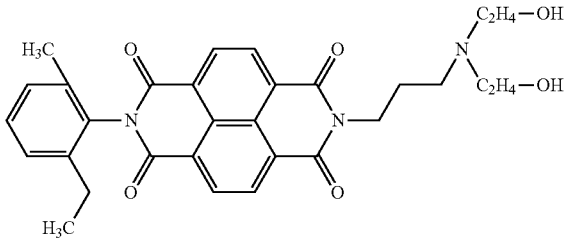
(A1-53)
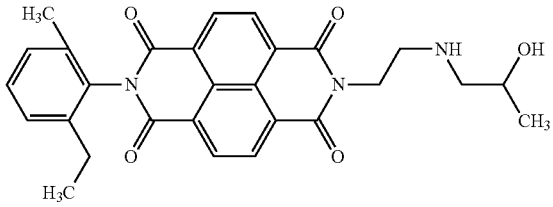
(A1-54)
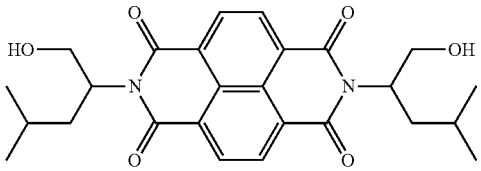
(A1-55)
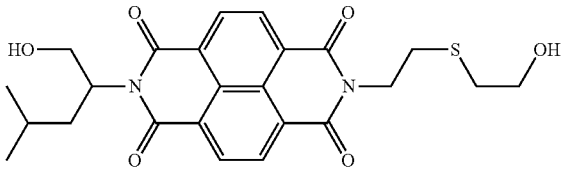
(A1-56)
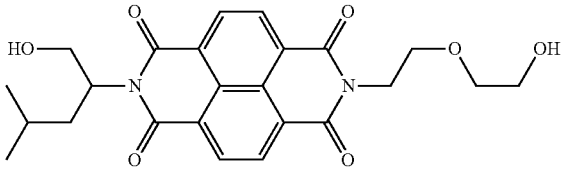
(A1-57)
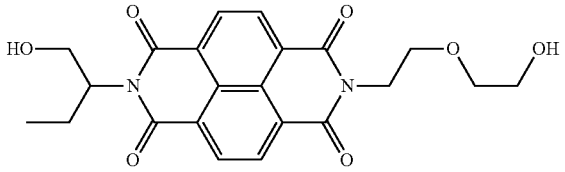
(A1-58)
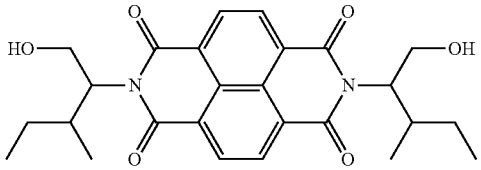
(A1-59)
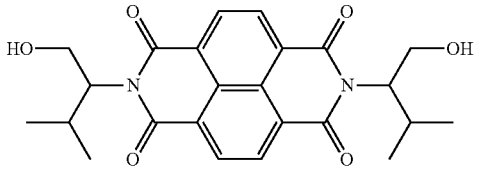
Specific examples of a compound having a structure represented by the formula (A2) are described below.
(A2-1)
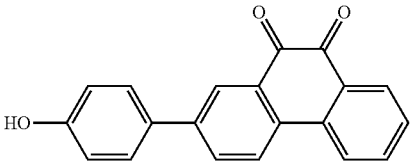
(A2-2)
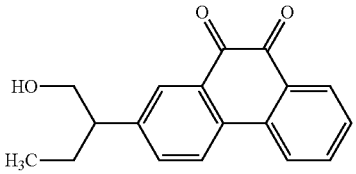
(A2-3)
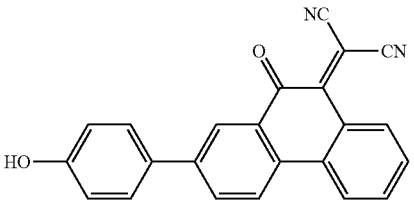
-continued
(A2-4)
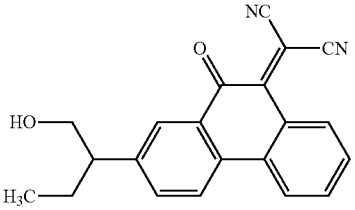
(A2-5)
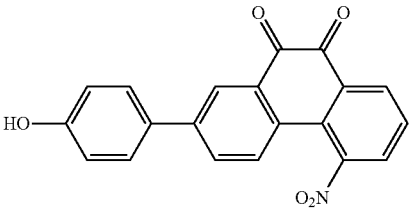
(A2-6)
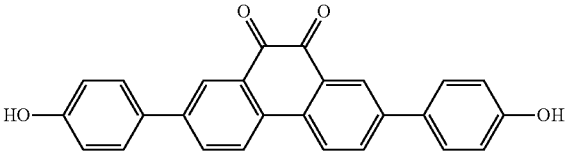

-continued
(A2-7)
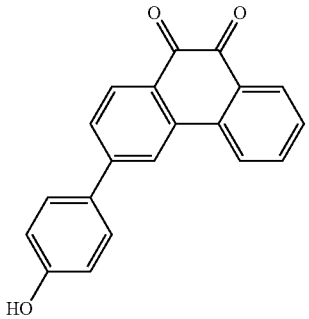
(A2-8)
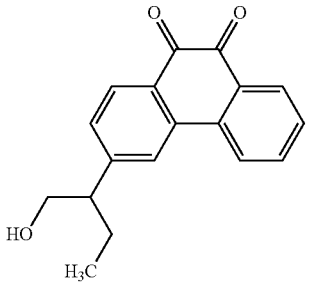
(A2-9)
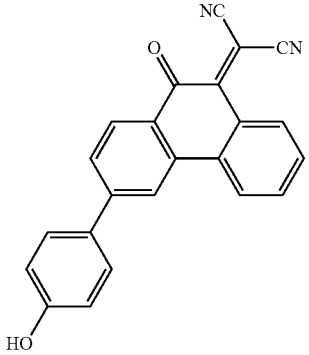
(A2-10)
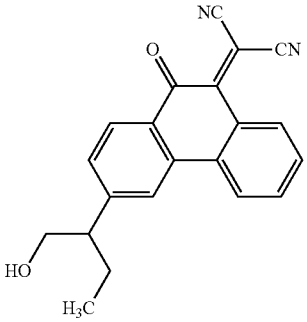
(A2-11)
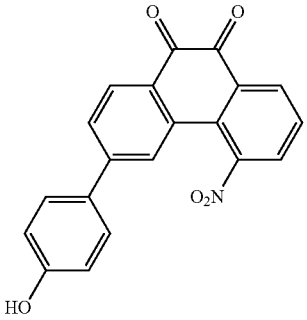
-continued
(A2-12)
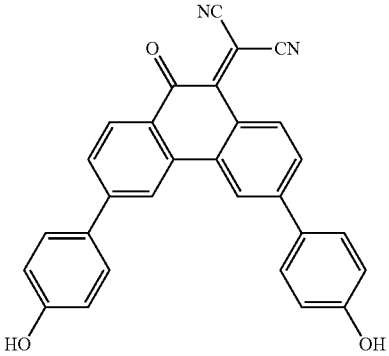
(A2-13)
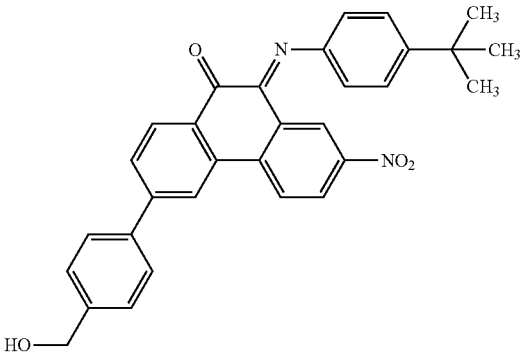
(A2-14)
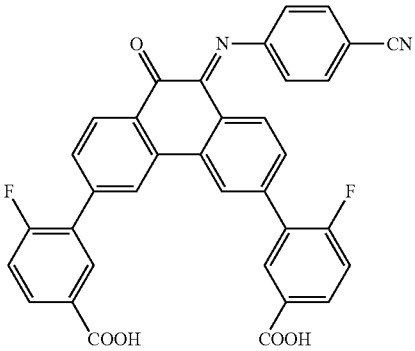
(A2-15)
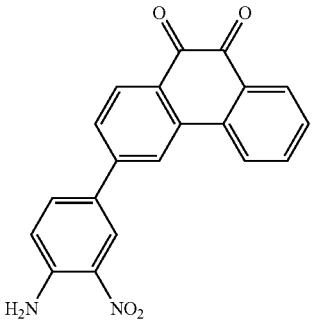

-continued
(A2-16)
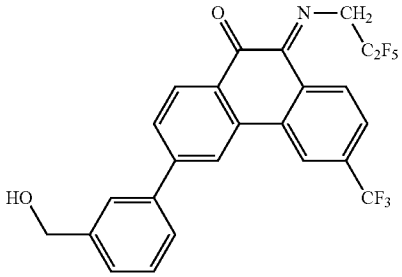
(A2-17)
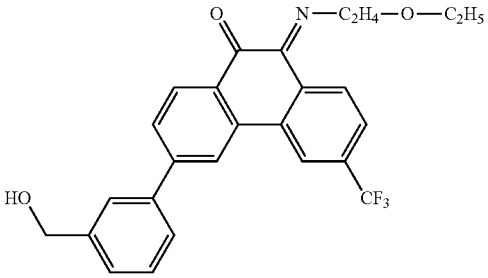
(A2-18)
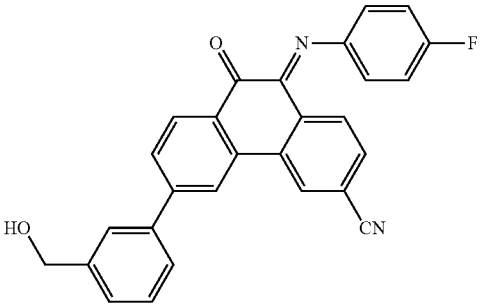
(A2-19)
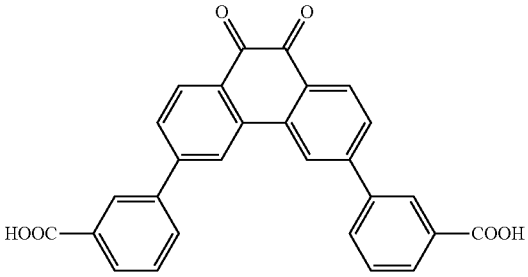
(A2-20)
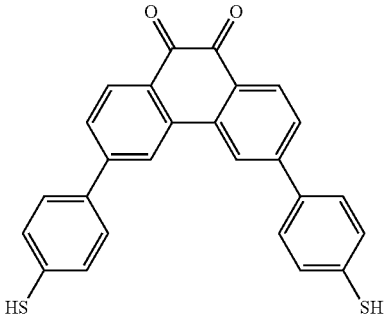
-continued
(A2-21)
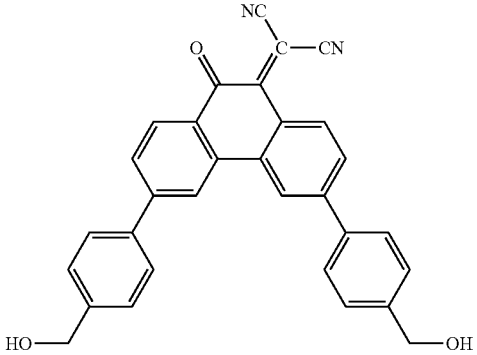
(A2-22)
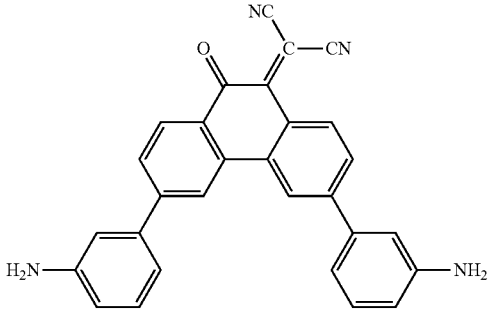
(A2-23)
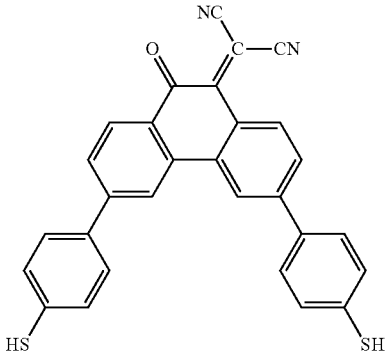
(A2-24)
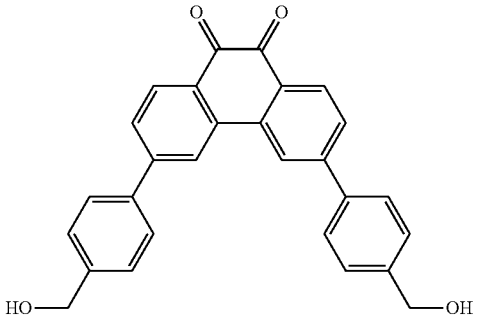
Specific examples of a compound having a structure represented by the formula (A3) are described below.

(A3-1)
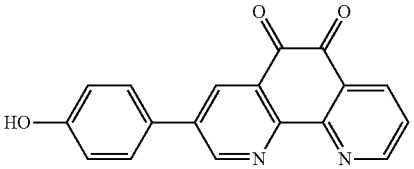
(A3-2)
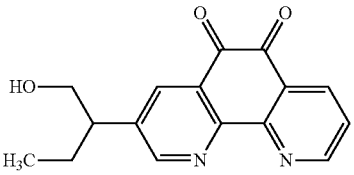
(A3-3)
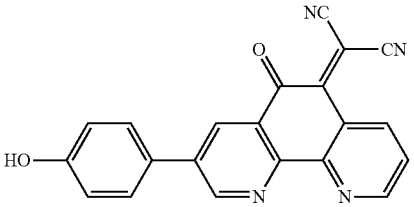
(A3-4)
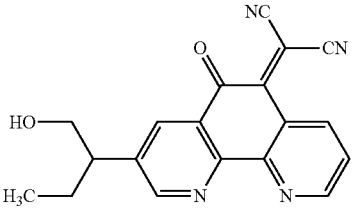
(A3-5)
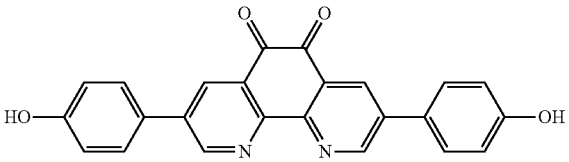
(A3-6)
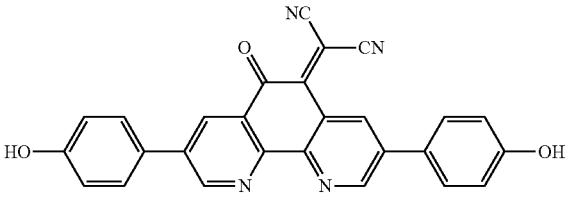
(A3-7)
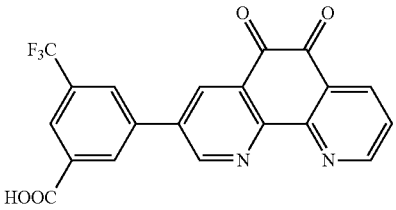
(A3-8)
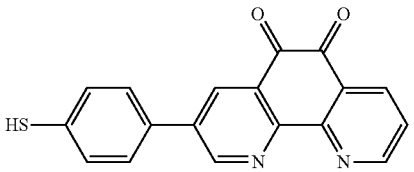
-continued
(A3-9)
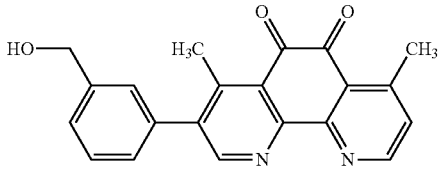
(A3-10)
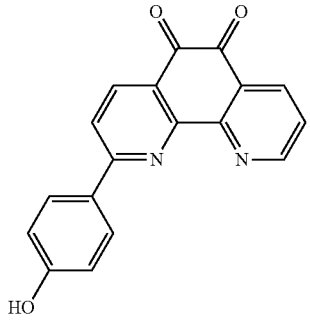
(A3-11)
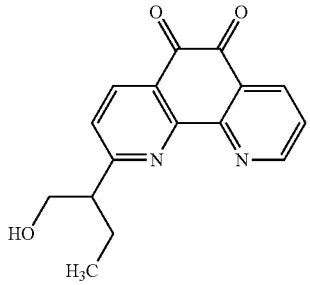
(A3-12)
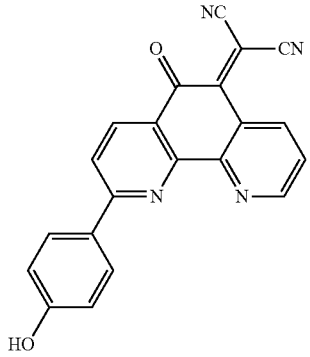
(A3-13)
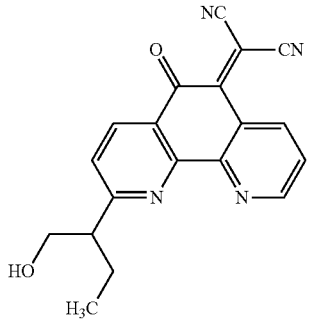

-continued
(A3-14)
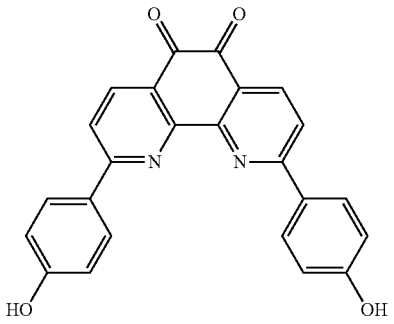
(A3-15)
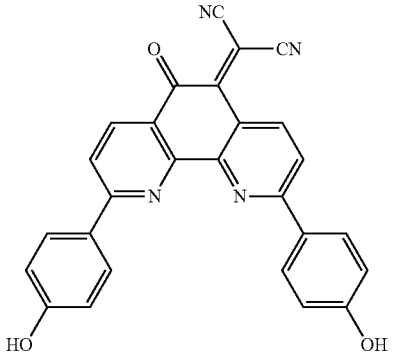
(A3-16)
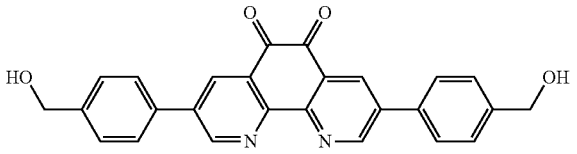
(A3-17)
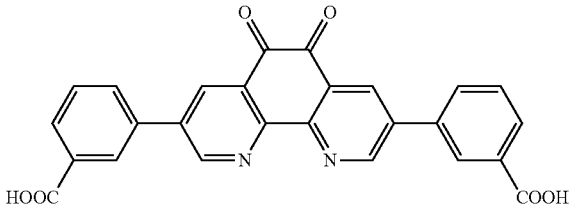
(A3-18)
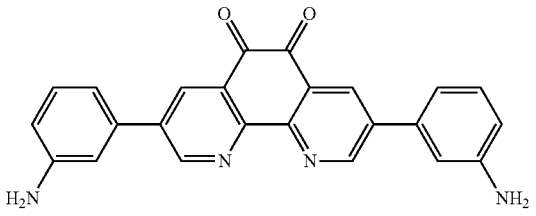
Specific examples of a compound having a structure represented by the formula (A4) are described below.
(A4-1)
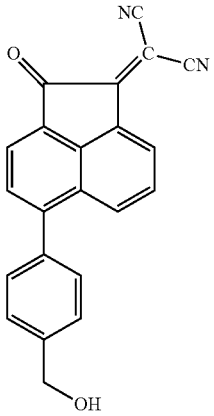
(A4-2)
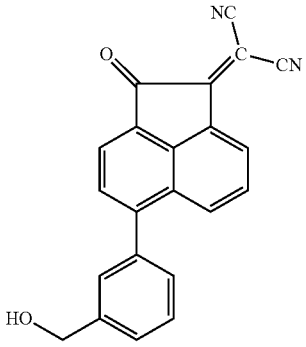
(A4-3)
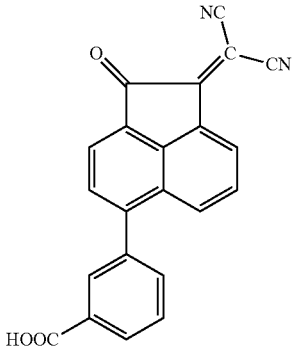
(A4-4)
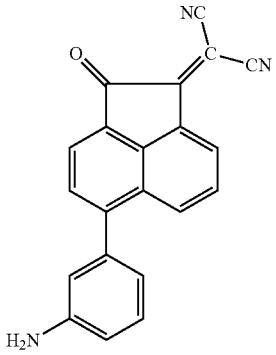

(A4-5)
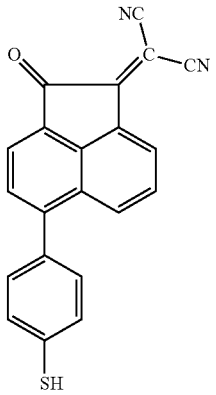
(A4-6)
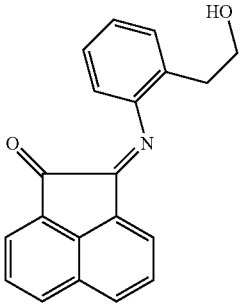
(A4-7)
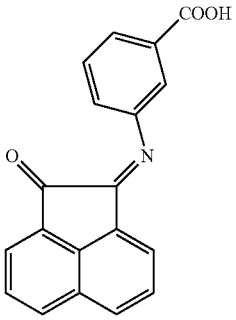
(A4-8)
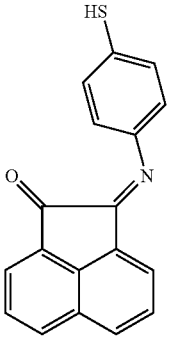
(A4-9)
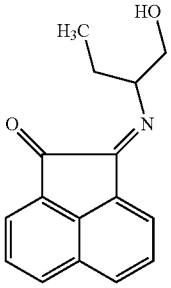
(A4-10)
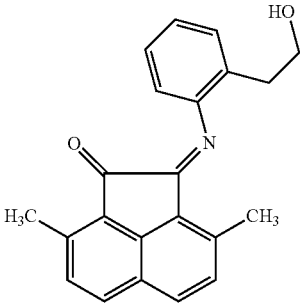
(A4-11)
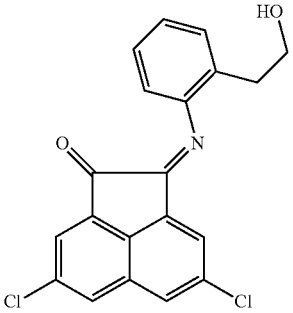
(A4-12)
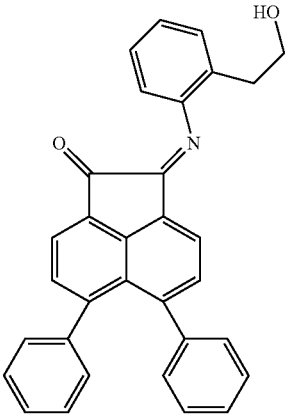

-continued
(A4-13)
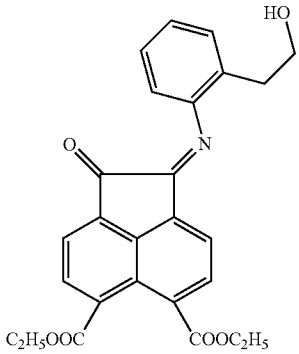
(A4-14)
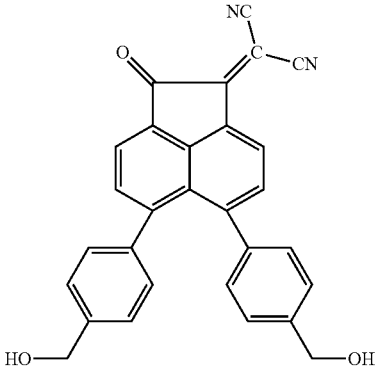
(A4-15)
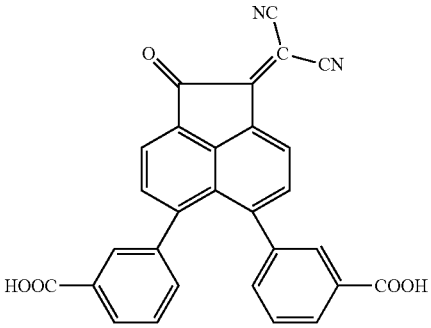
(A4-16)
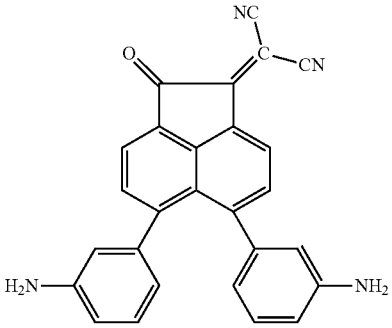
-continued
(A4-17)
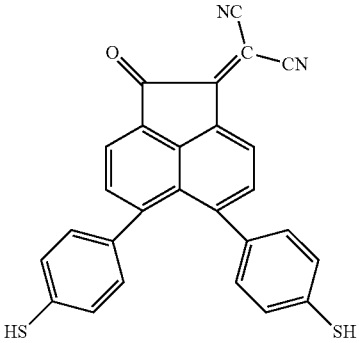
(A4-18)
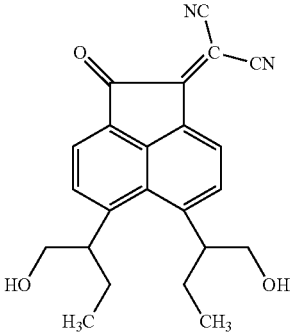
(A4-19)
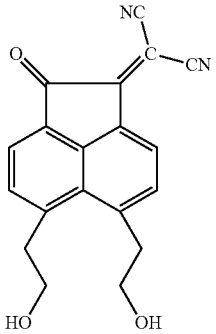
(A4-20)
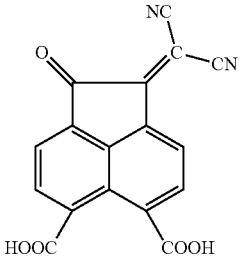
(A4-21)
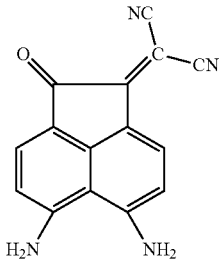

-continued
(A4-22)
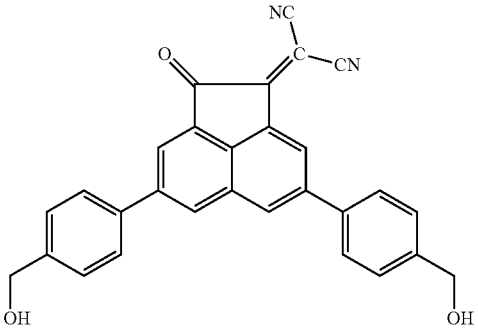
(A4-23)
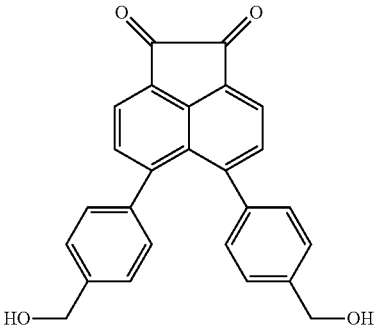
(A4-24)
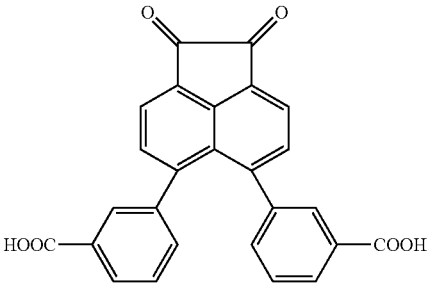
(A4-25)
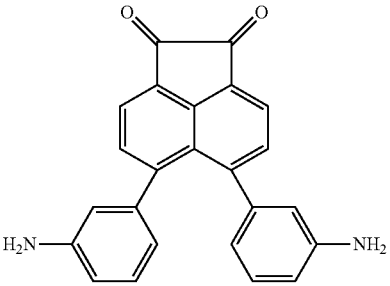
(A4-26)
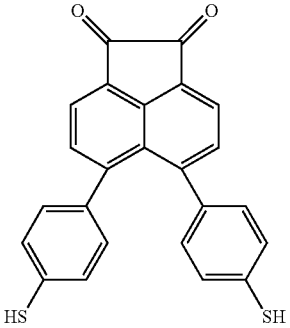
-continued
(A4-27)
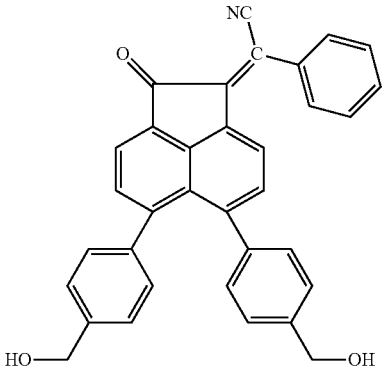
(A4-28)
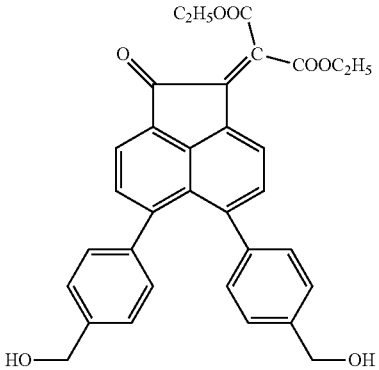
(A4-29)
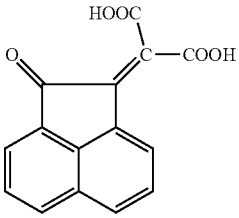
(A4-30)
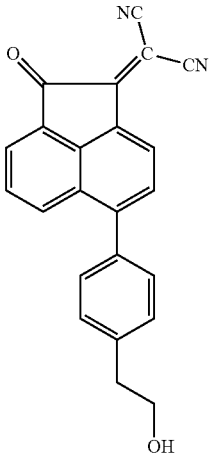

-continued
(A4-31)
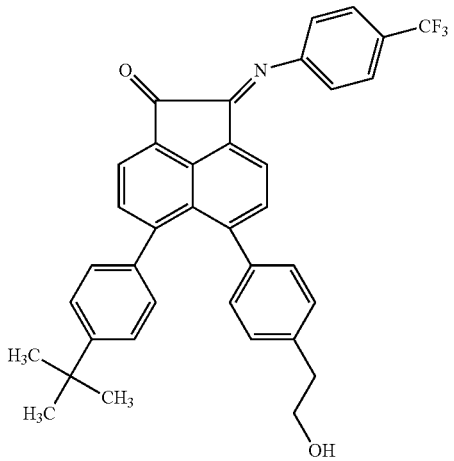
(A4-32)
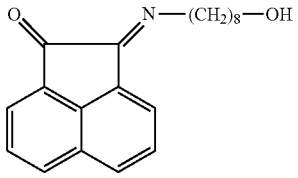
Specific examples of a compound having a structure represented by the formula (A5) are described below.
(A5-1)
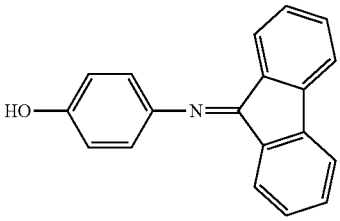
(A5-2)
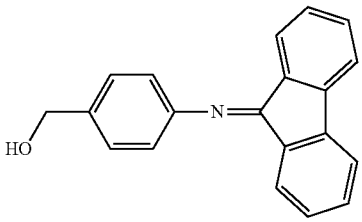
(A5-3)
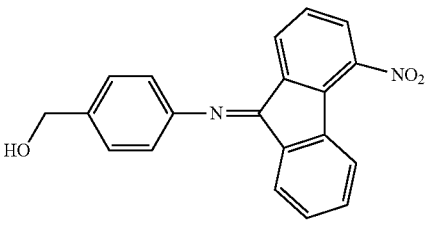
-continued
(A5-4)
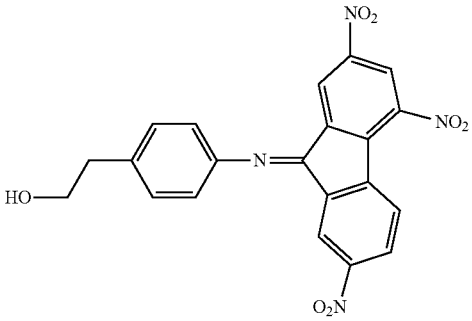
(A5-5)
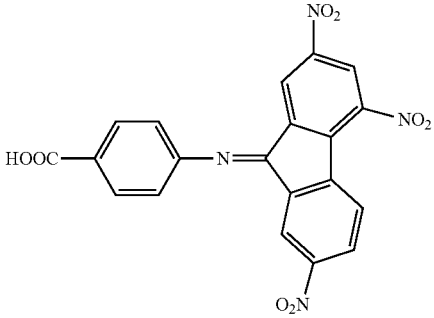
(A5-6)
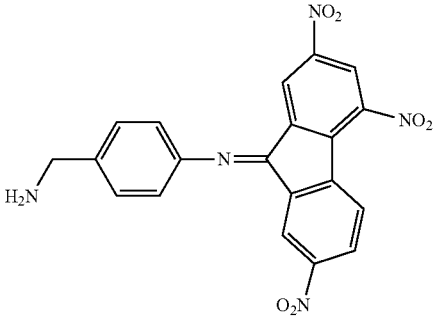
(A5-7)
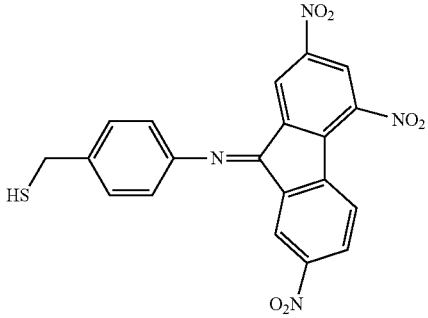
(A5-8)
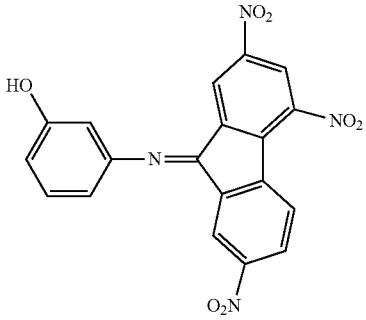

-continued
(A5-9)
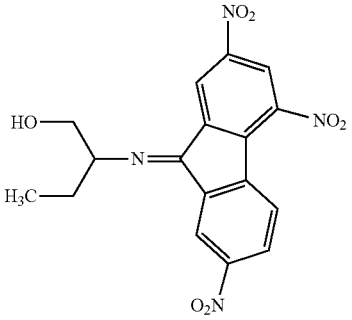
(A5-10)
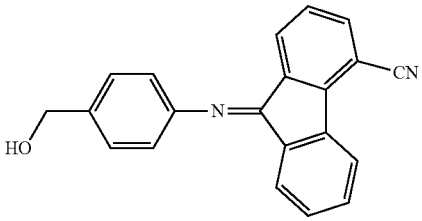
(A5-11)
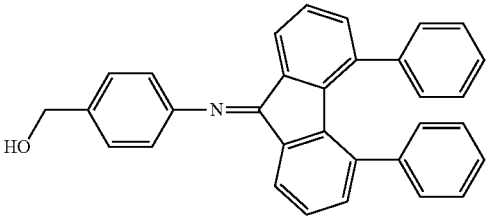
(A5-12)
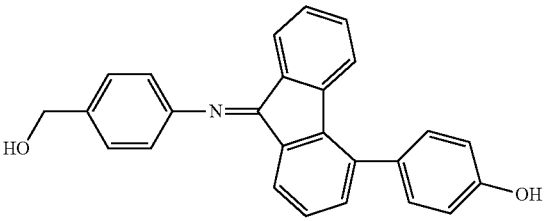
(A5-13)
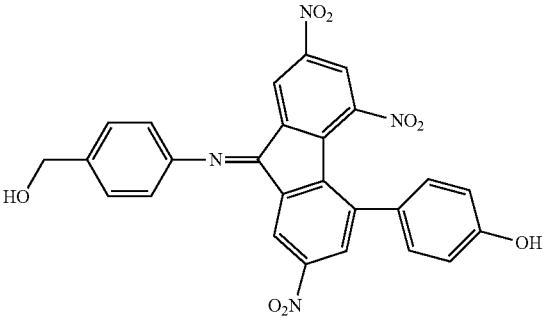
-continued
(A5-14)
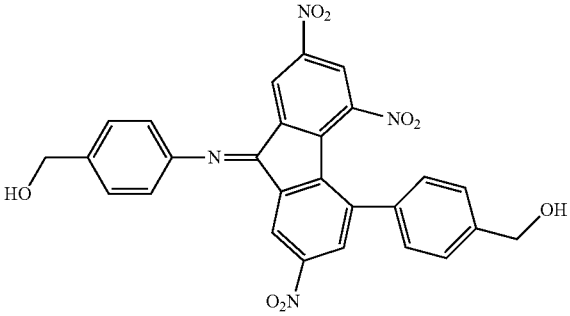
(A5-15)
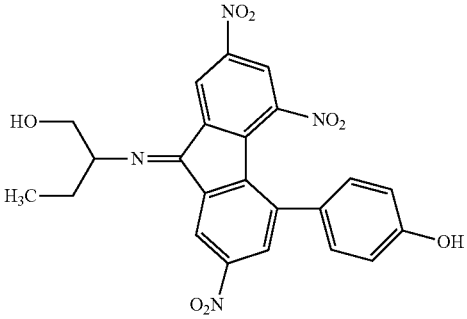
(A5-16)
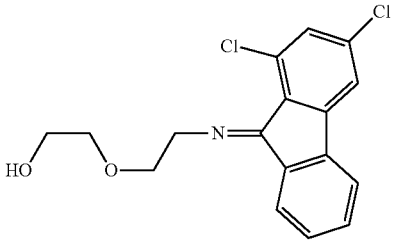
(A5-17)
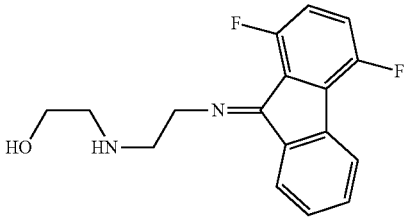
(A5-18)
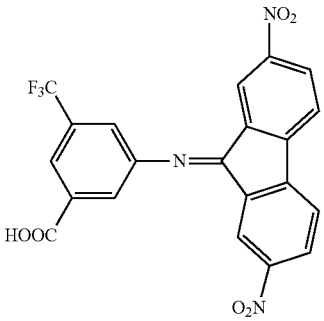

-continued
(A5-17)
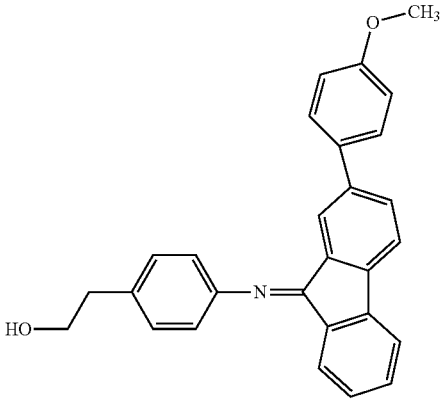
(A5-18)
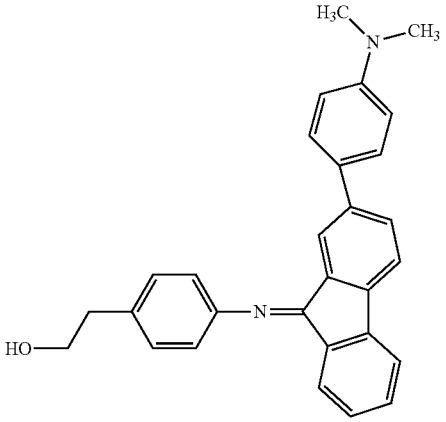
(A5-19)
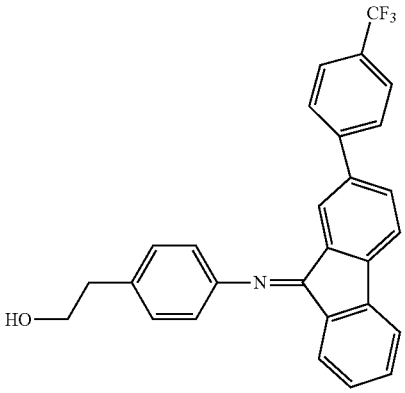
(A5-20)
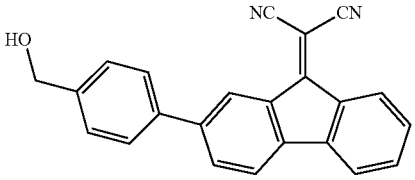
-continued
(A5-21)
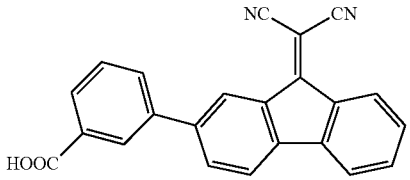
(A5-22)
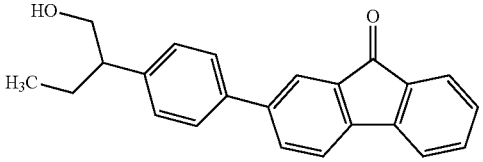
(A5-23)
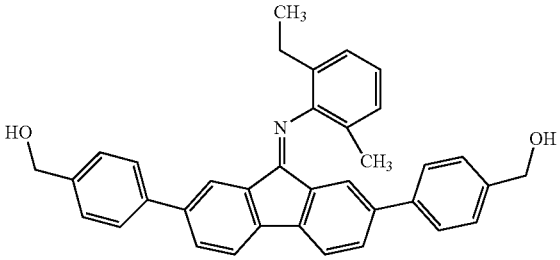
(A5-24)
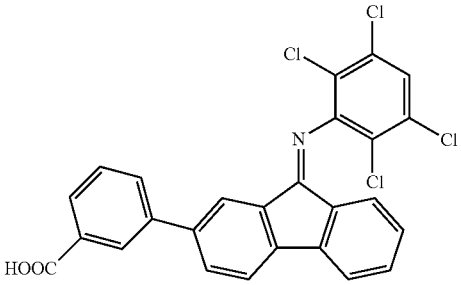
(A5-25)
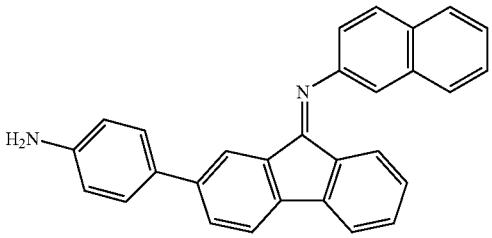
(A5-27)
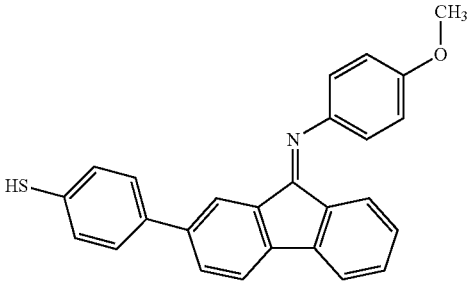

-continued
(A5-28)
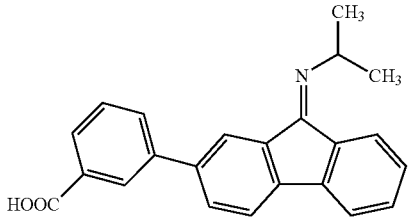
(A5-29)
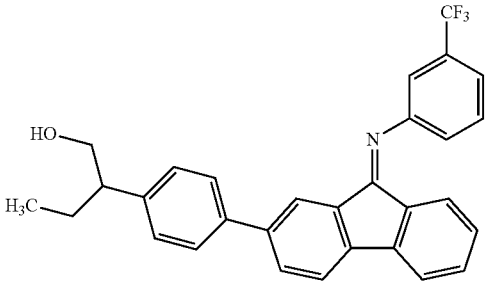
(A5-30)
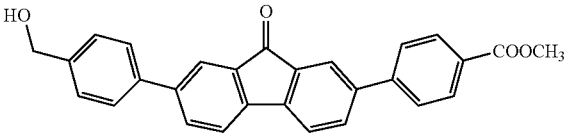
(A5-31)
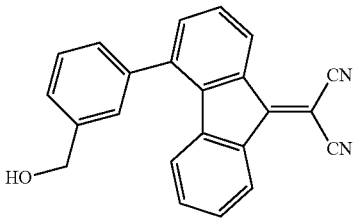
(A5-32)
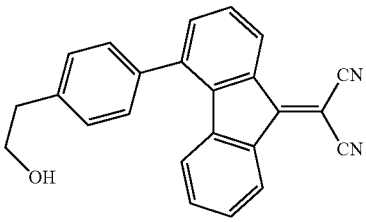
(A5-33)
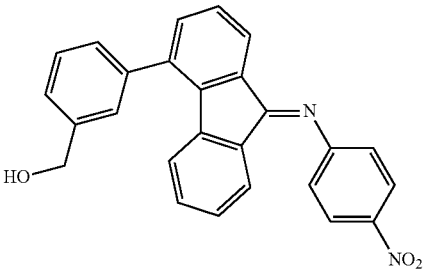
-continued
(A5-34)
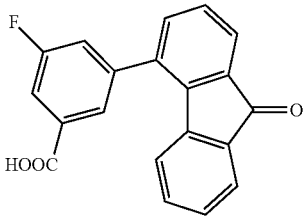
(A5-35)
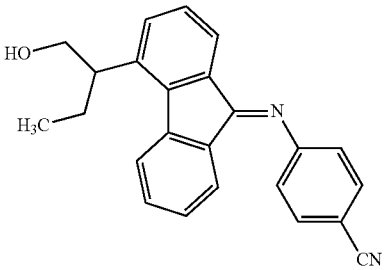
(A5-36)
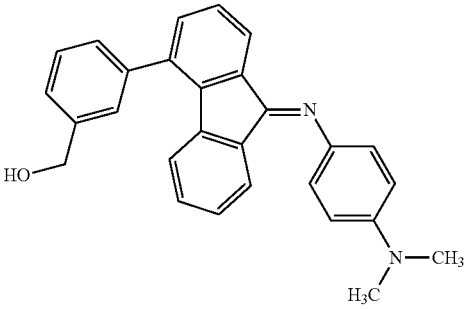
(A5-37)
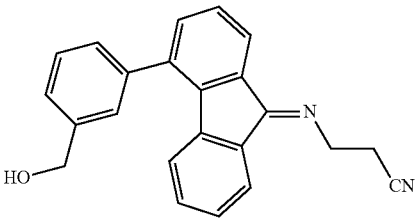
(A5-38)
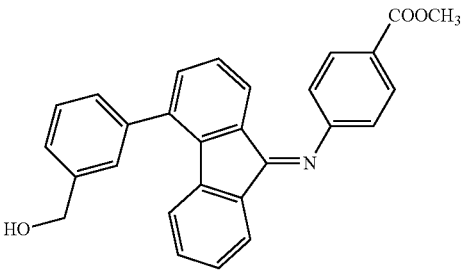

-continued
(A5-39)
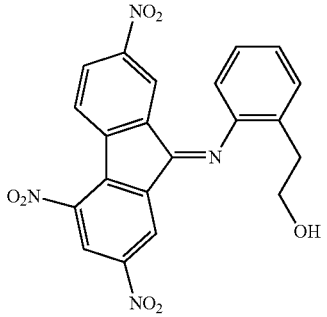
(A5-40)
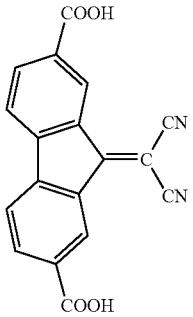
(A5-41)
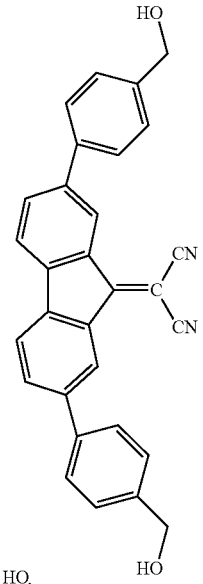
(A5-42)
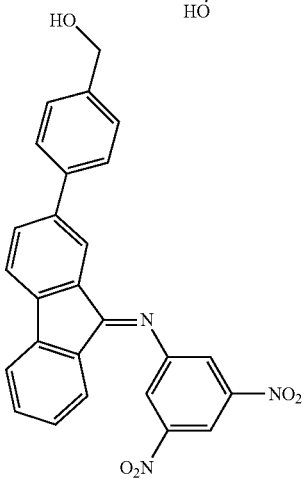
-continued
(A5-43)
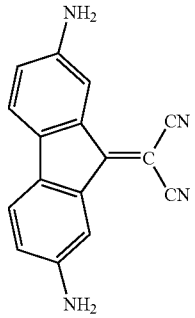
(A5-44)
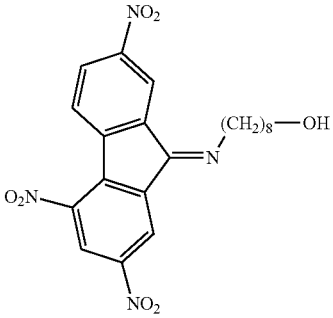
Specific examples of a compound having a structure represented by the formula (A6) are described below.
(A6-1)
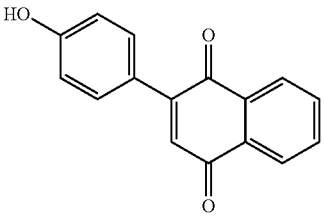
(A6-2)
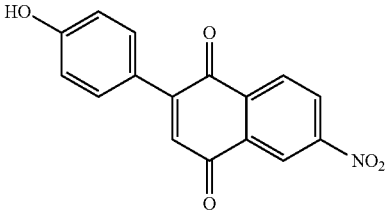
(A6-3)
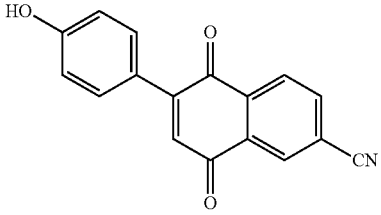

-continued
(A6-4)
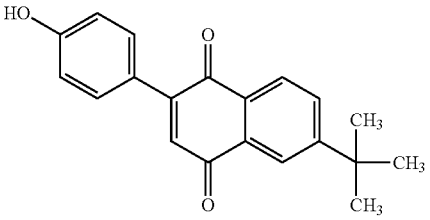
(A6-5)
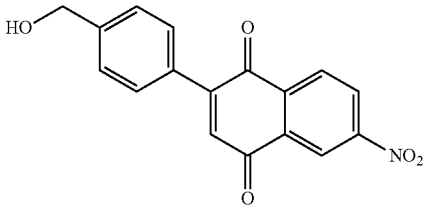
(A6-6)
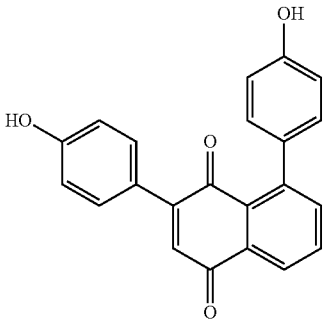
(A6-7)
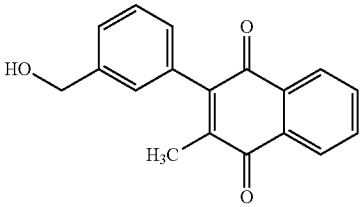
(A6-8)
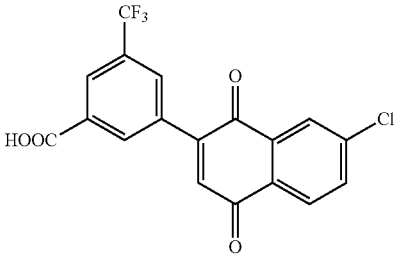
(A6-9)
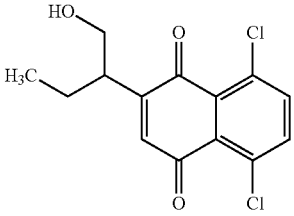
-continued
(A6-10)
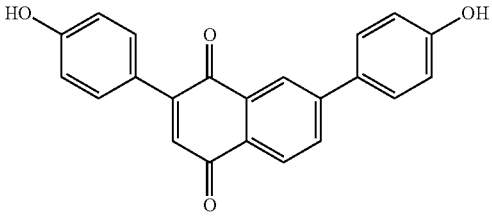
(A6-11)
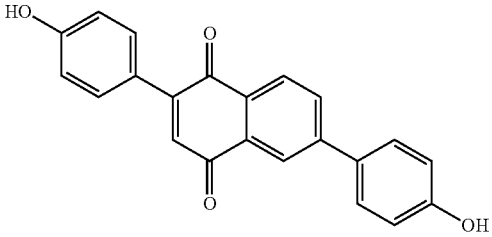
(A6-12)
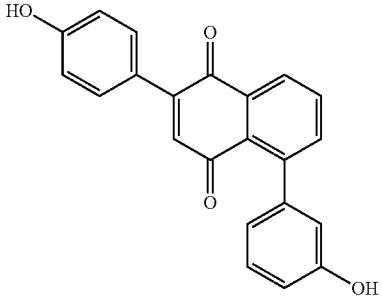
(A6-13)
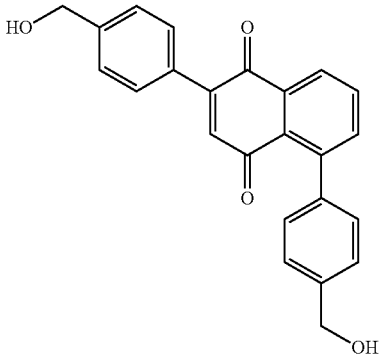
(A6-14)
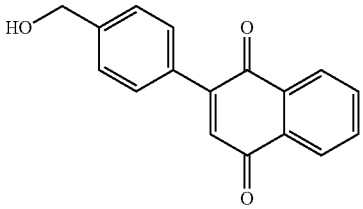
(A6-15)
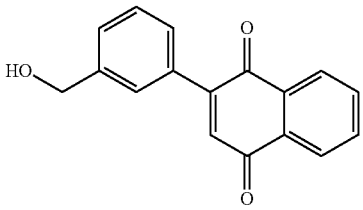

-continued
(A6-16)
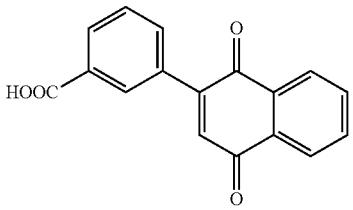
(A6-17)
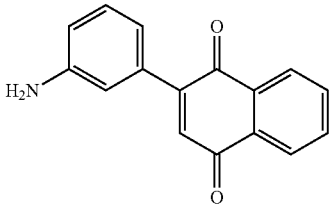
Specific examples of a compound having a structure represented by the formula (A7) are described below.
(A7-1)
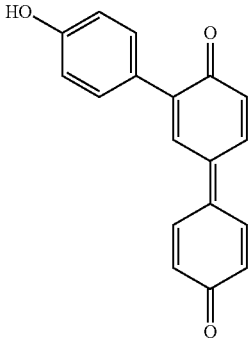
(A7-2)
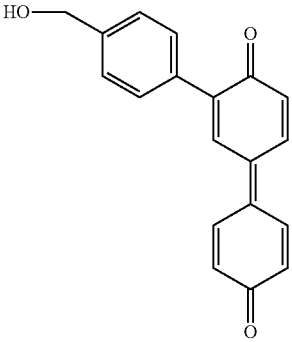
(A7-3)
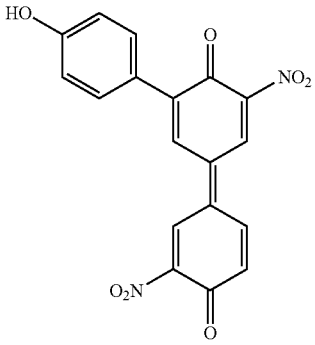
-continued
(A7-4)
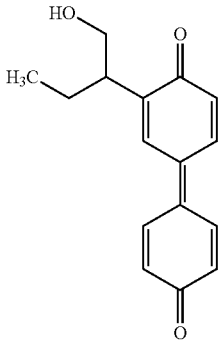
(A7-5)
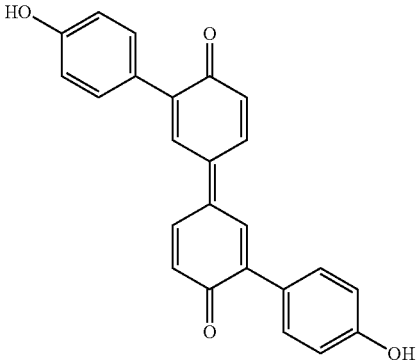
(A7-6)
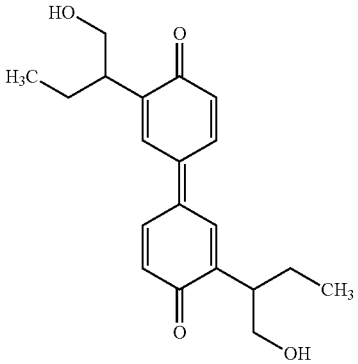
(A7-7)
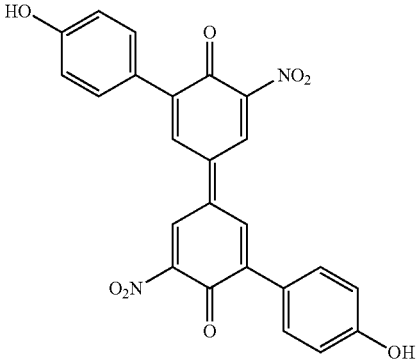

-continued
(A7-8)
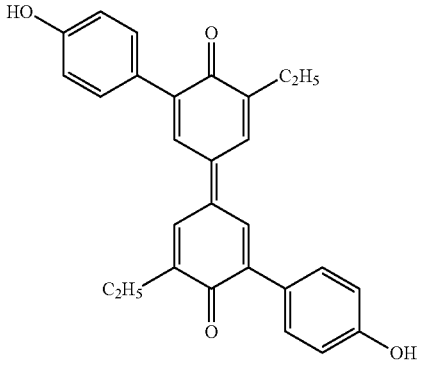
(A7-9)
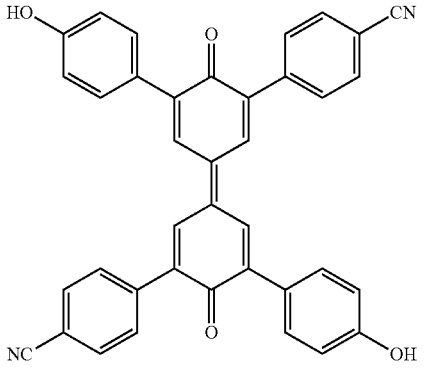
(A7-10)
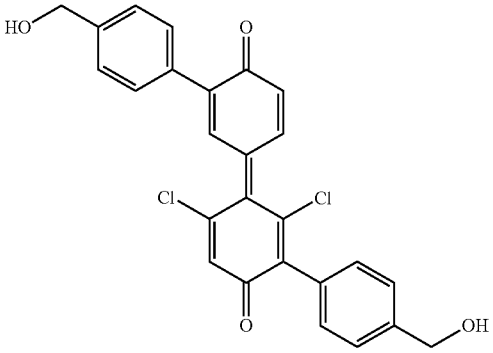
(A7-11)
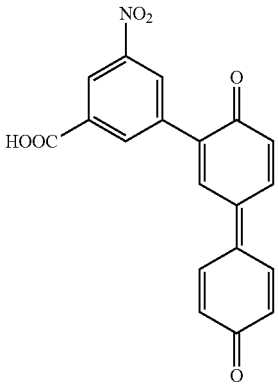
-continued
(A7-12)
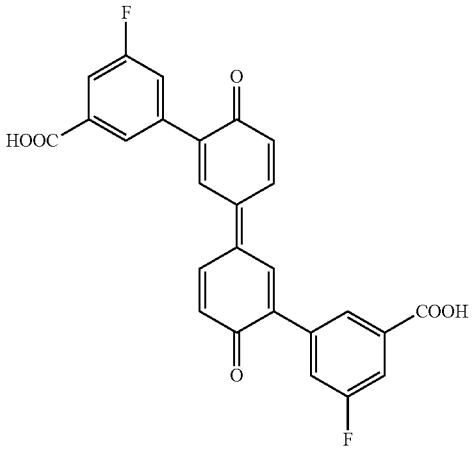
(A7-13)
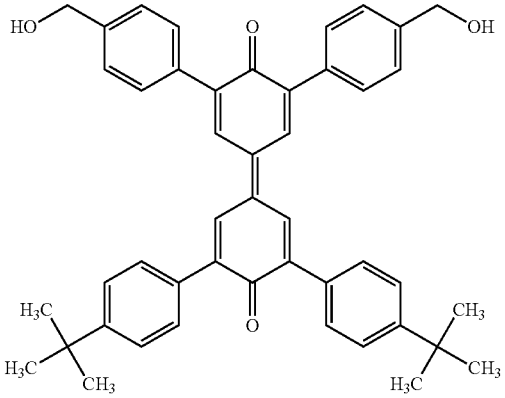
(A7-14)
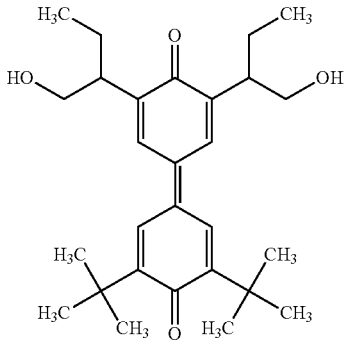
(A7-15)
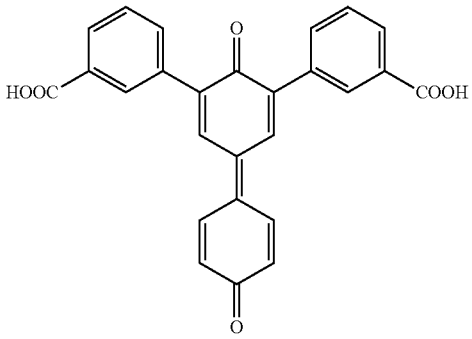

-continued
(A7-16)
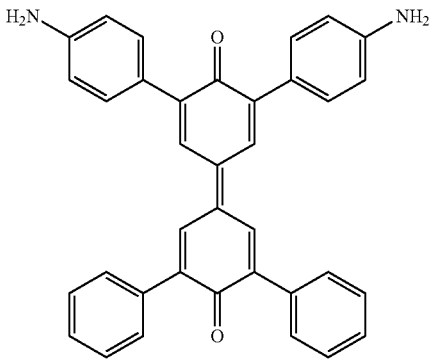
(A7-17)
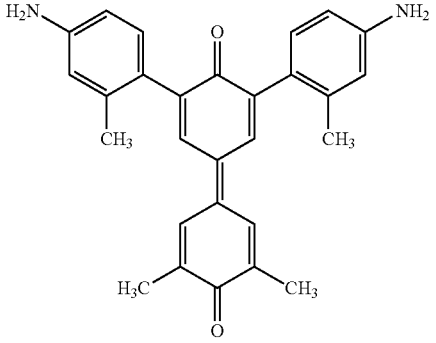
(A7-18)
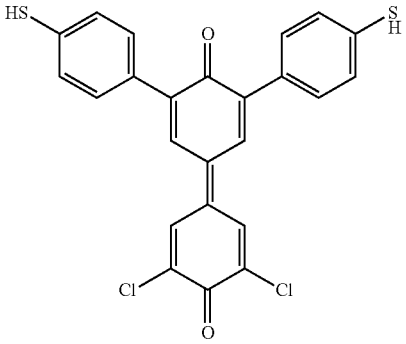
(A7-19)
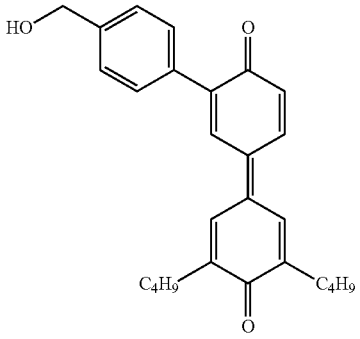
-continued
(A7-20)
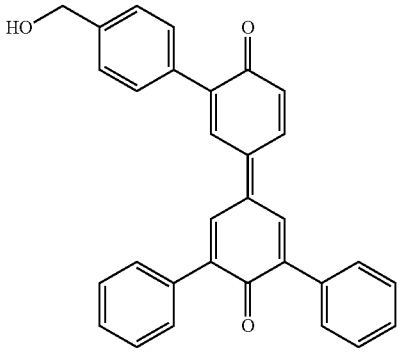
(A7-21)
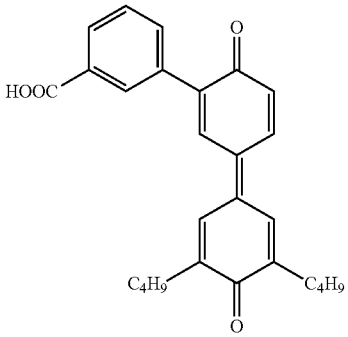
(A7-22)
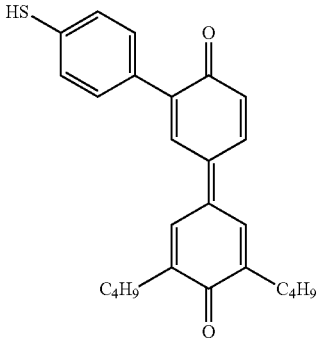
(A7-23)
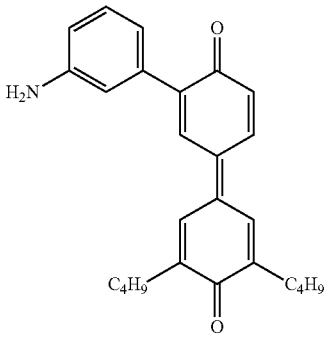
Specific examples of a compound having a structure represented by the formula (A8) are described below.

(A8-1)
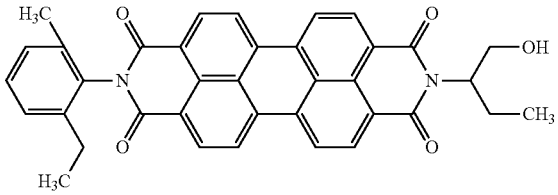
(A8-2)
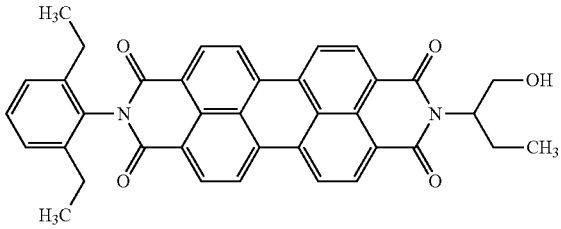
(A8-3)
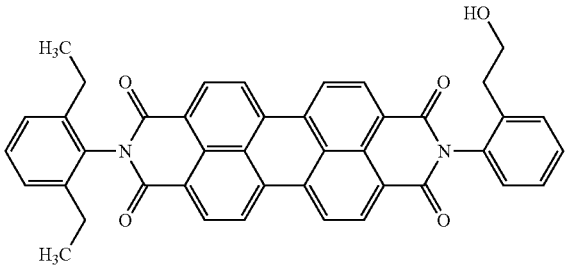
(A8-4)
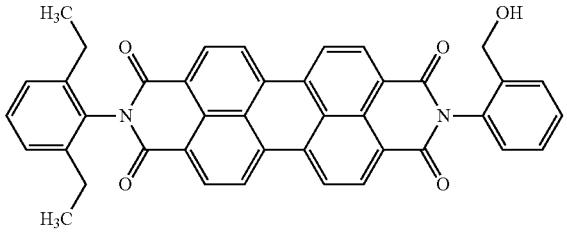
(A8-5)
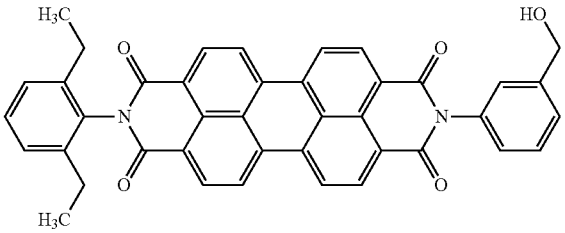
(A8-6)
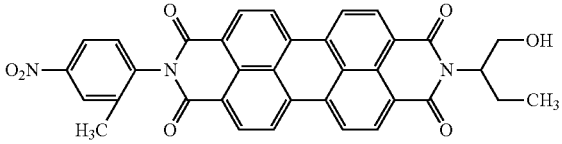
(A8-7)
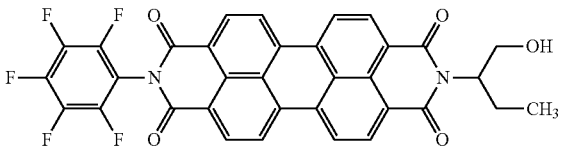
-continued
(A8-8)
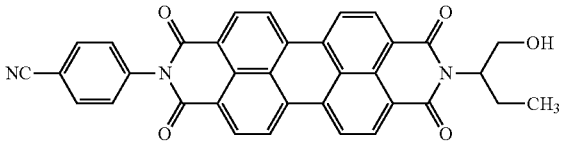
(A8-9)
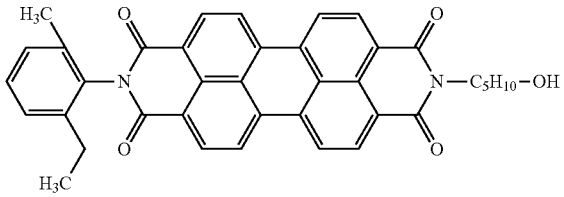
(A8-10)
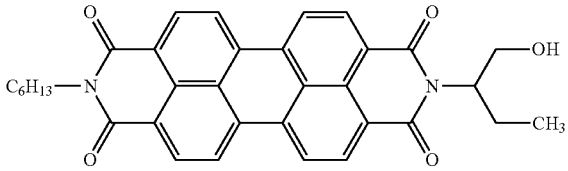
(A8-11)
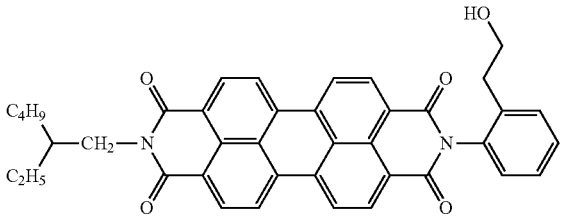
(A8-12)
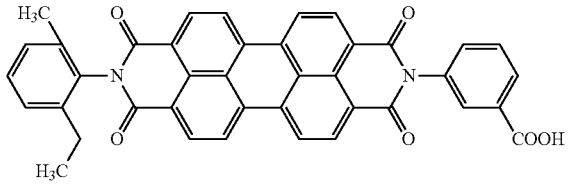
(A8-13)
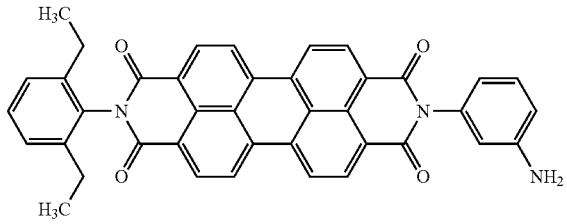
(A8-14)
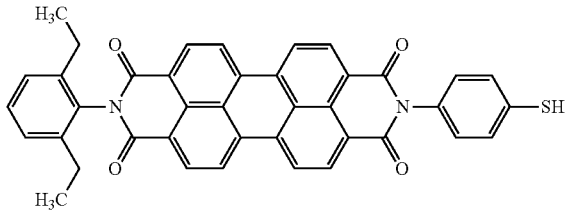

-continued
(A8-15)
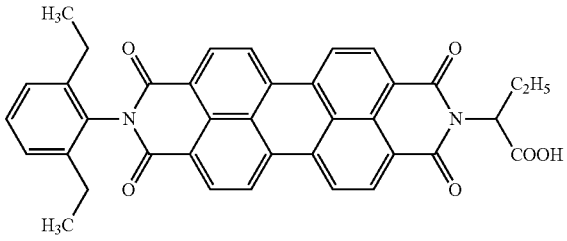
(A8-16)
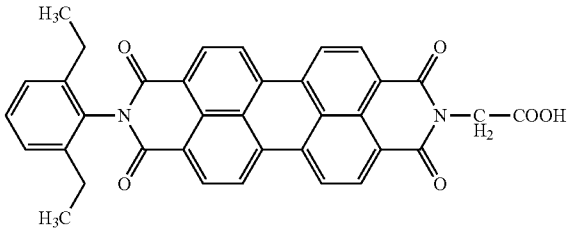
(A8-17)
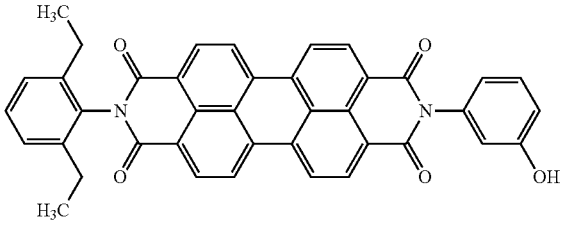
(A8-18)
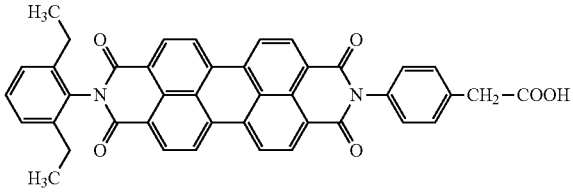
(A8-19)
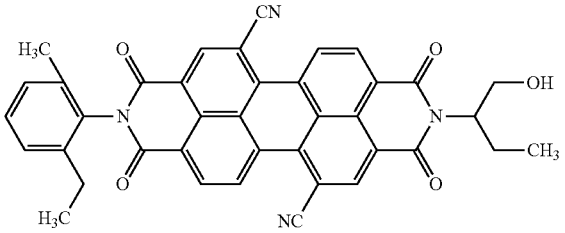
(A8-20)
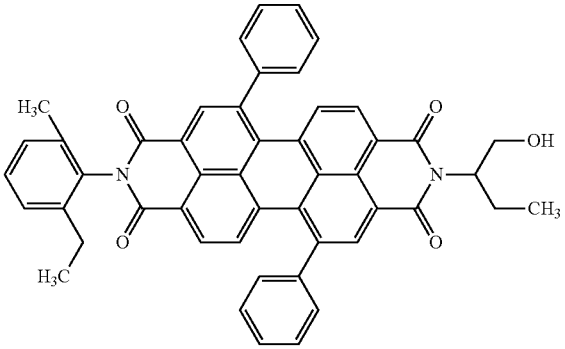
-continued
(A8-21)
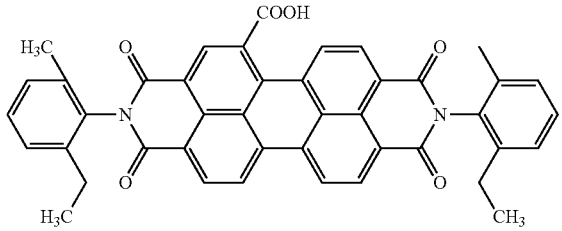
(A8-22)
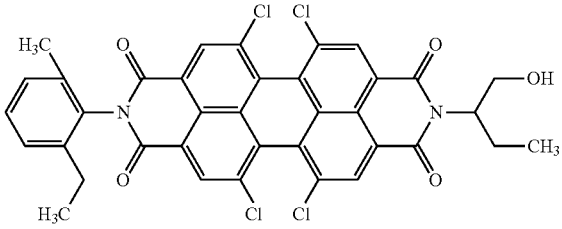
(A8-23)
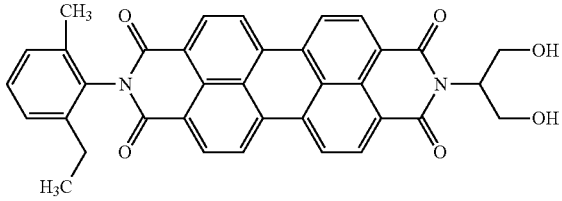
(A8-24)
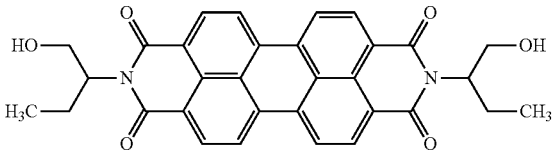
(A8-25)
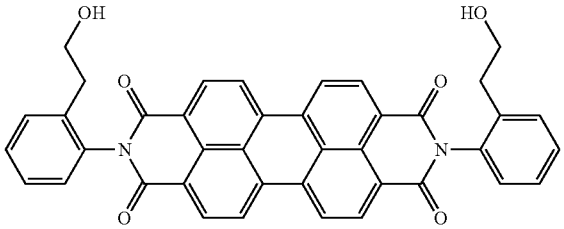
(A8-26)
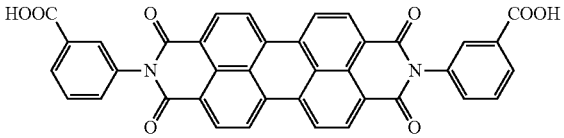
(A8-27)
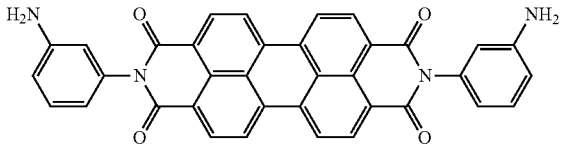

-continued
(A8-28)
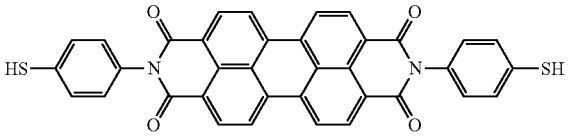
(A8-29)
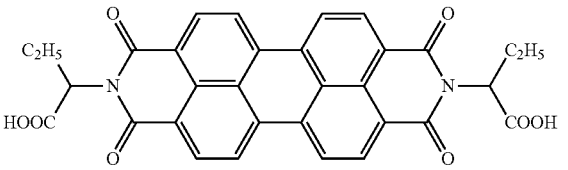
(A8-30)
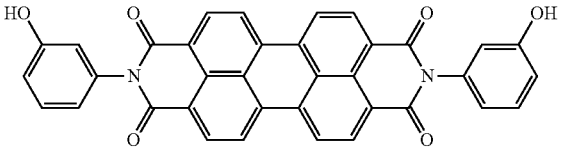
(A8-31)
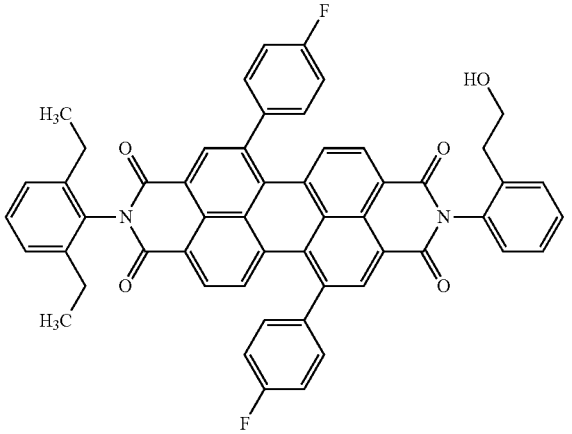
(A8-32)
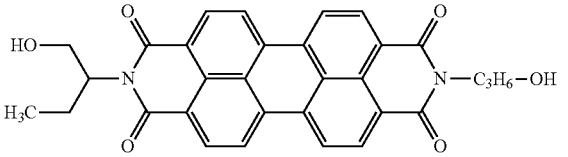
(A8-33)
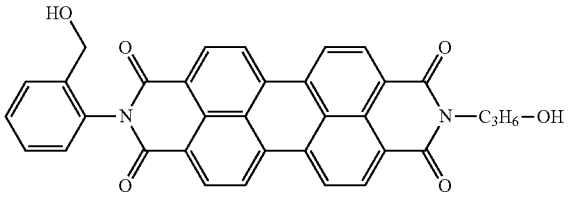
(A8-34)
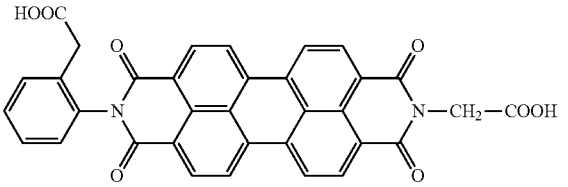
-continued
(A8-35)
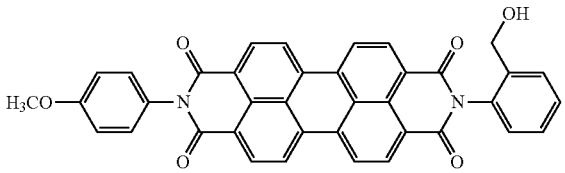
Specific examples of a compound having a structure represented by the formula (A9) are described below.
(A9-1)
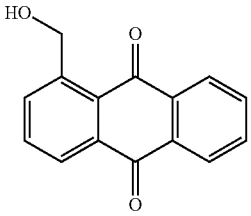
(A9-2)
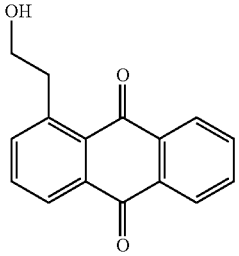
(A9-3)
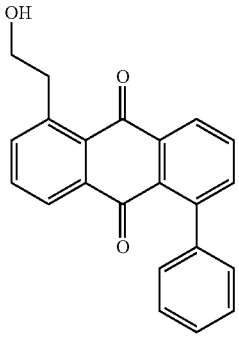
(A9-4)
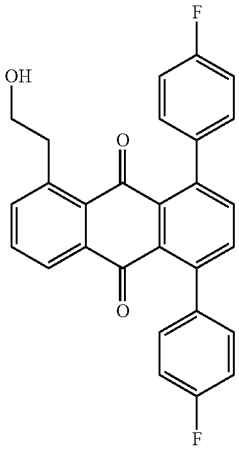

-continued
(A9-5)
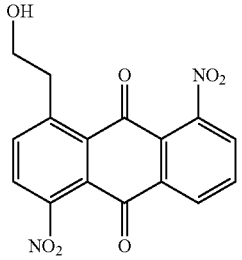
(A9-6)
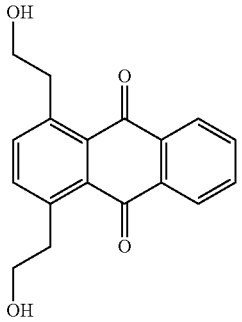
(A9-7)
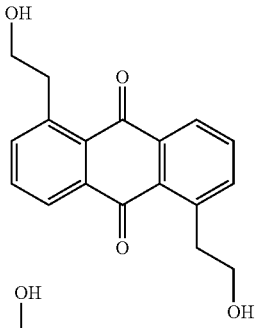
(A9-8)
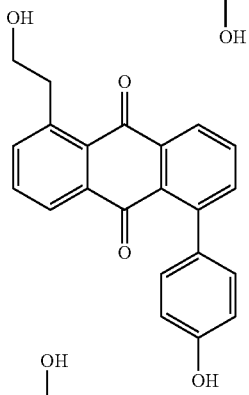
(A9-9)
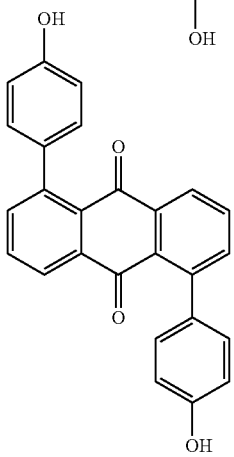
-continued
(A9-10)
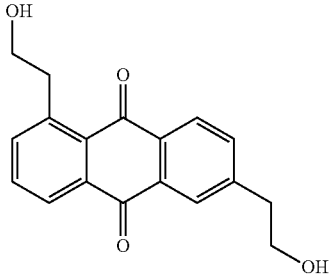
(A9-11)
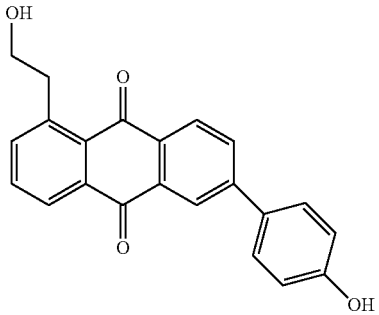
(A9-12)
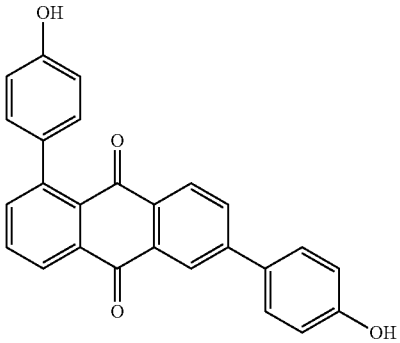
(A9-13)
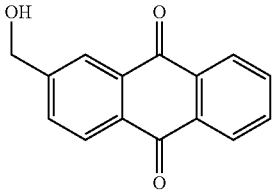
(A9-14)
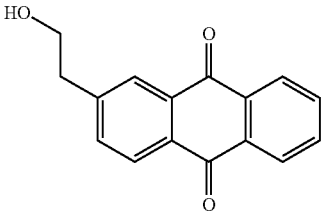
(A9-15)
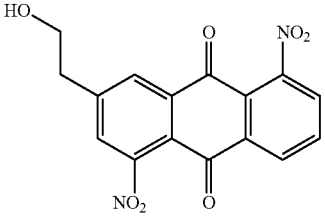

-continued
(A9-16)
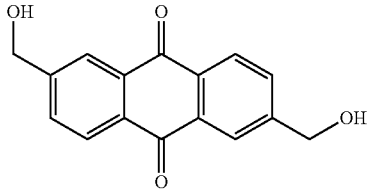
(A9-17)
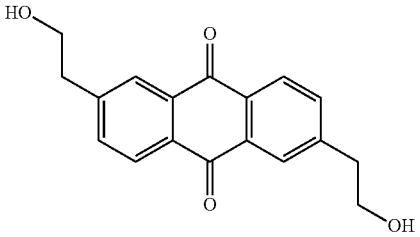
(A9-18)
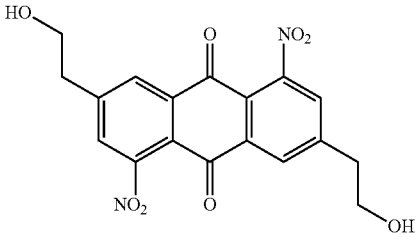
(A9-19)
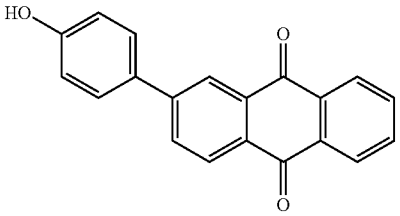
(A9-20)
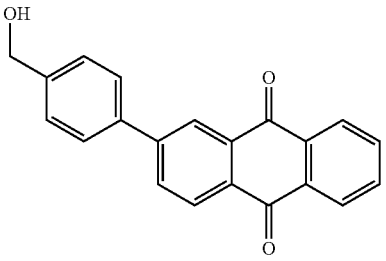
(A9-21)
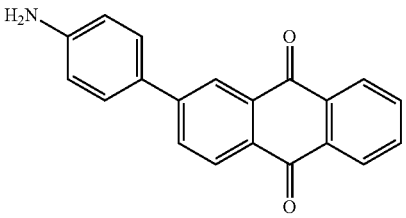
(A9-22)
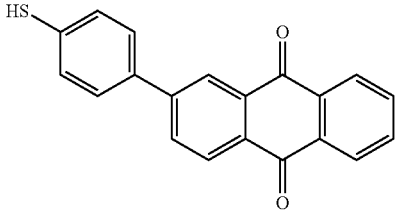
-continued
(A9-23)
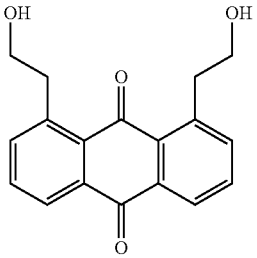
(A9-24)
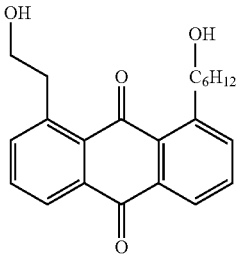
(A9-25)
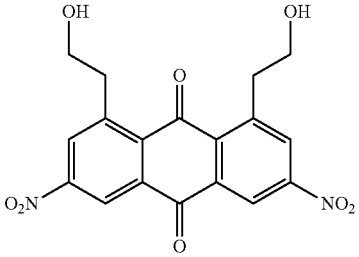
(A9-26)
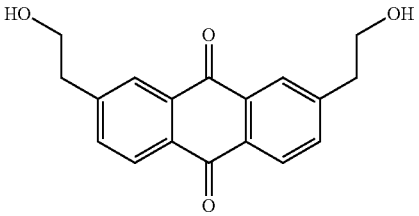
(A9-27)
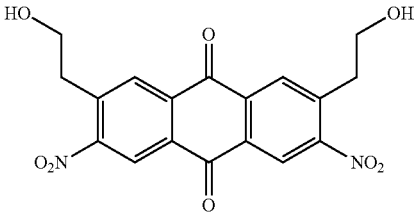
(A9-28)
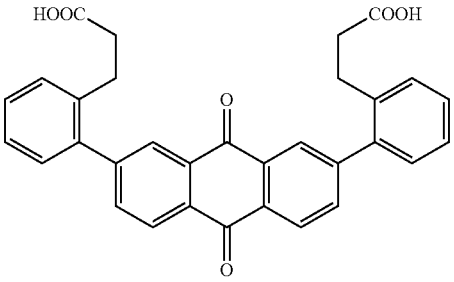

-continued (A9-29)

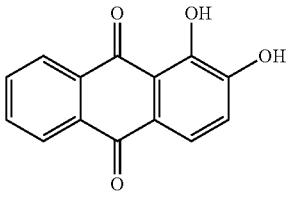

A derivative having a structure represented by (A1) (a derivative of an electron-transporting substance) can be synthesized by known synthetic methods described in, for example, U.S. Pat. Nos. 4,442,193, 4,992,349, and 5,468,583, and Chemistry of materials, Vol. 19, No. 11, pp. 2703-2705 (2007). The derivative can be synthesized by a reaction of naphthalenetetracarboxylic dianhydride and a monoamine derivative, which are available from Tokyo Chemical Industry Co., Ltd., Sigma-Aldrich Japan K.K., or Johnson Matthey Japan Inc.

A compound represented by (A1) contains a polymerizable functional group (a hydroxy group, a thiol group, an amino group, a carboxyl group, or a methoxy group) that can be cured (polymerized) with the melamine compound or the guanamine compound. As a method for introducing the polymerizable functional group into the derivative having a structure represented by (A1), there are a method in which the polymerizable functional group is directly introduced; and a method in which a structure having the polymerizable functional group or a functional group that can be formed into a precursor of a polymerizable functional group is introduced. Examples of the latter method include a method in which a functional group-containing aryl group is introduced into a halogenated compound of a naphthylimide derivative by a cross-coupling reaction using a palladium catalyst and a base; a method in which a functional group-containing alkyl group is introduced by a cross-coupling reaction using a $FeCl_3$ catalyst and a base; and a method in which after lithiation, an epoxy compound or $CO_2$ is allowed to react to introduce a hydroxyalkyl group or a carboxyl group. There is a method in which a naphthalenetetracarboxylic dianhydride derivative or a monoamine derivative containing the polymerizable functional group or a functional group that can be formed into a precursor of the polymerizable functional group is used as a raw material for the synthesis of the naphthylimide derivative.

A derivative having a structure represented by (A2) is available from, for example, Tokyo Chemical Industry Co., Ltd., Sigma-Aldrich Japan K.K., or Johnson Matthey Japan Inc. Alternatively, the derivative can also be synthesized from a phenanthrene derivative or a phenanthroline derivative by a synthetic method described in Chem. Educator No. 6, pp. 227-234 (2001), Journal of Synthetic Organic Chemistry, Japan, Vol. 15, pp. 29-32 (1957), or Journal of Synthetic Organic Chemistry, Japan, Vol. 15, pp. 32-34 (1957). A dicyanomethylene group can also be introduced by reaction with malononitrile.

A compound represented by (A2) contains a polymerizable functional group (a hydroxy group, a thiol group, an amino group, a carboxyl group, or a methoxy group) that can be polymerized with the melamine compound or the guanamine compound. As a method for introducing the polymerizable functional group into the derivative having a structure represented by (A2), there are a method in which the polymerizable functional group is directly introduced; and a method in which a structure having the polymerizable functional group or a functional group to be formed into a precursor of a polymerizable functional group is introduced. Examples of the latter method include a method in which a functional group-containing aryl group is introduced into a halogenated compound of phenanthrenequinone by a cross-coupling reaction using a palladium catalyst and a base; a method in which a functional group-containing alkyl group is introduced by a cross-coupling reaction using a $FeCl_3$ catalyst and a base; and a method in which after lithiation, an epoxy compound or $CO_2$ is allowed to react to introduce a hydroxyalkyl group or a carboxyl group.

A derivative having a structure represented by (A3) is available from, for example, Tokyo Chemical Industry Co., Ltd., Sigma-Aldrich Japan K.K., or Johnson Matthey Japan Inc. Alternatively, the derivative can also be synthesized from a phenanthrene derivative or a phenanthroline derivative by a synthetic method described in Bull. Chem. Soc. Jpn., Vol. 65, pp. 1006-1011 (1992). A dicyanomethylene group can also be introduced by reaction with malononitrile.

A compound represented by (A3) contains a polymerizable functional group (a hydroxy group, a thiol group, an amino group, a carboxyl group, or a methoxy group) that can be polymerized with the melamine compound or the guanamine compound. As a method for introducing the polymerizable functional group into the derivative having a structure represented by (A3), there are a method in which the polymerizable functional group is directly introduced; and a method in which a structure having the polymerizable functional group or a functional group to be formed into a precursor of a polymerizable functional group is introduced. Examples of the latter method include a method in which a functional group-containing aryl group is introduced into a halogenated compound of phenanthrolinequinone by a cross-coupling reaction using a palladium catalyst and a base; a method in which a functional group-containing alkyl group is introduced by a cross-coupling reaction using a $FeCl_3$ catalyst and a base; and a method in which after lithiation, an epoxy compound or $CO_2$ is allowed to react to introduce a hydroxyalkyl group or a carboxyl group.

A derivative having a structure represented by (A4) is available from, for example, Tokyo Chemical Industry Co., Ltd., Sigma-Aldrich Japan K.K., or Johnson Matthey Japan Inc. Alternatively, the derivative can also be synthesized from an acenaphthenequinone derivative by a synthetic method described in Tetrahedron Letters, Vol. 43, issue 16, pp. 2991-2994 (2002) or Tetrahedron Letters, Vol. 44, issue 10, pp. 2087-2091 (2003). A dicyanomethylene group can also be introduced by reaction with malononitrile.

A compound represented by (A4) contains a polymerizable functional group (a hydroxy group, a thiol group, an amino group, a carboxyl group, or a methoxy group) that can be polymerized with the melamine compound or the guanamine compound. As a method for introducing the polymerizable functional group into the derivative having a structure represented by (A4), there are a method in which the polymerizable functional group is directly introduced; and a method in which a structure having the polymerizable functional group or a functional group to be formed into a precursor of a polymerizable functional group is introduced. Examples of the latter method include a method in which a functional group-containing aryl group is introduced into a halogenated compound of acenaphthenequinone by a cross-coupling reaction using a palladium catalyst and a base; a method in which a functional group-containing alkyl group is introduced by a cross-coupling reaction using a $FeCl_3$ catalyst and a base; and a method in which after lithiation, an epoxy compound or $CO_2$ is allowed to react to introduce a hydroxyalkyl group or a carboxyl group.

A derivative having a structure represented by (A5) is available from, for example, Tokyo Chemical Industry Co., Ltd., Sigma-Aldrich Japan K.K., or Johnson Matthey Japan Inc. Alternatively, the derivative can also be synthesized from a fluorenone derivative and malononitrile by a synthetic method described in U.S. Pat. No. 4,562,132. In addition, the derivative can also be synthesized from a fluorenone derivative and an aniline derivative by a synthetic method described in Japanese Patent Laid-Open No. 5-279582 or 7-70038.

A compound represented by (A5) contains a polymerizable functional group (a hydroxy group, a thiol group, an amino group, a carboxyl group, or a methoxy group) that can be polymerized with the melamine compound or the guanamine compound. As a method for introducing the polymerizable functional group into the derivative having a structure represented by (A5), there are a method in which the polymerizable functional group is directly introduced; and a method in which a structure having the polymerizable functional group or a functional group to be formed into a precursor of a polymerizable functional group is introduced. Examples of the latter method include a method in which a functional group-containing aryl group is introduced into a halogenated compound of fluorenone by a cross-coupling reaction using a palladium catalyst and a base; a method in which a functional group-containing alkyl group is introduced by a cross-coupling reaction using a $FeCl_3$ catalyst and a base; and a method in which after lithiation, an epoxy compound or $CO_2$ is allowed to react to introduce a hydroxyalkyl group or a carboxyl group.

A derivative having a structure represented by (A6) can be synthesized by a synthetic method described in, Chemistry Letters, 37(3), pp. 360-361 (2008) or Japanese Patent Laid-Open No. 9-151157. Alternatively, the derivative is available from Tokyo Chemical Industry Co., Ltd., Sigma-Aldrich Japan K.K., or Johnson Matthey Japan Inc.

A compound represented by (A6) contains a polymerizable functional group (a hydroxy group, a thiol group, an amino group, a carboxyl group, or a methoxy group) that can be polymerized with the melamine compound or the guanamine compound. As a method for introducing the polymerizable functional group into the derivative having a structure represented by (A6), there is a method in which a structure having the polymerizable functional group or a functional group to be formed into a precursor of a polymerizable functional group is introduced into a naphthoquinone derivative. Examples of the method include a method in which a functional group-containing aryl group is introduced into a halogenated compound of naphthoquinone by a cross-coupling reaction using a palladium catalyst and a base; a method in which a functional group-containing alkyl group is introduced by a cross-coupling reaction using a $FeCl_3$ catalyst and a base; and a method in which after lithiation, an epoxy compound or $CO_2$ is allowed to react to introduce a hydroxyalkyl group or a carboxyl group.

A derivative having a structure represented by (A7) can be synthesized by a synthetic method described in Japanese Patent Laid-Open No. 1-206349 or the proceedings of PPCI/Japan Hardcopy '98, p. 207 (1998). For example, the derivative can be synthesized from a phenol derivative, which is available from Tokyo Chemical Industry Co., Ltd. or Sigma-Aldrich Japan K.K., serving as a raw material.

A compound represented by (A7) contains a polymerizable functional group (a hydroxy group, a thiol group, an amino group, a carboxyl group, or a methoxy group) that can be polymerized with the melamine compound or the guanamine compound. As a method for introducing the polymerizable functional group into the derivative having a structure represented by (A7), there is a method in which a structure having the polymerizable functional group or a functional group to be formed into a precursor of a polymerizable functional group is introduced. Examples of the method include a method in which a functional group-containing aryl group is introduced into a halogenated compound of diphenoquinone by a cross-coupling reaction using a palladium catalyst and a base; a method in which a functional group-containing alkyl group is introduced by a cross-coupling reaction using a $FeCl_3$ catalyst and a base; and a method in which after lithiation, an epoxy compound or $CO_2$ is allowed to react to introduce a hydroxyalkyl group or a carboxyl group.

A derivative having a structure represented by (A8) can be synthesized by a known synthetic method described in, for example, Journal of the American chemical society, Vol. 129, No. 49, pp. 15259-78 (2007). For example, the derivative can be synthesized by a reaction between perylenetetracarboxylic dianhydride and a monoamine derivative, which are available from Tokyo Chemical Industry Co., Ltd., Sigma-Aldrich Japan K.K., or Johnson Matthey Japan Inc.

A compound represented by (A8) contains a polymerizable functional group (a hydroxy group, a thiol group, an amino group, a carboxyl group, or a methoxy group) that can be polymerized with the melamine compound or the guanamine compound. As a method for introducing the polymerizable functional group into the derivative having a structure represented by (A8), there are a method in which the polymerizable functional group is directly introduced; and a method in which a structure having the polymerizable functional group or a functional group that can be formed into a precursor of a polymerizable functional group is introduced. Examples of the latter method include a method in which a cross-coupling reaction of a halogenated compound of a perylene imide derivative is used with a palladium catalyst and a base; and a method in which a cross-coupling reaction is used with a $FeCl_3$ catalyst and a base. There is a method in which a perylenetetracarboxylic dianhydride derivative or a monoamine derivative containing the polymerizable functional group or a functional group that can be formed into a precursor of the polymerizable functional group is used as a raw material for the synthesis of the perylene imide derivative.

A derivative having a structure represented by (A9) is available from, for example, Tokyo Chemical Industry Co., Ltd., Sigma-Aldrich Japan K.K., or Johnson Matthey Japan Inc.

A compound represented by (A9) contains a polymerizable functional group (a hydroxy group, a thiol group, an amino group, a carboxyl group, or a methoxy group) that can be polymerized with the melamine compound or the guanamine compound. As a method for introducing the polymerizable functional group into the derivative having a structure represented by (A9), there is a method in which a structure having the polymerizable functional group or a functional group to be formed into a precursor of a polymerizable functional group is introduced into a commercially available anthraquinone derivative. Examples of the method include a method in which a functional group-containing aryl group is introduced into a halogenated compound of anthraquinone by a cross-coupling reaction using a palladium catalyst and a base; a method in which a functional group-containing alkyl group is introduced by a cross-coupling reaction using a $FeCl_3$ catalyst and a base; and a method in which after lithiation, an epoxy compound or $CO_2$ is allowed to react to introduce a hydroxyalkyl group or a carboxyl group.

Resin

The resin containing a polymerizable functional group capable of reacting with the melamine compound or the guanamine compound is described below. The resin contains the group represented by the formula (i). The resin is prepared by the polymerization of a monomer containing a polymerizable functional group (a hydroxy group, a thiol group, an amino group, a carboxyl group, or a methoxy group), the monomer being available from, for example, Sigma-Aldrich Japan K.K., or Tokyo Chemical Industry Co., Ltd.

Alternatively, the resin can usually be purchased. Examples of the resin that can be purchased include polyether polyol-based resins, such as AQD-457 and AQD-473 manufactured by Nippon Polyurethane Industry Co., Ltd. and SANNIX GP-400 and GP-700 manufactured by Sanyo Chemical Industries, Ltd.; polyester polyol-based resins, such as PHTHALKYD W2343 manufactured by Hitachi Chemical Company, Ltd., Watersol S-118 and CD-520 and BECKOLITE M-6402-50 and M-6201-401M manufactured by DIC Corporation, HARIDIP WH-1188 manufactured by Harima Chemicals Group, Inc., and ES3604 and ES6538 manufactured by Japan U-PiCA Company, Ltd.; polyacrylic polyol-based resins, such as BURNOCK WE-300 and WE-304 manufactured by DIC Corporation; polyvinyl alcohol-based resins, such as KURARAY POVAL PVA-203 manufactured by Kuraray Co., Ltd.; polyvinyl acetal-based resins, such as BX-1, BM-1, KS-1, and KS-5 manufactured by Sekisui Chemical Co., Ltd.; polyamide-based resins, such as Toresin FS-350 manufactured by Nagase ChemteX Corporation; carboxyl group-containing resins, such as AQUALIC manufactured by Nippon Shokubai Co., Ltd., and FINELEX SG2000 manufactured by Namariichi Co., Ltd.; polyamine resins, such as LUCKAMIDE manufactured by DIC Corporation; and polythiol resins, such as QE-340M manufactured by Toray Industries, Inc. Among these products, polyvinyl acetal-based resins, polyester polyol-based resins, and so forth may be used from the viewpoint of polymerizability and the uniformity of the undercoat layer.

The weight-average molecular weight (Mw) of the resin is preferably in the range of 5,000 or more and 400,000 or less and more preferably 5,000 or more and 300,000 or less.

Examples of quantitative methods of functional groups in the resin include the titration of carboxyl groups with potassium hydroxide; the titration of amino groups with sodium nitrite; the titration of hydroxy groups with acetic anhydride and potassium hydroxide; the titration of thiol group with 5,5'-dithiobis(2-nitrobenzoic acid); and a calibration curve method using a calibration curve obtained from IR spectra of samples having different functional group contents.

Subsequently, specific examples of the resin are described below.

TABLE 28

| | Structure | | | Per | Another | Molecular |
|---|---|---|---|---|---|---|
| | $R^{61}$ | $Y^1$ | $D^1$ | gram | moiety | weight |
| B1 | H | single bond | OH | 3.3 mmol | butyral | $1 \times 10^5$ |
| B2 | H | single bond | OH | 3.3 mmol | butyral | $4 \times 10^4$ |
| B3 | H | single bond | OH | 3.3 mmol | butyral | $2 \times 10^4$ |
| B4 | H | single bond | OH | 1.0 mmol | polyolefin | $1 \times 10^5$ |
| B5 | H | single bond | OH | 3.0 mmol | ester | $8 \times 10^4$ |
| B6 | H | single bond | OH | 2.5 mmol | polyether | $5 \times 10^4$ |
| B7 | H | single bond | OH | 2.8 mmol | cellulose | $3 \times 10^4$ |

TABLE 28-continued

| | Structure | | | Per | Another | Molecular |
|---|---|---|---|---|---|---|
| | $R^{61}$ | $Y^1$ | $D^1$ | gram | moiety | weight |
| B8 | H | single bond | COOH | 3.5 mmol | polyolefin | $6 \times 10^4$ |
| B9 | H | single bond | $NH_2$ | 1.2 mmol | polyamide | $2 \times 10^5$ |
| B10 | H | single bond | SH | 1.3 mmol | polyolefin | $9 \times 10^3$ |
| B11 | H | phenylene | OH | 2.8 mmol | polyolefin | $4 \times 10^3$ |
| B12 | H | single bond | OH | 3.0 mmol | butyral | $7 \times 10^4$ |
| B13 | H | single bond | OH | 2.9 mmol | polyester | $2 \times 10^4$ |
| B14 | H | single bond | OH | 2.5 mmol | polyester | $6 \times 10^3$ |
| B15 | H | single bond | OH | 2.7 mmol | polyester | $8 \times 10^4$ |
| B16 | H | single bond | COOH | 1.4 mmol | polyolefin | $2 \times 10^5$ |
| B17 | H | single bond | COOH | 2.2 mmol | polyester | $9 \times 10^3$ |
| B18 | H | single bond | COOH | 2.8 mmol | polyester | $8 \times 10^2$ |
| B19 | $CH_3$ | alkylene | OH | 1.5 mmol | polyester | $2 \times 10^4$ |
| B20 | $C_2H_5$ | alkylene | OH | 2.1 mmol | polyester | $1 \times 10^4$ |
| B21 | $C_2H_5$ | alkylene | OH | 3.0 mmol | polyester | $5 \times 10^4$ |
| B22 | H | single bond | $OCH_3$ | 2.8 mmol | polyolefin | $7 \times 10^3$ |
| B23 | H | single bond | OH | 3.3 mmol | butyral | $2.7 \times 10^5$ |
| B24 | H | single bond | OH | 3.3 mmol | butyral | $4 \times 10^5$ |
| B25 | H | single bond | OH | 2.5 mmol | acetal | $3.4 \times 10^5$ |

The ratio of the functional groups contained in the melamine compound and the guanamine compound to the sum of the polymerizable functional groups in the resin and the electron-transporting substance (a compound having a structure represented by any one of (A1) to (A9)) may be 1:0.5 to 1:3.0 because the proportion of the functional groups that react is increased.

A solvent to prepare the undercoat layer coating liquid may be freely-selected from alcohols, aromatic solvents, halogenated hydrocarbons, ketones, ketone alcohols, ethers, esters, and so forth. Specific examples of the solvent that may be used include organic solvents, such as methanol, ethanol, n-propanol, isopropanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used separately or in combination as a mixture of two or more.

The curability of the undercoat layer was checked as described below. A coating film of the undercoat layer coating liquid containing the resin, the electron-transporting substance, and the melamine compound or the guanamine compound was formed on an aluminum sheet with a Meyer bar. The coating film was dried by heating at 160° C. for 40 minutes to form an undercoat layer. The resulting undercoat layer was immersed in a cyclohexanone/ethyl acetate (1/1) solvent mixture for 2 minutes and then dried at 160° C. for 5 minutes. The weight of the undercoat layer was measured before and after the immersion. In examples, it was confirmed that the elution of a component of the undercoat layer due to the immersion (weight difference: within ±2%) did not occur.

Support

The support may be a support having electrical conductivity (conductive support). Examples of the support that may be used include supports composed of metals, such as aluminum, nickel, copper, gold, and iron, and alloys; and a support in which a thin film composed of a metal, for example, aluminum, silver, or gold, or a conductive material, for example, indium oxide or tin oxide, is formed on an insulating base composed of, for example, a polyester resin, a polycarbonate resin, a polyimide resin, or glass.

A surface of the support may be subjected to electrochemical treatment, such as anodic oxidation, or a process, for example, wet honing, blasting, or cutting in order to improve the electric characteristics and inhibit interference fringes.

A conductive layer may be provided between the support and the undercoat layer. The conductive layer is formed by forming a coating film composed of a conductive layer coating liquid containing conductive particles dispersed in a resin on a support and drying the coating film. Examples of the conductive particles include carbon black, acetylene black, powders of metals composed of aluminum, nickel, iron, nichrome, copper, zinc, and silver, and powders of metal oxides, such as conductive tin oxide and indium tin oxide (ITO).

Examples of the resin include polyester resins, polycarbonate resins, polyvinyl butyral resins, acrylic resins, silicone resins, epoxy resins, melamine resins, urethane resins, phenolic resins, and alkyd resins.

Examples of a solvent for the conductive layer coating liquid include ether-based solvents, alcohol-based solvents, ketone-based solvents, and aromatic hydrocarbon solvents. The conductive layer preferably has a thickness of 0.2 μm or more and 40 μm or less, more preferably 1 μm or more and 35 μm or less, and still more preferably 5 μm or more and 30 μm or less.

Photosensitive Layer

The photosensitive layer is provided on the undercoat layer.

Examples of the charge-generating substance include azo pigment, perylene pigments, anthraquinone derivatives, anthanthrone derivatives, dibenzopyrenequinone derivatives, pyranthrone derivatives, violanthrone derivatives, isoviolanthrone derivatives, indigo derivatives, thioindigo derivatives, phthalocyanine pigments, such as metal phthalocyanines and non-metal phthalocyanines, and bisbenzimidazole derivatives. Among these compounds, azo pigments and phthalocyanine pigments may be used. Among phthalocyanine pigments, oxytitanium phthalocyanine, chlorogallium phthalocyanine, and hydroxygallium phthalocyanine may be used.

In the case where the photosensitive layer is a laminated photosensitive layer, examples of a binder resin used for the charge-generating layer include polymers and copolymers of vinyl compounds, such as styrene, vinyl acetate, vinyl chloride, acrylates, methacrylates, vinylidene fluoride, and trifluoroethylene; polyvinyl alcohol resins, polyvinyl acetal resins, polycarbonate resins, polyester resins, polysulfone resins, polyphenylene oxide resins, polyurethane resins, cellulose resins, phenolic resins, melamine resins, silicone resins, and epoxy resins. Among these compounds, polyester resins, polycarbonate resins, and polyvinyl acetal resins may be used. Polyvinyl acetal may be used.

In the charge-generating layer, the ratio of the charge-generating substance to the binder resin (charge-generating substance/binder resin) is preferably in the range of 10/1 to 1/10 and more preferably 5/1 to 1/5. Examples of a solvent used for a charge-generating layer coating liquid include alcohol-based solvents, sulfoxide-based solvents, ketone-based solvents, ether-based solvents, ester-based solvents, and aromatic hydrocarbon solvents.

The charge-generating layer may have a thickness of 0.05 μm or more and 5 μm or less.

Examples of a hole-transporting substance include polycyclic aromatic compounds, heterocyclic compounds, hydrazone compounds, styryl compounds, benzidine compounds, triarylamine compounds, and triphenylamine, and also include polymers having groups derived from these compounds on their main chains or side chains.

In the case where the photosensitive layer is a laminated photosensitive layer, examples of a binder resin used for the charge-transporting layer (hole-transporting layer) include polyester resins, polycarbonate resins, polymethacrylate resins, polyarylate resins, polysulfone resins, and polystyrene resins. Among these resins, polycarbonate resins and polyarylate resins may be used. The weight-average molecular weight (Mw) of each of the resins may be in the range of 10,000 or more and 300,000 or less.

In the charge-transporting layer, the ratio of the charge-transporting substance to the binder resin (charge-transporting substance/binder resin) is preferably in the range of 10/5 to 5/10 and more preferably 10/8 to 6/10. The charge-transporting layer may have a thickness of 5 μm or more and 40 μm or less. Examples of a solvent used for a charge-transporting layer coating liquid include alcohol-based solvents, sulfoxide-based solvents, ketone-based solvents, ether-based solvents, ester-based solvents, and aromatic hydrocarbon solvents.

Another layer, such as a second undercoat layer that does not contain the polymer according to an embodiment of the present invention, may be provided between the support and the undercoat layer or between the undercoat layer and the photosensitive layer.

A protective layer (surface protective layer) containing a binder resin and conductive particles or a charge-transporting substance may be provided on the photosensitive layer (charge-transporting layer). The protective layer may further contain an additive, such as a lubricant. The binder resin in the protective layer may have conductivity or charge transportability. In that case, the protective layer may not contain conductive particles or a charge-transporting substance other than the resin. The binder resin in the protective layer may be a thermoplastic resin or a curable resin to be cured by polymerization due to, for example, heat, light, or radiation (e.g., an electron beam).

As a method for forming layers, such as the undercoat layer, the charge-generating layer, and the charge-transporting layer, constituting the electrophotographic photosensitive member, a method may be employed in which coating liquids prepared by dissolving and/or dispersing materials constituting the layers in solvents are applied, and the resulting coating films are dried and/or cured to form the layers. Examples of a method for applying a coating liquid include an immersion coating method (dip coating method), a spray coating method, a curtain coating method, and a spin coating method. Among these methods, the immersion coating method may be employed from the viewpoint of efficiency and productivity.

Process Cartridge and Electrophotographic Apparatus

Figure 1:
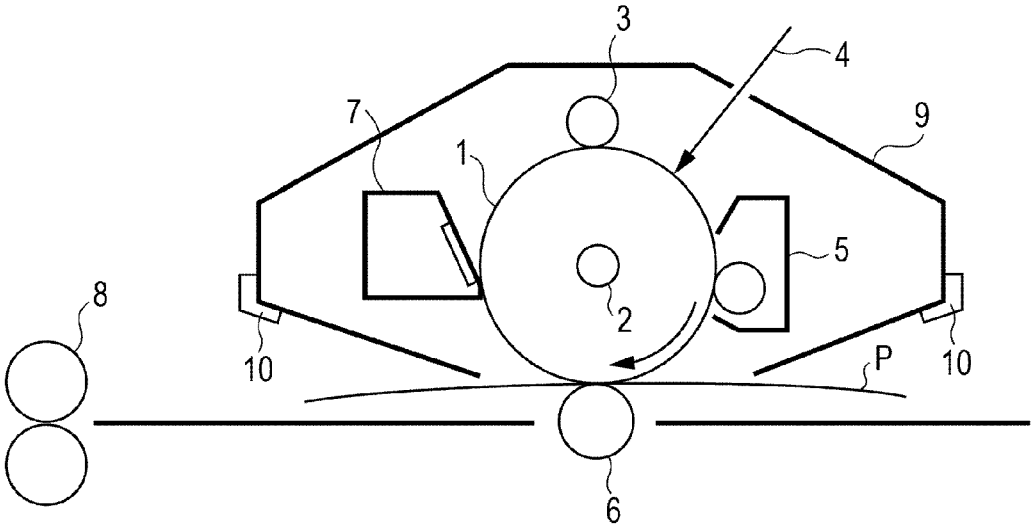
FIG. 1 illustrates a schematic structure of an electrophotographic apparatus including a process cartridge with an electrophotographic photosensitive member.

FIG. 1 illustrates a schematic structure of an electrophotographic apparatus including a process cartridge with an electrophotographic photosensitive member.

In FIG. 1, reference numeral 1 denotes a cylindrical electrophotographic photosensitive member, which is rotationally driven around a shaft 2 at a predetermined peripheral speed in the direction indicated by an arrow. A surface (peripheral surface) of the rotationally driven electrophotographic photosensitive member 1 is uniformly charged to a predetermined positive or negative potential with a charging device 3 (a primary charging device: for example, a charging roller). Then, the surface receives exposure light (image exposure light) 4 emitted from an exposure device (not illustrated) employing, for example, slit exposure or laser beam scanning exposure. In this way, an electrostatic latent image corresponding to a target image is successively formed on the surface of the electrophotographic photosensitive member 1.

The electrostatic latent image formed on the surface of the electrophotographic photosensitive member 1 is then developed with a toner in a developer of a developing device 5 to form a toner image. The toner image formed and held on the surface of the electrophotographic photosensitive member 1 is sequentially transferred onto a transfer material (for example, paper) P by a transfer bias from a transferring device (for example, a transferring roller) 6. The transfer material P is removed from a transfer material feeding unit (not illustrated) in synchronization with the rotation of the electrophotographic photosensitive member 1 and fed to a portion (contact portion) between the electrophotographic photosensitive member 1 and the transferring device 6.

The transfer material P to which the toner image has been transferred is separated from the surface of the electrophotographic photosensitive member 1, conveyed to a fixing device 8, and subjected to fixation of the toner image. The transferred material P is then conveyed as an image formed product (print or copy) to the outside of the apparatus.

The surface of the electrophotographic photosensitive member 1 after the transfer of the toner image, is cleaned by removing the residual developer (toner) after the transfer with a cleaning device (for example, a cleaning blade) 7. The electrophotographic photosensitive member 1 is subjected to charge elimination by pre-exposure light (not illustrated) emitted from a pre-exposure device (not illustrated) and then is repeatedly used for image formation. As illustrated in FIG. 1, in the case where the charging device 3 is a contact charging device using, for example, a charging roller, the pre-exposure light is not always required.

Plural components selected from the components, such as the electrophotographic photosensitive member 1, the charging device 3, the developing device 5, the transferring device 6, and the cleaning device 7 may be arranged in a housing and integrally connected into a process cartridge. The process cartridge may be detachably attached to the main body of an electrophotographic apparatus, for example, a copier or a laser beam printer. In FIG. 1, the electrophotographic photosensitive member 1, the charging device 3, the developing device 5, and the cleaning device 7 are integrally supported into a process cartridge 9 detachably attached to the main body of the electrophotographic apparatus using a guiding member 10, such as a rail.

EXAMPLES

The present invention will be described in more detail below by examples. Here, the term "part(s)" in examples indicates "part(s) by mass". Synthesis examples of electron-transporting substances according to an embodiment of the present invention will now be described.

Synthesis Example 1

First, 5.4 parts of naphthalenetetracarboxylic dianhydride (manufactured by Tokyo Chemical Industry Co., Ltd.), 4 parts of 2-methyl-6-ethylaniline (manufactured by Tokyo Chemical Industry Co., Ltd.), and 3 parts of 2-amino-1-butanol were added to 200 parts of dimethylacetamide under a nitrogen atmosphere. The mixture was stirred at room temperature for 1 hour to prepare a solution. After the preparation of the solution, the solution was refluxed for 8 hours. The precipitate was separated by filtration and recrystallized in ethyl acetate to give 1.0 part of compound A1-8.

Synthesis Example 2

First, 5.4 parts of naphthalenetetracarboxylic dianhydride and 5 parts of 2-aminobutyric acid (manufactured by Tokyo Chemical Industry Co., Ltd.) were added to 200 parts of dimethylacetamide under a nitrogen atmosphere. The mixture was stirred at room temperature for 1 hour to prepare a solution. After the preparation of the solution, the solution was refluxed for 8 hours. The precipitate was separated by filtration and recrystallized in ethyl acetate to give 4.6 parts of compound A1-42.

Synthesis Example 3

First, 5.4 parts of naphthalenetetracarboxylic dianhydride, 4.5 parts of 2,6-diethylaniline (manufactured by Tokyo Chemical Industry Co., Ltd.) and 4 parts of 4-2-aminobenzenethiol were added to 200 parts of dimethylacetamide under a nitrogen atmosphere. The mixture was stirred at room temperature for 1 hour to prepare a solution. After the preparation of the solution, the solution was refluxed for 8 hours. The precipitate was separated by filtration and recrystallized in ethyl acetate to give 1.3 parts of compound A1-39.

Synthesis Example 4

To a solvent mixture of 100 parts of toluene and 50 parts of ethanol, 7.4 parts of 3,6-dibromo-9,10-phenanthrenedione, which was synthesized from 2.8 parts of 4-(hydroxymethyl) phenylboronic acid (manufactured by Sigma-Aldrich Japan K.K.) and phenanthrenequinone (manufactured by Sigma-Aldrich Japan K.K.) under a nitrogen atmosphere by a synthetic method described in Chem. Educator No. 6, pp. 227-234, (2001), was added. After 100 parts of an aqueous solution of 20% sodium carbonate was added dropwise to the mixture, 0.55 parts of tetrakis(triphenylphosphine)palladium (0) was added thereto. The resulting mixture was refluxed for 2 hours. After the reaction, the organic phase was extracted with chloroform, washed with water, and dried over anhydrous sodium sulfate. After the solvent was removed under reduced pressure, the residue was purified by silica-gel chromatography to give 3.2 parts of compound A2-24.

Synthesis Example 5

As with synthesis example 4, 7.4 parts of 2,7-dibromo-9,10-phenanthrolinequinone was synthesized from 2.8 parts of 3-aminophenylboronic acid monohydrate and phenanthrolinequinone (manufactured by Sigma-Aldrich Japan K.K.) under a nitrogen atmosphere. To a solvent mixture of 100 parts of toluene and 50 parts of ethanol, 7.4 parts of 2,7-dibromo-9,10-phenanthrolinequinone was added. After 100 parts of an aqueous solution of 20% sodium carbonate was added dropwise to the mixture, 0.55 parts of tetrakis(triphenylphosphine)palladium(0) was added thereto. The resulting mixture was refluxed for 2 hours. After the reaction, the organic phase was extracted with chloroform, washed with water, and dried over anhydrous sodium sulfate. After the solvent was removed under reduced pressure, the residue was purified by silica-gel chromatography to give 2.2 parts of compound A3-18.

Synthesis Example 6

First, 7.4 parts of perylenetetracarboxylic dianhydride (manufactured by Tokyo Chemical Industry Co., Ltd.), 4 parts of 2,6-diethylaniline (manufactured by Tokyo Chemical Industry Co., Ltd.), and 4 parts of 2-aminophenylethanol were added to 200 parts of dimethylacetamide under a nitrogen atmosphere. The mixture was stirred at room temperature for 1 hour to prepare a solution. After the preparation of the solution, the solution was refluxed for 8 hours. The precipitate was separated by filtration and recrystallized in ethyl acetate to give 5.0 parts of compound A8-3.

Synthesis Example 7

First, 5.4 parts of naphthalenetetracarboxylic dianhydride and 5.2 parts of leucinol (manufactured by Tokyo Chemical Industry Co., Ltd.) were added to 200 parts of dimethylacetamide under a nitrogen atmosphere. The mixture was stirred at room temperature for 1 hour and then refluxed for 7 hours. After the removal of dimethylacetamide by distillation under reduced pressure, recrystallization was performed in ethyl acetate to give 5.0 parts of compound A1-54.

Synthesis Example 8

First, 5.4 parts of naphthalenetetracarboxylic dianhydride, 2.6 parts of leucinol, and 2.7 parts of 2-(2-aminoethylthio) ethanol (manufactured by Wako Pure Chemical Industries, Ltd.) were added to 200 parts of dimethylacetamide under a nitrogen atmosphere. The mixture was stirred at room temperature for 1 hour and then refluxed for 7 hours. After dimethylacetamide was removed from a dark brown solution by distillation under reduced pressure, the resulting product was dissolved in an ethyl acetate/toluene mixed solution. After separation was performed by silica-gel column chromatography (eluent: ethyl acetate/toluene), a fraction containing a target product was concentrated. The resulting crystals were recrystallized in toluene/hexane mixed solution to give 2.5 parts of compound A1-55. The production and the evaluation of an electrophotographic photosensitive member will be described below.

Example 1

An aluminum cylinder (JIS-A3003, aluminum alloy) having a length of 260.5 mm and a diameter of 30 mm was used as a support (conductive support).

Next, 50 parts of titanium oxide particles covered with oxygen-deficient tin oxide (powder resistivity: 120 Ω•cm, coverage of tin oxide: 40%), 40 parts of a phenolic resin (Plyophen J-325, manufactured by Dainippon Ink and Chemicals Inc., resin solid content: 60%), and 50 parts of methoxypropanol as a solvent (dispersion medium) were charged into a sand mill with glass beads of 1 mm in diameter. The mixture was subjected to dispersion treatment for 3 hours to prepare a conductive layer coating liquid (dispersion). The conductive layer coating liquid was applied onto the support by dipping. The resulting coating film was dried and thermally cured for 30 minutes at 150° C. to form a conductive layer having a thickness of 28 μm.

The average particle size of the titanium oxide particles covered with oxygen-deficient tin oxide in the conductive layer coating liquid was measured with a particle size distribution analyzer (trade name: CAPA700) made by HORIBA Ltd., by a centrifugal sedimentation method using tetrahydrofuran as a dispersion medium at a number of revolutions of 5000 rpm and found to be 0.31 μm.

Next, 5 parts of compound (A1-8), 3.5 parts of melamine compound (C1-3), 3.4 parts of resin (B1), and 0.1 parts of dodecylbenzenesulfonic acid serving as a catalyst were dissolved in a solvent mixture of 100 parts of dimethylacetamide and 100 parts of methyl ethyl ketone to prepare an undercoat layer coating liquid.

The undercoat layer coating liquid was applied onto the conductive layer by dipping. The resulting coating film was cured (polymerized) by heating for 40 minutes at 160° C. to form an undercoat layer having a thickness of 0.5 μm. Table 29 illustrates structures identified by solid-state $^{13}$C-NMR measurement, mass spectrometry measurement, MS-spectrum measurement by pyrolysis GC-MS analysis, and characteristic absorption measurement by infrared spectrophotometry.

Next, 10 parts of a hydroxygallium phthalocyanine crystal (charge-generating substance) of a crystal form that exhibits strong peaks at 7.5°, 9.9°, 12.5°, 16.3°, 18.6°, 25.1°, and 28.3° of Bragg angles (2θ±0.2°) in X-ray diffraction with CuKα characteristic radiation, 5 parts of polyvinyl butyral resin (trade name: S-LEC BX-1, manufactured by Sekisui Chemical Co., Ltd.), and 250 parts of cyclohexanone were charged into a sand mill with glass beads of 1 mm in diameter and subjected to dispersion treatment for 1.5 hours. Then 250 parts of ethyl acetate was added thereto to prepare a charge-generating layer coating liquid.

The charge-generating layer coating liquid was applied onto the undercoat layer by dipping. The resulting coating film was dried for 10 minutes at 100° C. to form a charge-generating layer having a thickness of 0.18 μm.

Next, 8 parts of an amine compound (hole-transporting substance) represented by the following structural formula (15) and 10 parts of a polyarylate resin having a repeating structural unit represented by the following formula (16-1) and a repeating structural unit represented by the following formula (16-2) in a ratio of 5/5 and having a weight-average molecular weight (Mw) of 100,000 were dissolved in a solvent mixture of 40 parts of dimethoxymethane and 60 parts of o-xylene to prepare a charge-transporting layer coating liquid. The charge-transporting layer coating liquid was applied onto the charge-generating layer by dipping. The resulting coating film was dried for 40 minutes at 120° C. to form a charge-transporting layer (hole-transporting layer) having a thickness of 15 μm.

(15)

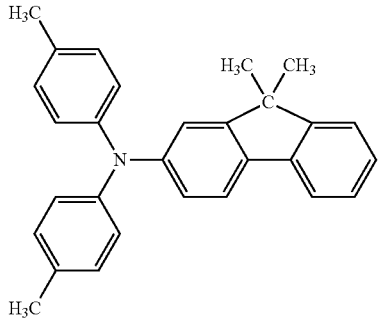

-continued (16-1)

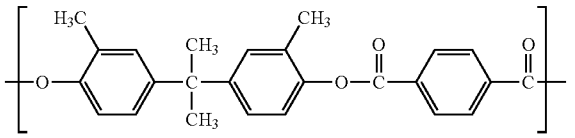

(16-2)

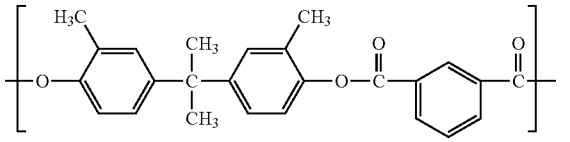

In this way, an electrophotographic photosensitive member having the conductive layer, the undercoat layer, the charge-generating layer, and the charge-transporting layer on the support was produced.

Evaluation

The produced electrophotographic photosensitive member was mounted on a modified printer (primary charging: roller contact DC charging, process speed: 120 mm/sec, laser exposure) of a laser beam printer (trade name: LBP-2510) manufactured by CANON KABUSHIKI KAISHA under an environment of 23° C. and 50% RH. The evaluation of output images was performed. The details are described below.

Evaluation of Positive Ghost

A process cartridge for a cyan color of the laser beam printer was modified. A potential probe (model: 6000B-8, manufactured by Trek Japan Co., Ltd.) was installed at a developing position. A potential at the middle portion of the electrophotographic photosensitive member was measured with a surface potentiometer (model: 344, manufactured by Trek Japan Co., Ltd.). The amounts of light used to expose an image were set in such a manner that the dark potential (Vd) was −500 V and the light potential (V1) was −150 V.

The produced electrophotographic photosensitive member was mounted on the process cartridge for the cyan color of the laser beam printer. The resulting process cartridge was mounted on a station of a cyan process cartridge. Images were output.

First, a sheet of a solid white image, five sheets of an image for evaluating a ghost, a sheet of a solid black image, and five sheets of the image for evaluating a ghost were continuously output in that order.

Next, full-color images (text images of colors each having a print percentage of 1%) were output on 5,000 sheets of A4-size plain paper. Thereafter, a sheet of a solid white image, five sheets of the image for evaluating a ghost, a sheet of a solid black image, and five sheets of the image for evaluating a ghost were continuously output in that order.

Figure 2:
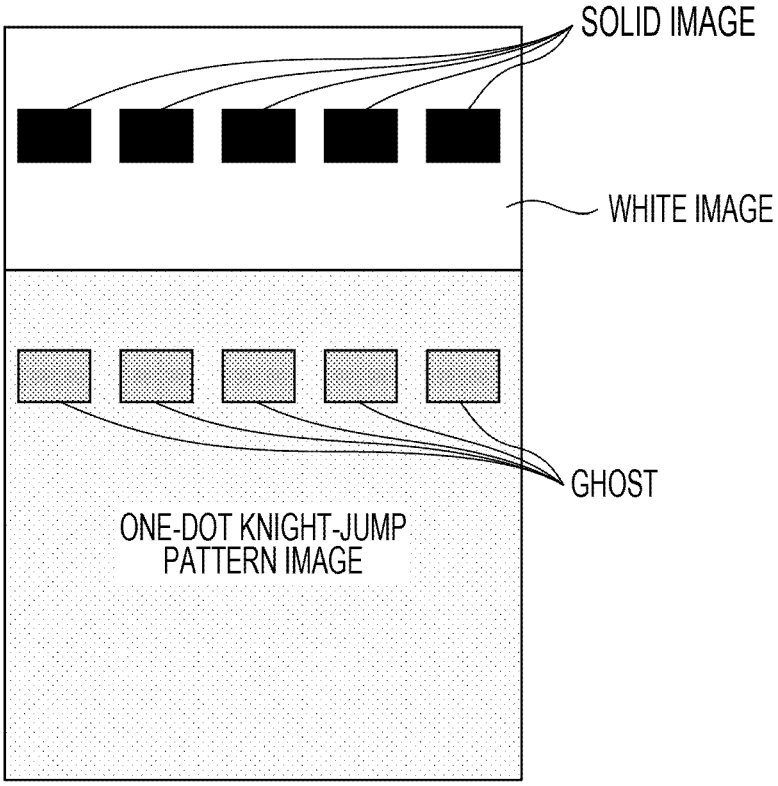
FIG. 2 illustrates an image for evaluating a ghost, the image being used in evaluating a ghost image.
Figure 3:
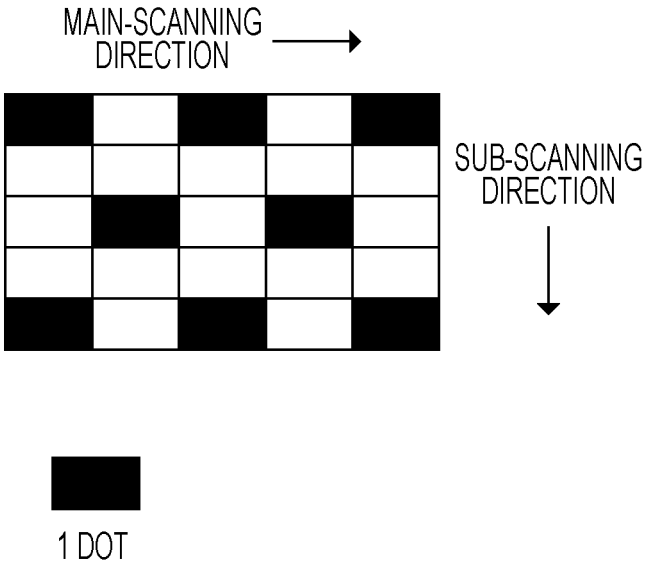
FIG. 3 illustrates a one-dot, knight-jump pattern image.

As illustrated in FIG. 2, the image for evaluating a ghost are an image in which after solid square images are output on a white image in the leading end portion of a sheet, a one-dot, knight-jump pattern halftone image illustrated in FIG. 3 is formed. In FIG. 2, portions expressed as "GHOST" are portions where ghosts attributed to the solid images might appear.

The evaluation of the positive ghost was performed by the measurement of differences in image density between the one-dot, knight-jump pattern halftone image and the ghost portions. The differences in image density were measured with a spectral densitometer (trade name: X-Rite 504/508, manufactured by X-Rite) at 10 points in one sheet of the image for evaluating a ghost. This operation was performed for all the 10 sheets of the image for evaluating a ghost to calculate the average of a total of 100 points. A difference in Macbeth density (initial) was evaluated at the time of the initial image output. Next, a difference (change) between a difference in Macbeth density after the output of 5,000 sheets and the difference in Macbeth density at the time of the initial image output was calculated to determine a change in Macbeth density difference. A smaller difference in Macbeth density indicates better suppression of the positive ghost. A smaller difference between the Macbeth density difference after the output of 5,000 sheets and the Macbeth density difference at the time of the initial image output indicates a smaller change of the positive ghost. Table 29 describes the results.

Examples 2 to 115

Electrophotographic photosensitive members were produced as in Example 1, except that the types and the contents of the electron-transporting substance, the resin (resin B), the melamine compound, and the guanamine compound were changed as described in Tables 29 to 31. The evaluation of the positive ghost was similarly performed. Tables 29 to 31 describe the results.

Example 116

An electrophotographic photosensitive member was produced as in Example 1, except that the preparation of the conductive layer coating liquid, the undercoat layer coating liquid, and the charge-transporting layer coating liquid was changed as described below. The evaluation of the positive ghost was similarly performed. Table 31 describes the results.

The preparation of the conductive layer coating liquid was changed as described below. First, 214 parts of titanium oxide ($TiO_2$) particles, serving as metal oxide particles, covered with oxygen-deficient tin oxide ($SnO_2$), 132 parts of a phenolic resin (trade name: Plyophen J-325) serving as a binder resin, and 98 parts of 1-methoxy-2-propanol serving as a solvent were charged into a sand mill with 450 parts of glass beads of 0.8 mm in diameter. The mixture was subjected to dispersion treatment under conditions including a number of revolutions of 2,000 rpm, a dispersion treatment time of 4.5 hours, and a preset temperature of cooling water of 18° C. to prepare a dispersion. The glass beads were removed from the dispersion with a mesh (opening size: 150 μm).

Silicone resin particles (trade name: Tospearl 120, manufactured by Momentive Performance Materials Inc., average particle size: 2 μm) serving as a surface-roughening material were added to the dispersion in an amount of 10% by mass with respect to the total mass of the metal oxide particles and the binder resin in the dispersion after the removal of the glass beads. Furthermore, a silicone oil (trade name: SH28PA, manufactured by Dow Corning Toray Co., Ltd.) serving as a leveling agent was added to the dispersion in an amount of 0.01% by mass with respect to the total mass of the metal oxide particles and the binder resin in the dispersion. The resulting mixture was stirred to prepare a conductive layer coating liquid. The conductive layer coating liquid was applied onto the support by dipping. The resulting coating film was dried and thermally cured for 30 minutes at 150° C. to form a conductive layer having a thickness of 30 μm.

The preparation of the undercoat layer coating liquid was changed as described below. First, 5 parts of compound (A1-54), 3.5 parts of melamine compound ($C_{1-3}$), 3.4 parts of resin (B25), and 0.1 parts of dodecylbenzenesulfonic acid serving as a catalyst were dissolved in a solvent mixture of 100 parts of dimethylacetamide and 100 parts of methyl ethyl ketone to prepare an undercoat layer coating liquid. The undercoat layer coating liquid was applied onto the conductive layer by dipping. The resulting coating film was cured (polymerized) by heating for 40 minutes at 160° C. to form an undercoat layer having a thickness of 0.5 μm. Table 31 illustrates a structure identified by solid-state $^{13}$C-NMR measurement, mass spectrometry measurement, MS-spectrum measurement by pyrolysis GC-MS analysis, and characteristic absorption measurement by infrared spectrophotometry.

The preparation of the charge-transporting layer coating liquid was changed as described below. First, 9 parts of the charge-transporting substance having the structure represented by the foregoing formula (15), 1 part of a charge-transporting substance having a structure represented by the following formula (18), as resins, 3 parts of polyester resin F (weight-average molecular weight: 90,000) which had a repeating structural unit represented by the following formula (24) and which had a repeating structural unit represented by the following formula (26) and a repeating structural unit represented by the following formula (25) in a ratio of 7:3, and 7 parts of polyester resin H (weight-average molecular weight: 120,000) having a repeating structural unit represented by the following formula (27) and a repeating structural unit represented by the following formula (28) in a ratio of 5:5 were dissolved in a solvent mixture of 30 parts of dimethoxymethane and 50 parts of o-xylene to prepare a charge-transporting layer coating liquid. In polyester resin F, the content of the repeating structural unit represented by the formula (24) was 10% by mass, and the content of the repeating structural units represented by the formulae (25) and (26) was 90% by mass.

(24)

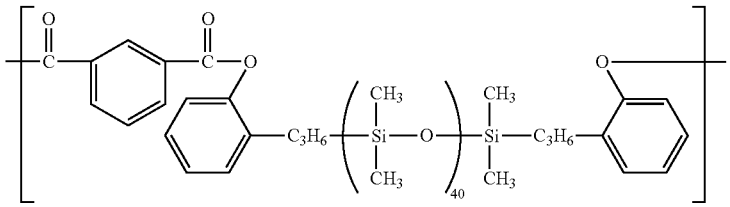

(25)

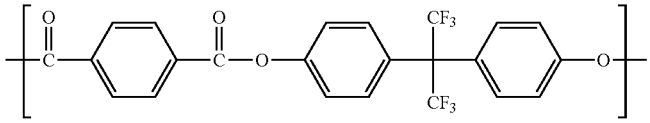

(26)

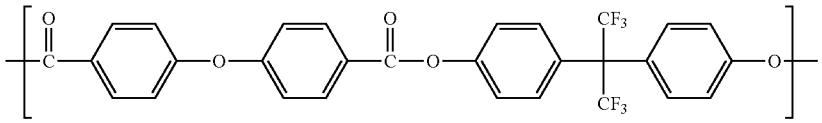

(27)

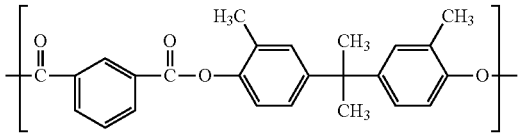

(28)

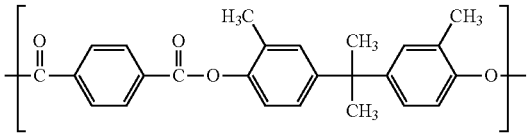

(18)

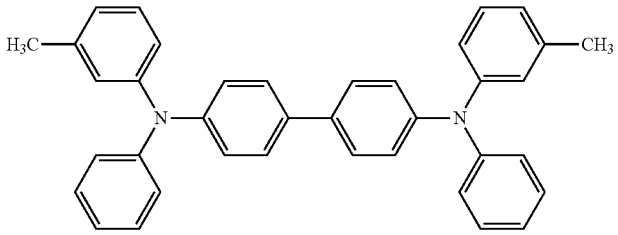

The charge-transporting layer coating liquid was applied onto the charge-generating layer by dipping and dried for 1 hour at 120° C. to form a charge-transporting layer having a thickness of 16 μm. It was confirmed that the resulting charge-transporting layer had a domain structure in which polyester resin F was contained in a matrix containing the charge-transporting substance and polyester resin H.

Example 117

An electrophotographic photosensitive member was produced as in Example 116, except that the preparation of the charge-transporting layer coating liquid was changed as described below. The evaluation of the positive ghost was similarly performed. Table 31 describes the results.

The preparation of the charge-transporting layer coating liquid was changed as described below. First, 9 parts of the charge-transporting substance having the structure represented by the foregoing formula (15), 1 part of the charge-transporting substance having the structure represented by the foregoing formula (18), as resins, 10 parts of polycarbonate resin I (weight-average molecular weight: 70,000) having a repeating structure represented by the following formula (29), and 0.3 parts of polycarbonate resin J (weight-average molecular weight: 40,000) having a repeating structural unit represented by the following formula (29), a repeating structural unit represented by the following formula (30), and a structure which was represented by the following formula (31) and which was located at least one of the ends were dissolved in a solvent mixture of 30 parts of dimethoxymethane and 50 parts of o-xylene to prepare a charge-transporting layer coating liquid. In polyester resin J, the total mass of the repeating structural units represented by the formulae (30) and (31) was 30% by mass. The charge-transporting layer coating liquid was applied onto the charge-generating layer by dipping and dried for 1 hour at 120° C. to form a charge-transporting layer having a thickness of 16 μm.

(29)

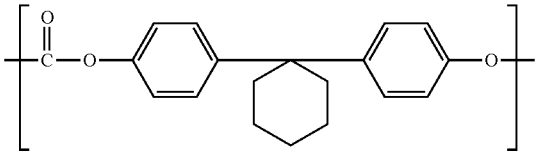

(30)

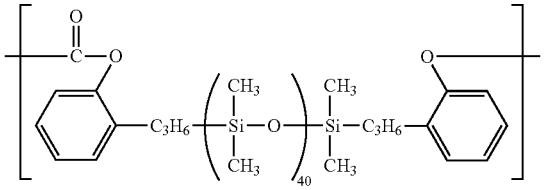

(31)

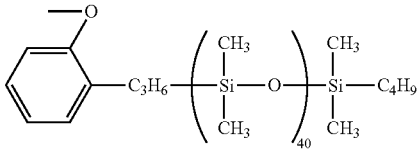

Example 118

An electrophotographic photosensitive member was produced as in Example 117, except that in the preparation of the charge-transporting layer coating liquid, 10 parts of polyester resin H (weight-average molecular weight: 120,000) was used in place of 10 parts of polycarbonate resin I (weight-average molecular weight: 70,000). The evaluation of the positive ghost was similarly performed. Table 31 describes the results.

Examples 119 to 121

Electrophotographic photosensitive members were produced as in Examples 116 to 118, except that the preparation of the conductive layer coating liquids were changed as described below. The evaluation of the positive ghost was similarly performed. Table 31 describes the results.

First, 207 parts of titanium oxide ($TiO_2$) particles, serving as metal oxide particles, covered with phosphorus (P)-doped tin oxide ($SnO_2$), 144 parts of a phenolic resin (trade name: Plyophen J-325) serving as a binder resin, and 98 parts of 1-methoxy-2-propanol serving as a solvent were charged into a sand mill with 450 parts of glass beads of 0.8 mm in diameter. The mixture was subjected to dispersion treatment under conditions including a number of revolutions of 2,000 rpm, a dispersion treatment time of 4.5 hours, and a preset temperature of cooling water of 18° C. to prepare a dispersion. The glass beads were removed from the dispersion with a mesh (opening size: 150 μm).

Silicone resin particles (trade name: Tospearl 120) serving as a surface-roughening material were added to the dispersion in an amount of 15% by mass with respect to the total mass of the metal oxide particles and the binder resin in the dispersion after the removal of the glass beads. Furthermore, a silicone oil (trade name: SH28PA) serving as a leveling agent was added to the dispersion in an amount of 0.01% by mass with respect to the total mass of the metal oxide particles and the binder resin in the dispersion. The resulting mixture was stirred to prepare a conductive layer coating liquid. The conductive layer coating liquid was applied onto the support by dipping. The resulting coating film was dried and thermally cured for 30 minutes at 150° C. to form a conductive layer having a thickness of 30 μm.

Examples 122 and 123

Electrophotographic photosensitive members were produced as in Example 116, except that the type of electron-transporting substance was changed as described in Table 31. The evaluation of the positive ghost was similarly performed. Table 31 describes the results.

TABLE 29

| | | Electron-transporting substance | | Melamine compound, guanamine compound | | Resin | | | |
|---|---|---|---|---|---|---|---|---|---|
| | Specific | | Parts by | | Parts by | | Parts by | Macbeth density | |
| Example No. | example | Type | mass | Type | mass | Type | mass | Change | Initial |
| Example 1 | 101 | A1-8 | 5 | C1-3 | 3.5 | B1 | 3.4 | 0.006 | 0.026 |
| Example 2 | 101 | A1-8 | 6 | C1-3 | 3.5 | B1 | 3.4 | 0.006 | 0.025 |
| Example 3 | 101 | A1-8 | 7 | C1-3 | 3.5 | B1 | 3.4 | 0.006 | 0.024 |
| Example 4 | 101 | A1-8 | 4 | C1-3 | 3.5 | B1 | 3.4 | 0.007 | 0.028 |
| Example 5 | 101 | A1-8 | 8 | C1-3 | 3.5 | B1 | 3.0 | 0.006 | 0.023 |
| Example 6 | 101 | A1-8 | 5 | C1-2 | 2.5 | B1 | 3.4 | 0.006 | 0.025 |
| Example 7 | 101 | A1-8 | 5 | C1-11 | 3.3 | B1 | 3.4 | 0.006 | 0.024 |
| Example 8 | 101 | A1-8 | 5 | C1-10 | 3.5 | B2 | 3.4 | 0.006 | 0.025 |
| Example 9 | 101 | A1-8 | 5 | C1-12 | 3.5 | B3 | 3.4 | 0.006 | 0.025 |
| Example 10 | 102 | A1-8 | 5 | C1-6 | 3.2 | B19 | 3.4 | 0.006 | 0.025 |
| Example 11 | 103 | A1-8 | 5 | C1-5 | 2.5 | B20 | 3.4 | 0.006 | 0.024 |
| Example 12 | 103 | A1-8 | 5 | C1-2 | 2.5 | B20 | 3.4 | 0.006 | 0.024 |
| Example 13 | 103 | A1-8 | 5 | C1-7 | 3.5 | B21 | 3.0 | 0.006 | 0.025 |
| Example 14 | 103 | A1-8 | 5 | C1-8 | 3.5 | B21 | 3.0 | 0.006 | 0.025 |

TABLE 29-continued

| Example No. | Specific example | Electron-transporting substance Type | Parts by mass | Melamine compound, guanamine compound Type | Parts by mass | Resin Type | Parts by mass | Macbeth density Change | Macbeth density Initial |
|---|---|---|---|---|---|---|---|---|---|
| Example 15 | 101 | A1-8 | 5 | C1-5 | 2.5 | B1 | 3.4 | 0.006 | 0.025 |
| Example 16 | 101 | A1-8 | 5 | C1-6 | 3.2 | B1 | 3.4 | 0.006 | 0.026 |
| Example 17 | 109 | A1-36 | 5 | C1-3 | 3.5 | B1 | 3.7 | 0.006 | 0.027 |
| Example 18 | 110 | A1-37 | 5 | C1-3 | 3.5 | B8 | 1.6 | 0.007 | 0.025 |
| Example 19 | 111 | A1-38 | 5 | C1-3 | 3.5 | B9 | 4.0 | 0.006 | 0.026 |
| Example 20 | 112 | A1-39 | 5 | C1-3 | 3.5 | B10 | 4.0 | 0.006 | 0.025 |
| Example 21 | 114 | A1-40 | 5 | C1-3 | 3.5 | B2 | 4.0 | 0.006 | 0.026 |
| Example 22 | 132 | A1-22 | 5 | C2-12 | 2.7 | B1 | 4.0 | 0.006 | 0.026 |
| Example 23 | 115 | A1-42 | 5 | C1-3 | 8.4 | B10 | 3.0 | 0.007 | 0.025 |
| Example 24 | 116 | A1-44 | 5 | C1-3 | 3.5 | B2 | 3.5 | 0.006 | 0.026 |
| Example 25 | 117 | A1-45 | 5 | C1-3 | 3.5 | B2 | 0.4 | 0.006 | 0.026 |
| Example 26 | 125 | A1-8 | 5 | C2-3 | 2.4 | B2 | 1.4 | 0.006 | 0.025 |
| Example 27 | 131 | A1-33 | 5 | C2-4 | 2.9 | B12 | 1.4 | 0.007 | 0.027 |
| Example 28 | 108 | A1-34 | 5 | C1-10 | 3.5 | B12 | 1.2 | 0.006 | 0.025 |
| Example 29 | 118 | A1-46 | 5 | C1-7 | 3.5 | B12 | 3.5 | 0.006 | 0.026 |
| Example 30 | 119 | A1-47 | 5 | C1-6 | 3.4 | B12 | 3.1 | 0.006 | 0.025 |
| Example 31 | 133 | A1-37 | 5 | C2-4 | 3.3 | B8 | 3.4 | 0.006 | 0.027 |
| Example 32 | 134 | A1-38 | 5 | C2-4 | 3.3 | B9 | 3.4 | 0.006 | 0.025 |
| Example 33 | 135 | A1-39 | 5 | C2-4 | 3.3 | B10 | 3.4 | 0.007 | 0.026 |
| Example 34 | 120 | A1-22 | 5 | C1-9 | 3.0 | B2 | 3.4 | 0.006 | 0.025 |
| Example 35 | 136 | A1-22 | 5 | C2-18 | 3.0 | B1 | 3.4 | 0.006 | 0.027 |
| Example 36 | 509 | A5-39 | 5 | C2-11 | 3.3 | B1 | 2.5 | 0.006 | 0.026 |
| Example 37 | 510 | A5-39 | 5 | C2-17 | 3.3 | B3 | 2.5 | 0.006 | 0.026 |
| Example 38 | 501 | A5-39 | 5 | C1-5 | 3.5 | B20 | 1.3 | 0.006 | 0.028 |
| Example 39 | 504 | A5-41 | 5 | C1-9 | 3.5 | B1 | 1.3 | 0.007 | 0.025 |
| Example 40 | 511 | A5-41 | 5 | C2-1 | 2.1 | B1 | 1.0 | 0.007 | 0.028 |
| Example 41 | 513 | A5-42 | 5 | C2-16 | 2.2 | B20 | 2.0 | 0.007 | 0.027 |
| Example 42 | 505 | A5-40 | 5 | C1-1 | 2.1 | B8 | 1.3 | 0.006 | 0.026 |
| Example 43 | 506 | A5-40 | 5 | C1-4 | 2.1 | B16 | 1.0 | 0.006 | 0.026 |
| Example 44 | 514 | A5-40 | 5 | C2-13 | 2.1 | B16 | 1.3 | 0.006 | 0.028 |
| Example 45 | 507 | A5-43 | 5 | C1-2 | 3.0 | B9 | 1.5 | 0.006 | 0.027 |
| Example 46 | 517 | A5-43 | 5 | C2-8 | 3.0 | B9 | 1.5 | 0.007 | 0.028 |
| Example 47 | 601 | A6-14 | 5 | C1-4 | 2.0 | B1 | 1.4 | 0.007 | 0.032 |
| Example 48 | 607 | A6-16 | 5 | C2-13 | 2.1 | B8 | 0.8 | 0.006 | 0.035 |
| Example 49 | 602 | A6-16 | 5 | C1-4 | 2.1 | B8 | 1.4 | 0.006 | 0.035 |
| Example 50 | 603 | A6-15 | 5 | C1-1 | 2.1 | B1 | 1.5 | 0.007 | 0.035 |

TABLE 30

| Example No. | Specific example | Electron-transporting substance Type | Parts by mass | Melamine compound, guanamine compound Type | Parts by mass | Resin Type | Parts by mass | Macbeth density Change | Macbeth density Initial |
|---|---|---|---|---|---|---|---|---|---|
| Example 51 | 604 | A6-14 | 5 | C1-4 | 2.2 | B20 | 1.4 | 0.007 | 0.037 |
| Example 52 | 605 | A6-17 | 5 | C1-4 | 2.2 | B9 | 1.5 | 0.007 | 0.034 |
| Example 53 | 701 | A7-19 | 5 | C1-7 | 3.6 | B1 | 3.0 | 0.007 | 0.033 |
| Example 54 | 702 | A7-20 | 5 | C1-3 | 3.6 | B1 | 3.0 | 0.007 | 0.035 |
| Example 55 | 706 | A7-21 | 5 | C2-4 | 2.9 | B17 | 2.1 | 0.006 | 0.032 |
| Example 56 | 703 | A7-22 | 5 | C1-6 | 3.3 | B10 | 3.5 | 0.006 | 0.037 |
| Example 57 | 701 | A7-19 | 5 | C1-11 | 3.3 | B3 | 3.4 | 0.007 | 0.036 |
| Example 58 | 702 | A7-20 | 5 | C1-12 | 3.3 | B1 | 3.5 | 0.007 | 0.035 |
| Example 59 | 704 | A7-23 | 5 | C1-7 | 3.6 | B9 | 2.5 | 0.006 | 0.035 |
| Example 60 | 801 | A8-3 | 5 | C1-3 | 3.5 | B5 | 3.0 | 0.006 | 0.035 |
| Example 61 | 801 | A8-3 | 5 | C1-10 | 3.5 | B6 | 3.3 | 0.006 | 0.037 |
| Example 62 | 802 | A8-5 | 5 | C1-3 | 3.5 | B14 | 3.0 | 0.006 | 0.035 |
| Example 63 | 803 | A8-12 | 5 | C1-7 | 3.5 | B16 | 4.0 | 0.006 | 0.032 |
| Example 64 | 804 | A8-13 | 5 | C1-12 | 3.4 | B9 | 4.5 | 0.006 | 0.037 |
| Example 65 | 805 | A8-14 | 5 | C1-10 | 3.3 | B10 | 4.5 | 0.006 | 0.036 |
| Example 66 | 806 | A8-19 | 5 | C1-8 | 3.5 | B21 | 4.5 | 0.006 | 0.032 |
| Example 67 | 205 | A2-19 | 5 | C2-15 | 2.8 | B17 | 1.1 | 0.006 | 0.046 |
| Example 68 | 206 | A2-20 | 5 | C2-17 | 2.3 | B10 | 1.1 | 0.007 | 0.045 |
| Example 69 | 207 | A2-21 | 5 | C2-16 | 2.7 | B1 | 0.4 | 0.006 | 0.045 |
| Example 70 | 201 | A2-22 | 5 | C1-6 | 3.3 | B9 | 2.2 | 0.007 | 0.043 |
| Example 71 | 208 | A2-23 | 5 | C2-3 | 2.5 | B10 | 0.4 | 0.006 | 0.045 |
| Example 72 | 301 | A3-16 | 5 | C1-2 | 3.5 | B1 | 1.1 | 0.007 | 0.043 |
| Example 73 | 302 | A3-17 | 5 | C1-6 | 3.5 | B17 | 0.5 | 0.006 | 0.045 |
| Example 74 | 303 | A3-18 | 5 | C1-5 | 2.5 | B9 | 1.5 | 0.007 | 0.046 |

TABLE 30-continued

| | | Electron-transporting substance | | Melamine compound, guanamine compound | | Resin | | | |
|---|---|---|---|---|---|---|---|---|---|
| | Specific | | Parts by | | Parts by | | Parts by | Macbeth density | |
| Example No. | example | Type | mass | Type | mass | Type | mass | Change | Initial |
| Example 75 | 401 | A4-12 | 5 | C1-5 | 3.5 | B14 | 1.6 | 0.006 | 0.047 |
| Example 76 | 406 | A4-14 | 5 | C2-6 | 2.8 | B23 | 0.2 | 0.007 | 0.048 |
| Example 77 | 407 | A4-15 | 5 | C2-15 | 2.4 | B17 | 0.4 | 0.006 | 0.045 |
| Example 78 | 402 | A4-17 | 5 | C1-12 | 3.4 | B10 | 0.3 | 0.006 | 0.045 |
| Example 79 | 403 | A4-31 | 5 | C1-10 | 3.4 | B1 | 2.6 | 0.007 | 0.047 |
| Example 80 | 901 | A9-28 | 5 | C1-6 | 3.5 | B8 | 1.8 | 0.007 | 0.048 |
| Example 81 | 126 | A1-8 | 5 | C2-13 | 2.8 | B3 | 3.0 | 0.008 | 0.026 |
| Example 82 | 125 | A1-38 | 5 | C1-9 | 2.4 | B9 | 3.3 | 0.008 | 0.027 |
| Example 83 | 131 | A1-48 | 5 | C1-2 | 2.6 | B2 | 3.4 | 0.008 | 0.027 |
| Example 84 | 121 | A1-22 | 5 | C1-7 | 3.5 | B14 | 3.5 | 0.008 | 0.027 |
| Example 85 | 121 | A1-22 | 5 | C1-10 | 3.5 | B23 | 3.5 | 0.008 | 0.024 |
| Example 86 | 501 | A5-39 | 5 | C1-8 | 3.5 | B20 | 3.5 | 0.008 | 0.026 |
| Example 87 | 515 | A5-41 | 5 | C2-15 | 3.6 | B14 | 1.5 | 0.009 | 0.026 |
| Example 88 | 516 | A5-42 | 5 | C2-7 | 3.3 | B23 | 1.1 | 0.009 | 0.026 |
| Example 89 | 505 | A5-40 | 5 | C1-5 | 3.9 | B8 | 1.4 | 0.008 | 0.027 |
| Example 90 | 608 | A6-15 | 5 | C2-17 | 3.6 | B19 | 0.8 | 0.008 | 0.036 |
| Example 91 | 606 | A6-15 | 5 | C1-2 | 3.1 | B19 | 0.8 | 0.008 | 0.035 |
| Example 92 | 707 | A7-2 | 5 | C2-8 | 3.5 | B1 | 0.9 | 0.009 | 0.033 |
| Example 93 | 708 | A7-19 | 5 | C2-1 | 2.2 | B1 | 0.6 | 0.008 | 0.035 |
| Example 94 | 709 | A7-20 | 5 | C2-2 | 2.3 | B11 | 1.5 | 0.009 | 0.037 |
| Example 95 | 803 | A8-12 | 5 | C1-6 | 3.4 | B8 | 3.0 | 0.008 | 0.037 |
| Example 96 | 807 | A8-19 | 5 | C2-9 | 2.9 | B3 | 2.0 | 0.008 | 0.037 |
| Example 97 | 408 | A4-6 | 5 | C2-4 | 3.7 | B1 | 2.0 | 0.009 | 0.048 |
| Example 98 | 303 | A3-18 | 5 | C1-12 | 3.3 | B9 | 3.0 | 0.008 | 0.046 |
| Example 99 | 902 | A9-2 | 5 | C1-9 | 3.3 | B2 | 2.8 | 0.008 | 0.046 |
| Example 100 | 505 | A5-40 | 5 | C1-7 | 5.6 | B17 | 1.4 | 0.011 | 0.028 |

TABLE 31

| | | Electron-transporting substance | | Melamine compound, guanamine compound | | Resin | | | |
|---|---|---|---|---|---|---|---|---|---|
| | Specific | | Parts by | | Parts by | | Parts by | Macbeth density | |
| Example No. | example | Type | mass | Type | mass | Type | mass | Change | Initial |
| Example 101 | 808 | A8-12 | 5 | C2-2 | 2.4 | B8 | 1.5 | 0.011 | 0.037 |
| Example 102 | 601 | A6-14 | 5 | C1-7 | 3.8 | B23 | 1.5 | 0.011 | 0.037 |
| Example 103 | 903 | A9-29 | 5 | C1-7 | 3.0 | B1 | 2.0 | 0.012 | 0.047 |
| Example 104 | 124 | A1-51 | 8 | C1-7 | 2.5 | B1 | 3.0 | 0.018 | 0.047 |
| Example 105 | 137 | A1-51 | 8 | C2-4 | 2.5 | B15 | 3.0 | 0.018 | 0.047 |
| Example 106 | 132 | A1-49 | 5 | C1-2 | 3.2 | B8 | 3.3 | 0.020 | 0.030 |
| Example 107 | 139 | A1-49 | 5 | C2-8 | 3.2 | B16 | 3.3 | 0.020 | 0.031 |
| Example 108 | 138 | A1-50 | 5 | C2-13 | 3.2 | B13 | 3.3 | 0.020 | 0.030 |
| Example 109 | 409 | A4-32 | 5 | C2-16 | 3.0 | B3 | 3.0 | 0.024 | 0.049 |
| Example 110 | 508 | A5-44 | 5 | C1-3 | 3.2 | B14 | 3.3 | 0.020 | 0.029 |
| Example 111 | 204 | A2-21 | 5 | C1-4 | 2.7 | B11 | 3.0 | 0.018 | 0.046 |
| Example 112 | 405 | A4-31 | 5 | C1-4 | 2.6 | B11 | 3.0 | 0.018 | 0.045 |
| Example 113 | 904 | A9-28 | 5 | C1-4 | 5.9 | B18 | 2.1 | 0.026 | 0.047 |
| Example 114 | 905 | A9-2 | 5 | C1-7 | 3.4 | B24 | 3.1 | 0.022 | 0.046 |
| Example 115 | 305 | A3-2 | 5 | C2-4 | 3.0 | B24 | 3.0 | 0.022 | 0.046 |
| Example 116 | 140 | A1-54 | 5 | C1-3 | 3.5 | B25 | 3.4 | 0.006 | 0.025 |
| Example 117 | 140 | A1-54 | 5 | C1-3 | 3.5 | B25 | 3.4 | 0.006 | 0.025 |
| Example 118 | 140 | A1-54 | 5 | C1-3 | 3.5 | B25 | 3.4 | 0.006 | 0.025 |
| Example 119 | 140 | A1-54 | 5 | C1-3 | 3.5 | B25 | 3.4 | 0.006 | 0.027 |
| Example 120 | 140 | A1-54 | 5 | C1-3 | 3.5 | B25 | 3.4 | 0.006 | 0.026 |
| Example 121 | 140 | A1-54 | 5 | C1-3 | 3.5 | B25 | 3.4 | 0.006 | 0.026 |
| Example 122 | 141 | A1-55 | 5 | C1-3 | 3.5 | B25 | 3.4 | 0.006 | 0.025 |
| Example 123 | 142 | A1-57 | 5 | C1-3 | 3.5 | B25 | 3.4 | 0.006 | 0.025 |

Comparative Examples 1 to 5

Electrophotographic photosensitive members were produced as in Example 1, except that no resin was contained and that the types and the contents of the electron-transporting substance, the melamine compound, and the guanamine compound were changed as described in Table 32. The evaluation of the positive ghost was similarly performed. Table 32 describes the results.

Comparative Examples 6 to 10

Electrophotographic photosensitive members were produced as in Example 1, except that the electron-transporting substance was changed to a compound represented by the following formula (Y-1) and that the types and the contents of the melamine compound, the guanamine compound, and the resin were changed as described in Table 32. The evaluation of the positive ghost was similarly performed. Table 32 describes the results.

(Y-1)

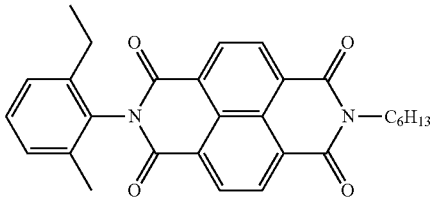

Comparative Example 11

An electrophotographic photosensitive member was produced as in Example 1, except that the undercoat layer was formed from a block copolymer represented by the following structural formula (copolymer described in PCT Japanese Translation Patent Publication No. 2009-505156), a blocked isocyanate compound, and a vinyl chloride-vinyl acetate copolymer. The evaluation was performed. The initial Macbeth density was 0.048, and a change in Macbeth density was 0.065.

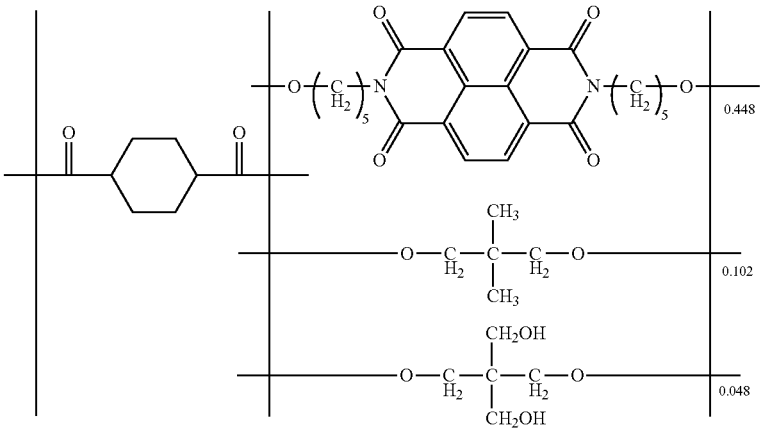

TABLE 32

| | Electron-transporting substance | | Melamine compound, guanamine compound | | Resin | | Macbeth density | |
|---|---|---|---|---|---|---|---|---|
| Comparative Example No. | Specific example | Type | Parts by mass | Type | Parts by mass | Type | Parts by mass | Change |
| Comparative Example 1 | A1-36 | 5 | C1-3 | 9.3 | — | — | 0.050 | 0.024 |
| Comparative Example 2 | A1-37 | 5 | C1-3 | 9.2 | — | — | 0.049 | 0.025 |
| Comparative Example 3 | A1-38 | 5 | C1-3 | 8.1 | — | — | 0.051 | 0.025 |
| Comparative Example 4 | A6-14 | 5 | C2-3 | 6.4 | — | — | 0.053 | 0.033 |
| Comparative Example 5 | A5-42 | 5 | C1-2 | 5.9 | — | — | 0.052 | 0.033 |
| Comparative Example 6 | Y-1 | 5 | C1-3 | 8.1 | — | — | 0.064 | 0.045 |
| Comparative Example 7 | Y-1 | 5 | C2-3 | 6.4 | — | — | 0.063 | 0.043 |
| Comparative Example 8 | Y-1 | 5 | C1-2 | 4.2 | B14 | 2.2 | 0.064 | 0.045 |
| Comparative Example 9 | Y-1 | 5 | C1-3 | 3.3 | B14 | 1.4 | 0.062 | 0.044 |
| Comparative Example 10 | Y-1 | 5 | C2-3 | 4.9 | B14 | 2.1 | 0.065 | 0.045 |

Comparisons of examples with Comparative Examples 1 to 5 reveal that in some cases, the structures described in Japanese Patent Laid-Open Nos. 2003-330209 and 2008-299344 are not sufficiently highly effective in reducing the change of the positive ghost during repeated use, compared with the electrophotographic photosensitive member including the undercoat layer having a specific structure according to an embodiment of the present invention. The reason for this is presumably that the absence of a resin causes the uneven distribution of the triazine rings and the electron-transporting substance in the undercoat layer, so that electrons are liable to stay during repeated use. Comparison of examples with Comparative Example 11 reveals that in some cases, even the structure described in PCT Japanese Translation Patent Publication No. 2009-505156 is not sufficiently highly effective in reducing the change of the positive ghost during repeated use. Comparisons of examples with Comparative Examples 6 to 10 reveal that in a state in which the resin and the electron-transporting substance are not bound together and are dispersed after dissolution in the solvent, it is not sufficiently effective to reduce the initial positive ghost and the change of the positive ghost during repeated use. The reason for this is presumably that the effect of reducing the positive ghost owing to bonding with the triazine ring. This is presumably because when the charge-generating layer is formed on the undercoat layer, the electron-transporting substance moves to the upper layer (charge-generating layer); hence, the electron-transporting substance is reduced in the undercoat layer, and the incorporation of the electron-transporting substance into the upper layer causes the retention of electrons.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-147161 filed Jun. 29, 2012, No. 2013-093091 filed Apr. 25, 2013, and No. 2013-118067 filed Jun. 4, 2013, which are hereby incorporated by reference herein in their entirety.

What is claimed is:

1. An electrophotographic photosensitive member, comprising:

a support;

an undercoat layer formed on the support; and a photosensitive layer formed on the undercoat layer, wherein the undercoat layer comprises a structure represented by the following formula (C1), or a structure represented by the following formula (C2), (C1)

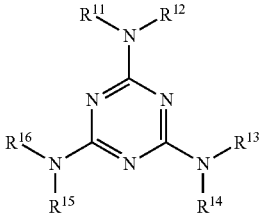

-continued (C2)

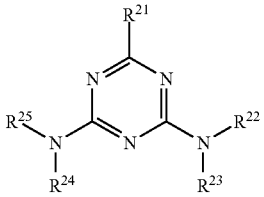

wherein, in the formulae (C1) and (C2), $R^{11}$ to $R^{16}$, and $R^{22}$ to $R^{25}$ each independently represent a hydrogen atom, a methylene group, a monovalent group represented by $—CH_2OR^2$, a group represented by the following formula (i), or a group represented by the following formula (ii), at least one of $R^{11}$ to $R^{16}$, and at least one of $R^{22}$ to $R^{25}$ are each the group represented by the formula (i), at least one of $R^{11}$ to $R^{16}$, and at least one of $R^{22}$ to $R^{25}$ are each the group represented by the formula (ii), $R^2$ represents a hydrogen atom or an alkyl group having 1 to 10 carbon atoms, and $R^{21}$ represents an alkyl group, a phenyl group, or a phenyl group substituted with an alkyl group, (i)

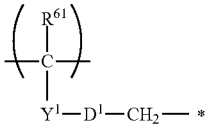

wherein, in the formula (i), $R^{61}$ represents a hydrogen atom or an alkyl group, $Y^1$ represents a single bond, an alkylene group, or a phenylene group, $D^1$ represents a divalent group represented by any one of the following formulae (D1) to (D4), and "*" in the formula (i) indicates the side to which a nitrogen atom in the formula (C1) or a nitrogen atom in the formula (C2) is bound, (D1)

(D2)

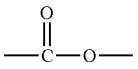

(D3)

(D4)

(ii)

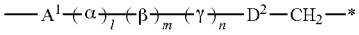

wherein, in the formula (ii), $D^2$ represents a divalent group represented by any one of the above formulae (D1) to (D4), α represents an alkylene group having 1 to 6 main-chain atoms, an alkylene group having 1 to 6 main-chain atoms and being substituted with an alkyl group having 1 to 6 carbon atoms, an alkylene group having 1 to 6 main-chain atoms and being substituted with a benzyl group, an alkylene group having 1 to 6 main-chain atoms and being substituted with an alkoxycarbonyl group, or an alkylene group having 1 to 6 main-chain atoms and being substituted with a phenyl group, one of the carbon atoms in the main chain of the alkylene group may be replaced with O, S, NH, or $NR^1$, $R^1$ representing an alkyl group having 1 to 6 carbon atoms, β represents a phenylene group, a phenylene group substituted with an alkyl group having 1 to 6 carbon atoms, a phenylene group substituted with a nitro group, or a phenylene group substituted with a halogen atom, γ represents an alkylene group having 1 to 6 main-chain atoms, or an alkyl group having 1 to 6 main-chain atoms and being substituted with an alkyl group having 1 to 6 carbon atoms, l, m, and n each independently represent 0 or 1, $A^1$ represents a divalent group represented by any one of the following formulae (A1) to (A9), and "*" in the formula (ii) indicates the side to which a nitrogen atom in the formula (C1) or a nitrogen atom in the formula (C2) is bound, (A1)

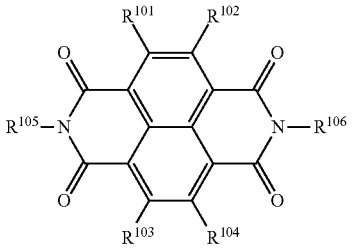

(A2)

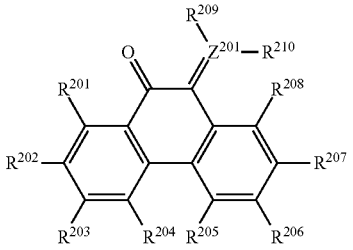

(A3)

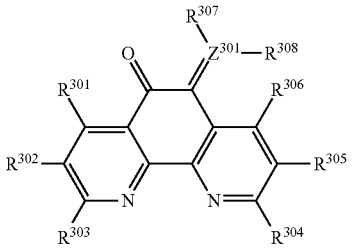

(A4)

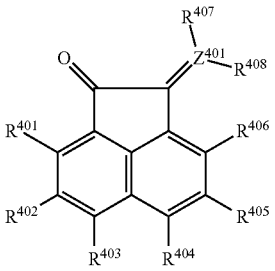

-continued (A5)

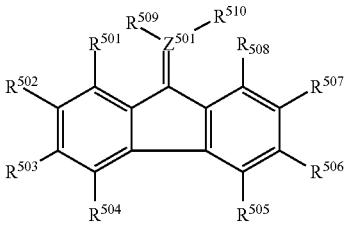

(A6)

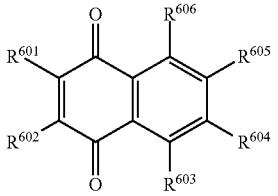

(A7)

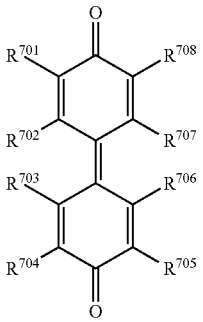

(A8)

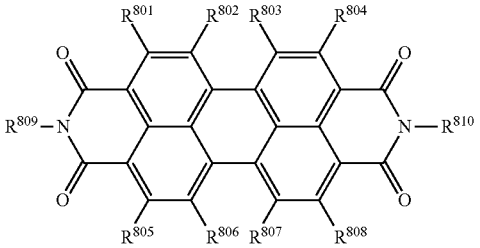

(A9)

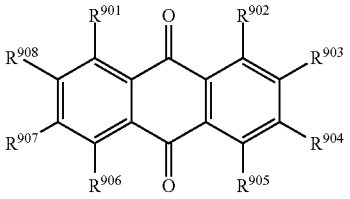

wherein, in the formulae (A1) to (A9), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$, and $R^{901}$ to $R^{908}$ each independently represent a single bond, a hydrogen atom, a halogen atom, a cyano group, a nitro group, an alkoxycarbonyl group, a carboxyl group, a dialkylamino group, a hydroxy group, an unsubstituted or substituted alkyl group, an unsubstituted or substituted aryl group, or an unsubstituted or substituted hetero ring, at least two of $R^{101}$ to $R^{106}$, at least two of $R^{201}$ to $R^{210}$, at least two of $R^{301}$ to $R^{308}$, at least two of $R^{401}$ to $R^{408}$ at least two of $R^{501}$ to $R^{510}$, at least two of $R^{601}$ to $R^{606}$, at least two of $R^{701}$ to $R^{708}$, at least two of $R^{801}$ to $R^{810}$, and at least two of $R^{901}$ to $R^{908}$ are the single bonds, a substituent of the substituted alkyl group is an alkyl group, an aryl group, a halogen atom, or a carbonyl group, a substituent of the substituted aryl group or hetero ring is a halogen atom, a nitro group, a cyano group, an alkyl group, a halogen-substituted alkyl group, an alkoxy group, or a carbonyl group, $Z^{201}$, $Z^{301}$, $Z^{401}$, and $Z^{501}$ each independently represent a carbon atom, a nitrogen atom, or an oxygen atom, $R^{209}$ and $R^{210}$ are absent when $Z^{201}$ is the oxygen atom, $R^{210}$ is absent when $Z^{201}$ is the nitrogen atom, $R^{307}$ and $R^{308}$ are absent when $Z^{301}$ is the oxygen atom, $R^{308}$ is absent when $Z^{301}$ is the nitrogen atom, $R^{407}$ and $R^{408}$ are absent when $Z^{401}$ is the oxygen atom, $R^{408}$ is absent when $Z^{401}$ is the nitrogen atom, $R^{509}$ and $R^{510}$ are absent when $Z^{501}$ is the oxygen atom, and $R^{510}$ is absent when $Z^{501}$ is the nitrogen atom.

2. An electrophotographic photosensitive member according to claim 1, wherein, in the formula (ii), α represents the alkylene group having 1 to 6 main-chain atoms, the alkylene group having 1 to 6 main-chain atoms and being substituted with the alkyl group having 1 to 6 carbon atoms, the alkylene group having 1 to 6 main-chain atoms and being substituted with the benzyl group, the alkylene group having 1 to 6 main-chain atoms and being substituted with the alkoxycarbonyl group, or the alkylene group having 1 to 6 main-chain atoms and being substituted with the phenyl group, one of the carbon atoms in the main chain of the alkylene group may be replaced with O, NH, or $NR^1$.

3. An electrophotographic photosensitive member according to claim 1, wherein the undercoat layer comprises a cured product having the structure represented by the formula (C1), or the structure represented by the formula (C2).

4. An electrophotographic photosensitive member according to claim 1, wherein the number of the main-chain atoms of the group represented by the formula (ii) except $A^1$, is from 2 to 9.

5. An electrophotographic photosensitive member according to claim 1, wherein, in the formula (ii), α is an alkylene group having 1 to 5 main-chain atoms and being substituted with an alkyl group having 1 to 4 carbon atoms, or an alkylene group having 1 to 5 main-chain atoms.

6. An electrophotographic photosensitive member according to claim 1, wherein, in the formula (ii), β is a phenylene group.

7. A process cartridge detachably attachable to a main body of an electrophotographic apparatus, wherein the process cartridge integrally supports:

the electrophotographic photosensitive member according to claim 1, and at least one device selected from the group consisting of a charging device, a developing device, a transferring device, and a cleaning device.

8. An electrophotographic apparatus comprising:

the electrophotographic photosensitive member according to claim 1;

a charging device;

an exposure device;

a developing device; and a transferring device.

* * * * *